US011603575B2

(12) United States Patent
Kataoka et al.

(10) Patent No.: US 11,603,575 B2
(45) Date of Patent: Mar. 14, 2023

(54) GRAIN-ORIENTED ELECTRICAL STEEL SHEET AND METHOD FOR PRODUCING THEREOF

(71) Applicant: NIPPON STEEL CORPORATION, Tokyo (JP)

(72) Inventors: Takashi Kataoka, Tokyo (JP); Nobusato Morishige, Tokyo (JP); Haruhiko Atsumi, Tokyo (JP); Kazutoshi Takeda, Tokyo (JP); Shin Furutaku, Tokyo (JP); Hirotoshi Tada, Tokyo (JP); Ryosuke Tomioka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 193 days.

(21) Appl. No.: 16/979,110

(22) PCT Filed: Mar. 19, 2019

(86) PCT No.: PCT/JP2019/011459
§ 371 (c)(1),
(2) Date: Sep. 8, 2020

(87) PCT Pub. No.: WO2019/181945
PCT Pub. Date: Sep. 26, 2019

(65) Prior Publication Data

US 2020/0399732 A1 Dec. 24, 2020

(30) Foreign Application Priority Data

Mar. 20, 2018 (JP) ..... JP2018-052898

(51) Int. Cl.
*C21D 9/46* (2006.01)
*C21D 8/12* (2006.01)
(Continued)

(52) U.S. Cl.
CPC ..... *C21D 9/46* (2013.01); *C21D 6/002* (2013.01); *C21D 6/005* (2013.01); *C21D 6/008* (2013.01);
(Continued)

(58) Field of Classification Search
CPC ..... C21D 6/002; C21D 6/005; C21D 6/008; C21D 8/1222; C21D 8/1233;
(Continued)

(56) References Cited

U.S. PATENT DOCUMENTS

2015/0243419 A1 8/2015 Senda et al.
2018/0371576 A1 12/2018 Park et al.

FOREIGN PATENT DOCUMENTS

GB 1 279 334 A 6/1972
GB 1279334 A * 6/1972 ..... C23C 24/00
(Continued)

OTHER PUBLICATIONS

"Methods of measurement of the magnetic properties of magnetic steel sheet and strip by means of a single sheet tester", JIS C 2556, (1996), total of 170 pages.
(Continued)

*Primary Examiner* — Jenny R Wu
(74) *Attorney, Agent, or Firm* — Birch, Stewart, Kolasch & Birch, LLP

(57) ABSTRACT

A grain-oriented electrical steel sheet includes: a silicon steel sheet including Si and Mn; a glass film arranged on a
(Continued)

surface of the silicon steel sheet; and an insulation coating arranged on a surface of the glass film, wherein the glass film includes a Mn-containing oxide.

17 Claims, 2 Drawing Sheets

(51) Int. Cl.

| | |
|---|---|
| ***C21D 6/00*** | (2006.01) |
| ***C22C 38/34*** | (2006.01) |
| ***C22C 38/20*** | (2006.01) |
| ***C22C 38/04*** | (2006.01) |
| ***C22C 38/00*** | (2006.01) |
| ***C22C 38/06*** | (2006.01) |

(52) U.S. Cl.
CPC ..... *C21D 8/1222* (2013.01); *C21D 8/1233* (2013.01); *C21D 8/1255* (2013.01); *C21D 8/1272* (2013.01); *C21D 8/1283* (2013.01); *C22C 38/001* (2013.01); *C22C 38/002* (2013.01); *C22C 38/008* (2013.01); *C22C 38/04* (2013.01); *C22C 38/06* (2013.01); *C22C 38/20* (2013.01); *C22C 38/34* (2013.01); *C21D 2201/05* (2013.01); *C22C 2202/02* (2013.01)

(58) Field of Classification Search
CPC .. C21D 8/1255; C21D 8/1272; C21D 8/1283; C21D 9/46; C21D 2201/05; H01F 1/147; C22C 2202/02; C22C 38/001; C22C 38/002; C22C 38/008; C22C 38/02; C22C 38/04; C22C 38/06; C22C 38/20; C22C 38/34; C22C 38/60
See application file for complete search history.

(56) References Cited

FOREIGN PATENT DOCUMENTS

| | | | | |
|---|---|---|---|---|
| JP | 48-37193 | B1 | | 11/1973 |
| JP | 50-71526 | A | | 6/1975 |
| JP | 62-133021 | A | | 6/1987 |
| JP | 63-7333 | A | | 1/1988 |
| JP | 63-310917 | A | | 12/1988 |
| JP | 2-240216 | A | | 9/1990 |
| JP | 2-259017 | A | | 10/1990 |
| JP | 5-295441 | A | | 11/1993 |
| JP | 6-33142 | A | | 2/1994 |
| JP | 10-212526 | A | | 8/1998 |
| JP | 11-61356 | A | | 3/1999 |
| JP | 2000-204450 | A | | 7/2000 |
| JP | 2003-27194 | A | | 1/2003 |
| JP | 2013-108149 | A | | 6/2013 |
| JP | 2013108149 | A | * | 6/2013 |
| WO | WO 2014/049770 | A1 | | 4/2014 |
| WO | WO 2017/105112 | A1 | | 6/2017 |

OTHER PUBLICATIONS

"Test methods for electrical steel strip and sheet", JIS C 2550-1, (2011), total of 114 pages.
International Search Report for PCT/JP2019/011459 (PCT/ISA/210) dated May 28, 2019.
Takayama et al., "Quantitative Analysis of Mineral Phases in Sinter Ore by Rietveld Method", Iron and steel, vol. 103 (2017), No. 6, pp. 397-406.

* cited by examiner

GRAIN-ORIENTED ELECTRICAL STEEL SHEET AND METHOD FOR PRODUCING THEREOF

TECHNICAL FIELD

The present invention relates to a grain-oriented electrical steel sheet and method for producing thereof.

Priority is claimed on Japanese Patent Application No. 2018-052898, filed on Mar. 20, 2018, and the content of which is incorporated herein by reference.

BACKGROUND ART

Background Art

A grain-oriented electrical steel sheet includes a silicon steel sheet for base sheet which is composed of grains oriented to {110}<001> (hereinafter, Goss orientation) and which includes 7 mass % or less of Si. The grain-oriented electrical steel sheet has been mainly applied to iron core materials of transformer. When the grain-oriented electrical steel sheet is utilized for the iron core materials of transformer, in other words, when the steel sheets are laminated as the iron core, it is necessary to ensure interlaminar insulation (insulation between laminated steel sheets). Thus, in order to ensure the insulation for the grain-oriented electrical steel sheet, it is needed to form a primary coating (glass film) and a secondary coating (insulation coating) on the surface of silicon steel sheet. In addition, the glass film and the insulation coating have effect of improving the magnetic characteristics by applying tension to the silicon steel sheet.

A method for forming the glass film and the insulation coating and a typical method for producing the grain-oriented electrical steel sheet are as follows. A silicon steel slab including 7 mass % or less of Si is hot-rolled, and is cold-rolled once or cold-rolled two times with intermediate annealing therebetween, whereby a steel sheet having a final thickness is obtained. Thereafter, an annealing in a wet hydrogen atmosphere (decarburization annealing) is conducted for decarburization and primary recrystallization. In the decarburization annealing, an oxide film ($Fe_2SiO_4$, $SiO_2$, and the like) is formed on the surface of steel sheet. Then, an annealing separator containing MgO (magnesia) as a main component is applied to the decarburization annealed sheet. After drying the annealing separator, a final annealing is conducted. By the final annealing, secondary recrystallization occurs in the steel sheet, and the grains are aligned with {110}<001> orientation. Simultaneously, MgO in the annealing separator reacts with the oxide film of decarburization annealing, whereby the glass film ($Mg_2SiO_4$ and the like) is formed on the surface of steel sheet. Subsequently, a solution mainly containing a phosphate is applied onto the surface of final annealed sheet, namely on the surface of glass film, and then, baking is conducted, whereby the insulation coating (phosphate based coating) is formed.

The glass film is important for securing the insulation, but adhesion thereof is significantly affected by various factors. For example, when the sheet thickness of grain-oriented electrical steel sheet becomes thin, iron loss which is one of the magnetic characteristics improves, but the adhesion of glass film tends not to be secured. Thus, in regard to the glass film of grain-oriented electrical steel sheet, the improvement in adhesion and the stable control have been issues. The glass film is derived from the oxide film formed by the decarburization annealing, and therefore, the glass film has been tried to be improved by controlling conditions of decarburization annealing.

Patent Document 1 discloses the technique to form the glass film excellent in adhesion by pickling the surface layer of grain-oriented electrical steel sheet which is cold-rolled to the final thickness before conducting the decarburization annealing, by removing the surface accretion and the surface layer of base steel, and by evenly proceeding the decarburization and oxide formation.

Patent Documents 2 to 4 disclose the technique to improve the coating adhesion by applying the fine roughness to the steel sheet surface during the decarburization annealing and by reaching the glass film to the deep area of steel sheet.

Patent Documents 5 to 8 disclose the technique to improve the adhesion of glass film by controlling the oxidation degree of decarburization annealing atmosphere. The technique is to accelerate the oxidation of decarburization-annealed sheet and thereby to promote the formation of glass film.

Further technical development has progressed, Patent Documents 9 to 11 disclose the technique to improve the adhesion of glass film and the magnetic characteristics by focusing the heating stage of decarburization annealing and by controlling the heating rate in addition to the atmosphere in the heating stage.

RELATED ART DOCUMENTS

Patent Documents

[Patent Document 1] Japanese Unexamined Patent Application, First Publication No. S50-71526
[Patent Document 2] Japanese Unexamined Patent Application, First Publication No. S62-133021
[Patent Document 3] Japanese Unexamined Patent Application, First Publication No. S63-7333
[Patent Document 4] Japanese Unexamined Patent Application, First Publication No. S63-310917
[Patent Document 5] Japanese Unexamined Patent Application, First Publication No. H2-240216
[Patent Document 6] Japanese Unexamined Patent Application, First Publication No. H2-259017
[Patent Document 7] Japanese Unexamined Patent Application, First Publication No. H6-33142
[Patent Document 8] Japanese Unexamined Patent Application, First Publication No. H10-212526
[Patent Document 9] Japanese Unexamined Patent Application, First Publication No. H11-61356
[Patent Document 10] Japanese Unexamined Patent Application, First Publication No. 2000-204450
[Patent Document 11] Japanese Unexamined Patent Application, First Publication No. 2003-27194

Non-Patent Document

[Non-Patent Document 1] "Quantitative Analysis of Mineral Phases in Sinter Ore by Rietveld Method", Toni Takayama et al., General incorporated association—The Iron and Steel Institute of Japan, Tetsu-to-Hagane, Vol. 103 (2017) No. 6, p. 397-406, DOI: http://dx.doi.org/10.2355/tetsutohagane.TETSU-2016-069.

SUMMARY OF INVENTION

Technical Problem to be Solved

However, the techniques described in Patent Documents 1 to 4 require an additional step in the process, and thus the operation load becomes high. For that reason, the further improvement has been desired.

The techniques described in Patent Documents 5 to 8 improve the adhesion of glass film, but the secondary recrystallization may become unstable and the magnetic characteristics (magnetism) may deteriorate.

The techniques described in Patent Documents 9 to 11 improve the magnetic characteristics, but the improvement for film is still insufficient. For example, in the case of the base materials with sheet thickness of 0.23 mm or less (hereinafter, thin base sheet), the adhesion of glass film is insufficient. The adhesion of glass film becomes unstable with decrease in the sheet thickness. For that reason, the further improvement for the adhesion of glass film has been required.

The present invention has been made in consideration of the above mentioned situations. An object of the invention is to provide a grain-oriented electrical steel sheet excellent in the coating adhesion without deteriorating the magnetic characteristics, and method for producing thereof.

Solution to Problem

The present inventors have made a thorough investigation to solve the above mentioned situations. As a result, it is found that the adhesion of glass film is drastically improved when the Mn-containing oxide is included in the glass film. Moreover, the above effect obtained by the technique becomes remarkable in the thin base sheet.

In addition, the present inventors found that the Mn-containing oxide is preferably formed in the glass film by comprehensively and inseparably controlling the heating conditions and the atmosphere conditions in the decarburization annealing process and the insulation coating forming process.

An aspect of the present invention employs the following.

(1) A grain-oriented electrical steel sheet according to an aspect of the present invention includes:

a silicon steel sheet including, as a chemical composition, by mass %, 2.50 to 4.0% of Si, 0.010 to 0.50% of Mn, 0 to 0.20% of C, 0 to 0.070% of acid-soluble Al, 0 to 0.020% of N, 0 to 0.080% of S, 0 to 0.020% of Bi, 0 to 0.50% of Sn, 0 to 0.50% of Cr, 0 to 1.0% of Cu, and a balance consisting of Fe and impurities;

a glass film arranged on a surface of the silicon steel sheet; and an insulation coating arranged on a surface of the glass film, wherein the glass film includes a Mn-containing oxide.

(2) In the grain-oriented electrical steel sheet according to (1), the Mn-containing oxide may include at least one selected from a group consisting of a Braunite and $Mn_3O_4$.

(3) In the grain-oriented electrical steel sheet according to (1) or (2), the Mn-containing oxide may be arranged at an interface with the silicon steel sheet in the glass film.

(4) In the grain-oriented electrical steel sheet according to any one of (1) to (3), 0.1 to 30 pieces/$\mu m^2$ of the Mn-containing oxide may be arranged at the interface in the glass film.

(5) In the grain-oriented electrical steel sheet according to any one of (1) to (4), when $I_{For}$ is a diffracted intensity of a peak originated in a forsterite and $I_{TiN}$ is a diffracted intensity of a peak originated in a titanium nitride in a range of 41°<20<43° of an X-ray diffraction spectrum of the glass film measured by an X-ray diffraction method, the $I_{For}$ and the $I_{TiN}$ may satisfy $I_{TiN}<I_{For}$.

(6) In the grain-oriented electrical steel sheet according to any one of (1) to (5), a number fraction of secondary recrystallized grains whose maximum diameter is 30 to 100 mm may be 20 to 80% as compared with entire secondary recrystallized grains in the silicon steel sheet.

(7) In the grain-oriented electrical steel sheet according to any one of (1) to (6), an average thickness of the silicon steel sheet may be 0.17 mm or more and less than 0.22 mm.

(8) In the grain-oriented electrical steel sheet according to any one of (1) to (7), the silicon steel sheet may include, as the chemical composition, by mass %, at least one selected from a group consisting of 0.0001 to 0.0050% of C, 0.0001 to 0.0100% of acid-soluble Al, 0.0001 to 0.0100% of N, 0.0001 to 0.0100% of S, 0.0001 to 0.0010% of Bi, 0.005 to 0.50% of Sn, 0.01 to 0.50% of Cr, and 0.01 to 1.0% of Cu.

(9) A method for producing a grain-oriented electrical steel sheet according to an aspect of the present invention, the method is for producing the grain-oriented electrical steel sheet according to any one of (1) to (8), and the method may include:

a hot rolling process of heating a slab to a temperature range of 1200 to 1600° C. and then hot-rolling the slab to obtain a hot rolled steel sheet, the slab including, as the chemical composition, by mass %, 2.50 to 4.0% of Si, 0.010 to 0.50% of Mn, 0 to 0.20% of C, 0 to 0.070% of acid-soluble Al, 0 to 0.020% of N, 0 to 0.080% of S, 0 to 0.020% of Bi, 0 to 0.50% of Sn, 0 to 0.50% of Cr, 0 to 1.0% of Cu, and a balance consisting of Fe and impurities;

a hot band annealing process of annealing the hot rolled steel sheet to obtain a hot band annealed sheet;

a cold rolling process of cold-rolling the hot band annealed sheet by cold-rolling once or by cold-rolling plural times with an intermediate annealing to obtain a cold rolled steel sheet;

a decarburization annealing process of decarburization-annealing the cold rolled steel sheet to obtain a decarburization annealed sheet;

a final annealing process of applying an annealing separator to the decarburization annealed sheet and then final-annealing the decarburization annealed sheet so as to form a glass film on a surface of the decarburization annealed sheet to obtain a final annealed sheet; and an insulation coating forming process of applying an insulation coating forming solution to the final annealed sheet and then heat-treating the final annealed sheet so as to form an insulation coating on a surface of the final annealed sheet, wherein, in the decarburization annealing process, when a dec-$S_{500-600}$ is an average heating rate in units of ° C./second and a dec-$P_{500-600}$ is an oxidation degree $PH_2O/PH_2$ of an atmosphere in a temperature range of 500 to 600° C. during raising a temperature of the cold rolled steel sheet and when a dec-$S_{600-700}$ is an average heating rate in units of ° C./second and a dec-$P_{600-700}$ is an oxidation degree $PH_2O/PH_2$ of an atmosphere in a temperature range of 600 to 700° C. during raising the temperature of the cold rolled steel sheet, the dec-$S_{500-600}$ may be 300 to 2000° C./second, the dec-$S_{600-700}$ may be 300 to 3000° C./second, the dec-$S_{500-600}$ and the dec-$S_{600-700}$ may satisfy dec-$S_{500-600}$<dec-$S_{600-700}$, the dec-$P_{500-600}$ may be 0.00010 to 0.50, and the dec-$P_{600-700}$ may be 0.00001 to 0.50, wherein, in the final annealing process, the decarburization annealed sheet after applying the annealing separator may be held in a temperature range of 1000 to 1300° C. for 10 to 60 hours, and wherein, in the insulation coating forming process, when an ins-$S_{600-700}$ is an average heating rate in units of ° C./second in a temperature range of 600 to 700° C. and an ins-$S_{700-800}$ is an average heating rate in units of ° C./second in a temperature range of 700 to 800° C. during raising a temperature of the final annealed sheet, the ins-$S_{600-700}$ may be 10 to 200° C./second, the ins-$S_{700-800}$ may be 5 to 100° C./second, and the ins-$S_{600-700}$ and the ins-$S_{700-800}$ may satisfy ins-$S_{600-700}$>ins-$S_{700-800}$.

(10) In the method for producing the grain-oriented electrical steel sheet according to (9), in the decarburization annealing process, the dec-$P_{500-600}$ and the dec-$P_{600-700}$ may satisfy dec-$P_{500-600}$>dec-$P_{600-700}$.

(11) In the method for producing the grain-oriented electrical steel sheet according to (9) or (10), in the decarburization annealing process, a first annealing and a second annealing may be conducted after raising the temperature of the cold rolled steel sheet, and when a dec-$T_I$ is a holding temperature in units of ° C., a dec-$t_I$ is a holding time in units of second, and a dec-$P_I$ is an oxidation degree $PH_2O/PH_2$ of an atmosphere during the first annealing and when a dec-$T_{II}$ is a holding temperature in units of ° C., a dec-$t_{II}$ is a holding time in units of second, and a dec-$P_{II}$ is an oxidation degree $PH_2O/PH_2$ of an atmosphere during the second annealing, the dec-$T_I$ may be 700 to 900° C., the dec-$t_I$ may be 10 to 1000 seconds, the dec-$P_I$ may be 0.10 to 1.0, the dec-$T_{II}$ may be (dec-$T_I$+50° C.) or more and 1000° C. or less, the dec-$t_{II}$ may be 5 to 500 seconds, the dec-$P_{II}$ may be 0.00001 to 0.10, and the dec-$P_I$ and the dec-$P_{II}$ may satisfy dec-$P_I$>dec-$P_{II}$.

(12) In the method for producing the grain-oriented electrical steel sheet according to any one of (9) to (11), in the decarburization annealing process, the dec-$P_{500-600}$, the dec-$P_{600-700}$, the dec-$P_I$, and the dec-$P_{II}$ may satisfy dec-$P_{500-600}$>dec-$P_{600-700}$<dec-$P_I$>dec-$P_{II}$.

(13) In the method for producing the grain-oriented electrical steel sheet according to any one of (9) to (12), in the insulation coating forming process, when an ins-$P_{600-700}$ is an oxidation degree $PH_2O/PH_2$ of an atmosphere in the temperature range of 600 to 700° C. and an ins-$P_{700-800}$ is an oxidation degree $PH_2O/PH_2$ of an atmosphere in the temperature range of 700 to 800° C. during raising the temperature of the final annealed sheet, the ins-$P_{600-700}$ may be 1.0 or more, the ins-$P_{700-800}$ may be 0.1 to 5.0, and the ins-$P_{600-700}$ and the ins-$P_{700-800}$ may satisfy ins-$P_{600-700}$>ins-$P_{700-800}$.

(14) In the method for producing the grain-oriented electrical steel sheet according to any one of (9) to (13), in the final annealing process, the annealing separator may include a Ti-compound of 0.5 to 10 mass % in metallic Ti equivalent.

(15) In the method for producing the grain-oriented electrical steel sheet according to any one of (9) to (14), the slab may include, as the chemical composition, by mass %, at least one selected from a group consisting of 0.01 to 0.20% of C, 0.01 to 0.070% of acid-soluble Al, 0.0001 to 0.020% of N, 0.005 to 0.080% of S, 0.001 to 0.020% of Bi, 0.005 to 0.50% of Sn, 0.01 to 0.50% of Cr, and 0.01 to 1.0% of Cu.

Effects of Invention

According to the above aspects of the present invention, it is possible to provide the grain-oriented electrical steel sheet excellent in the coating adhesion without deteriorating the magnetic characteristics, and method for producing thereof.

DETAILED DESCRIPTION OF PREFERRED EMBODIMENTS

Figure 1:
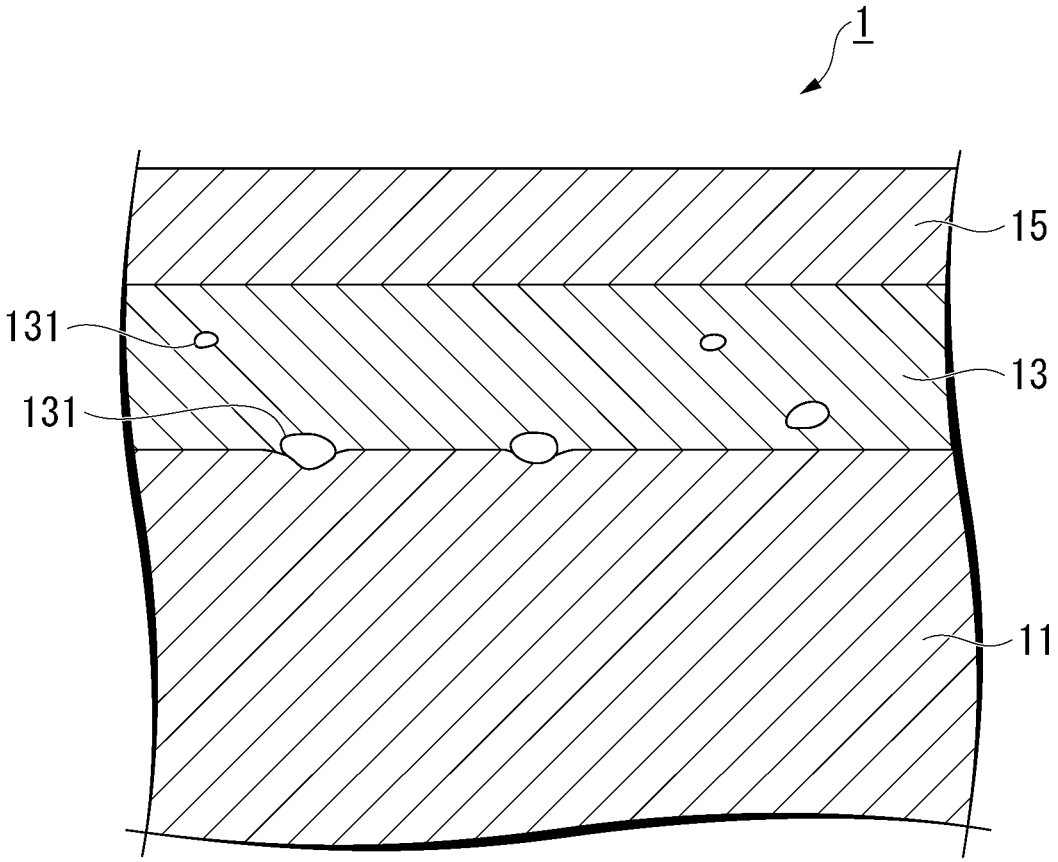
FIG. 1 is a cross-sectional illustration of a grain-oriented electrical steel sheet according to an embodiment of the present invention.

Hereinafter, a preferable embodiment of the present invention is described in detail. However, the present invention is not limited only to the configuration which is disclosed in the embodiment, and various modifications are possible without departing from the aspect of the present invention. In addition, the limitation range as described below includes a lower limit and an upper limit thereof. However, the value expressed by "more than" or "less than" does not include in the limitation range. "%" of the amount of respective elements expresses "mass %".

The details which lead to the embodiment are described below.

1. Background Leading to this Embodiment

The present inventors investigate the morphology of glass film in order to secure the adhesion between the glass film and the silicon steel sheet (base steel sheet). To begin with, the adhesion between the glass film and the steel sheet strongly depends on the morphology of glass film. For example, in the case of the structure such that the glass film bites the silicon steel sheet (hereinafter, intruding structure), the adhesion of glass film is excellent.

However, it is not easy to secure the adhesion of glass film. In particular, when the sheet thickness becomes thin, it becomes more difficult to secure the adhesion of glass film. Although the cause is not completely clear, the present inventors assume that the formation behavior of oxide film in the decarburization annealing is peculiar to the thin base sheet.

For the above situations, the present inventors conceive the technique to secure the adhesion of glass film by forming the oxide as an anchor between the glass film and the silicon steel sheet. Moreover, in order to control the formation of anchor oxide, the present inventors focus on and investigate the annealing conditions (heat treatment conditions) in the decarburization annealing process and the insulation coating forming process. As a result, the present inventors found that the adhesion of glass film is drastically improved by comprehensively and inseparably controlling the heating conditions and the atmosphere conditions in the decarburization annealing process and the insulation coating forming process.

As a result of analyzing the material having excellent adhesion of glass film, it is confirmed that the Mn-containing oxide is included in the interface between the glass film and the silicon steel sheet. As a result of analyzing the oxide in detail by transmission electron microscope (hereinafter, TEM) and X-ray diffraction (hereinafter, XRD), it is found that the Mn-containing oxide includes preferably at least one selected from the group consisting of Braunite ($Mn_7SiO_{12}$)

and Trimanganese tetroxide ($Mn_3O_4$) and that the Mn-containing oxide acts as the anchor oxide. Moreover, as a result of investigating the formation mechanism of Mn-containing oxide, it is found that the Mn-containing oxide is formed by the following mechanism.

First, when the heating rate and the atmosphere in the heating stage of decarburization annealing are controlled, a precursor of Mn-containing oxide (hereinafter, Mn-containing precursor) is formed near the surface of steel sheet. When the above decarburization annealed sheet is subjected to the final annealing, Mn segregates between the glass film and the silicon steel sheet (hereinafter, interfacial segregation Mn).

Secondly, when the above final annealed sheet is subjected to the insulation coating forming and when the heating rate in the heating stage of insulation coating forming is controlled, the Mn-containing oxide is formed from the Mn-containing precursor and the interfacial segregation Mn. The Mn-containing oxide (in particular, Braunite or Trimanganese tetroxide) acts as the anchor and contributes to the improvement of the adhesion of glass film.

As described above, the present inventors investigate the morphology of Mn-containing oxide in the glass film and the control technique thereof, and as a result, arrive at the embodiment.

2. Grain-Oriented Electrical Steel Sheet

The grain-oriented electrical steel sheet according to the embodiment is described.

2-1. Main Features of Grain-Oriented Electrical Steel Sheet

FIG. 1 is a cross-sectional illustration of the grain-oriented electrical steel sheet according to the embodiment. The grain-oriented electrical steel sheet 1 according to the embodiment includes a silicon steel sheet 11 (base steel sheet) having secondary recrystallized structure, a glass film 13 (primary coating) arranged on the surface of silicon steel sheet 11, and an insulation coating 15 (secondary coating) arranged on the surface of glass film 13. The glass film 13 includes the Mn-containing oxide 131. Although the glass film and the insulation coating may be formed on at least one surface of the silicon steel sheet, these are formed on both surfaces of the silicon steel sheet in general.

Hereinafter, the grain-oriented electrical steel sheet according to the embodiment is explained focusing on characteristic features. The explanation of the known features and the features which can be controlled by the skilled person are omitted.

(Glass Film)

The glass film is an inorganic film which mainly includes magnesium silicate ($MgSiO_3$, $Mg_2SiO_4$, and the like). In general, the glass film is formed during final annealing by reacting the annealing separator containing magnesia with the elements which is included in the silicon steel sheet or the oxide film such as $SiO_2$ on the surface of silicon steel sheet. Thus, the glass film has the composition derived from the components of annealing separator and silicon steel sheet. For example, the glass film may include spinel ($MgAl_2O_4$) and the like. In the grain-oriented electrical steel sheet according to the embodiment, the glass film includes the Mn-containing oxide.

As described above, in the grain-oriented electrical steel sheet according to the embodiment, the Mn-containing oxide is purposely formed in the glass film, and thereby the coating adhesion is improved. Since the coating adhesion is improved in so far as the Mn-containing oxide is included in the glass film, the fraction of Mn-containing oxide in the glass film is not particularly limited. In the embodiment, the Mn-containing oxide only has to be included in the glass film.

However, in the grain-oriented electrical steel sheet according to the embodiment, it is preferable that the Mn-containing oxide includes at least one selected from the group consisting of Braunite ($Mn_7SiO_{12}$) and Trimanganese tetroxide ($Mn_3O_4$). In other words, it is preferable that at least one selected from the group consisting of Braunite and $Mn_3O_4$ is included as the Mn-containing oxide in the glass film. When Braunite or Trimanganese tetroxide is included as the Mn-containing oxide in the glass film, it is possible to improve the coating adhesion without deteriorating the magnetic characteristics.

In addition, when the Mn-containing oxide (Braunite or $Mn_3O_4$) is included in the glass film in the interface between the glass film and the silicon steel sheet, the anchor effect can be preferably obtained. Thus, it is preferable that the Mn-containing oxide (Braunite or $Mn_3O_4$) is arranged at the interface between the glass film and the silicon steel sheet in the glass film.

In addition to the fact that the Mn-containing oxide (Braunite or $Mn_3O_4$) is arranged at the interface with the silicon steel sheet in the glass film, it is more preferable that 0.1 to 30 pieces/$\mu m^2$ of the Mn-containing oxide (Braunite or $Mn_3O_4$) are arranged at the interface in the glass film. When the Mn-containing oxide (Braunite or $Mn_3O_4$) at the above-mentioned number density is included in the glass film in the interface between the glass film and the silicon steel sheet, it is possible to more preferably obtain the anchor effect.

In order to preferably obtain the anchor effect, the lower limit of number density of the Mn-containing oxide (Braunite or $Mn_3O_4$) is preferably 0.5 pieces/$\mu m^2$, more preferably 1.0 pieces/$\mu m^2$, and most preferably 2.0 pieces/$\mu m^2$. On the other hand, in order to avoid a decrease in magnetic characteristics caused by the unevenness of the interface, the upper limit of number density of the Mn-containing oxide (Braunite or $Mn_3O_4$) is preferably 20 pieces/$\mu m^2$, more preferably 15 pieces/$\mu m^2$, and most preferably 10 pieces/$\mu m^2$.

The method for confirming the Mn-containing oxide (Braunite or $Mn_3O_4$) in the glass film and the method for measuring the Mn-containing oxide (Braunite or $Mn_3O_4$) included at the interface between the glass film and the silicon steel sheet in the glass film are described later in detail.

In addition, in the conventional grain-oriented electrical steel sheet, the glass film may include Ti. In the case, Ti included in the glass film reacts with N eliminated from the silicon steel sheet by purification during the final annealing to form TiN in the glass film. On the other hand, in the grain-oriented electrical steel sheet according to the embodiment, even when the glass film includes Ti, almost no TiN is included in the glass film after the final annealing.

In the grain-oriented electrical steel sheet according to the embodiment, N eliminated from the silicon steel sheet during the final annealing is trapped in the Mn-containing precursor or the interfacial segregation Mn in the interface between the glass film and the silicon steel sheet. Thus, even when the glass film includes Ti, N eliminated from the silicon steel plate during the final annealing tends not to react with Ti in the glass film, so that the formation of TiN is suppressed.

For example, in the grain-oriented electrical steel sheet according to the embodiment, regardless of whether or not the glass film includes Ti, the forsterite ($Mg_2SiO_4$) which is the main component in the glass film and the titanium nitride (TiN) in the glass film satisfy the following conditions as final product.

When $I_{For}$ is a diffracted intensity of a peak originated in the forsterite and $I_{TiN}$ is a diffracted intensity of a peak originated in the titanium nitride in a range of $41° < 2\theta < 43°$ of an X-ray diffraction spectrum of the glass film measured by an X-ray diffraction method, $I_{For}$ and $I_{TiN}$ satisfy $I_{TiN} < I_{For}$. In the case where the glass film includes Ti in the conventional grain-oriented electrical steel sheet, the above-mentioned $I_{For}$ and $I_{TiN}$ become $I_{TiN} > I_{For}$ as final product.

The method for measuring the X-ray diffraction spectrum of the glass film by the X-ray diffraction method is described later in detail.

(Secondary Recrystallized Grain Size of Silicon Steel Sheet)

In the grain-oriented electrical steel sheet according to the embodiment, the silicon steel sheet has the secondary recrystallized structure. For example, when the magnetic flux density B8 is 1.89 to 2.00 T, the silicon steel sheet is judged to have the secondary recrystallized structure. It is preferable that the secondary recrystallized grain size of silicon steel sheet is coarse. Thereby, it is possible to more preferably obtain the coating adhesion. Specifically, it is preferable that a number fraction of secondary recrystallized grains whose maximum diameter is 30 to 100 mm is 20% or more as compared with the entire secondary recrystallized grains in the silicon steel sheet. The number fraction is more preferably 30% or more. On the other hand, the upper limit of number fraction is not particularly limited. However, the upper limit may be 80% as the industrially controllable value.

As described above, in the embodiment, the Mn-containing oxide (Braunite or $Mn_3O_4$) is formed as the anchor in the interface between the glass film and the silicon steel sheet, and thereby the adhesion of glass film is improved. It is preferable that the anchor is formed not at the secondary recrystallized grain boundary but in the secondary recrystallized grain. Since the grain boundary is an aggregate of lattice defects, even when the Mn-containing oxide is formed at the grain boundary, the Mn-containing oxide tends not to be intruded into the silicon steel sheet as the anchor. In the silicon steel sheet in which coarse secondary recrystallized grains are mainly included, the possibility of forming the Mn-containing oxide inside the grain increases, and thereby the coating adhesion can be further improved.

In the embodiment, the secondary recrystallized grain and the maximum diameter of secondary recrystallized grain are defined as follows. In regard to the grain of silicon steel sheet, the maximum diameter of the grain is defined as the longest line segment in the grain among the line segments parallel to the rolling direction and parallel to the transverse direction (direction perpendicular to the rolling direction). Moreover, the grain with the maximum diameter of 15 mm or more is regarded as the secondary recrystallized grain.

The method for measuring the above-mentioned number fraction of coarse secondary recrystallized grains is described later in detail.

(Sheet Thickness of Silicon Steel Sheet)

In the grain-oriented electrical steel sheet according to the embodiment, the sheet thickness of silicon steel sheet is not particularly limited. For example, the average thickness of silicon steel sheet may be 0.17 to 0.29 mm. However, in the grain-oriented electrical steel sheet according to the embodiment, when the sheet thickness of silicon steel sheet is thin, the effect of improving the coating adhesion is remarkably obtained. Thus, the average thickness of silicon steel sheet is preferably 0.17 to less than 0.22 mm, and more preferably 0.17 to 0.20 mm.

The reason why the effect of improving the coating adhesion is remarkably obtained with the thin base sheet is not clear at present, but the following mechanism is considered. As described above, in the embodiment, it is necessary to form the Mn-containing oxide (particularly, Braunite or $Mn_3O_4$). The formation of Mn-containing oxide is limited by the situation where Mn in the steel diffuses to the surface of steel sheet. For example, the fraction of surface area as compared with volume with respect to the thin base sheet is larger than that with respect to thick base sheet. Thus, in the thin base sheet, the diffusion length of Mn from the inside to the surface of steel sheet is short. As a result, in the thin base sheet, Mn diffuses from the inside of steel sheet and reaches the surface of steel sheet in a substantially short time, and the Mn-containing oxide is easily formed as compared with the thick base sheet. For example, although the details are described later, in the thin base sheet, it is possible to efficiently form the Mn-containing precursor in low temperature range of 500 to 600° C. in the heating stage of decarburization annealing.

2-2. Chemical Composition

Next, the chemical composition of silicon steel sheet of the grain-oriented electrical steel sheet according to the embodiment is explained. In the embodiment, the silicon steel sheet includes, as a chemical composition, base elements, optional elements as necessary, and a balance consisting of Fe and impurities.

In the embodiment, the silicon steel sheet includes Si and Mn as the base elements (main alloying elements).

(2.50 to 4.0% of Si)

Si (silicon) is the base element. When the Si content is less than 2.50%, the phase transformation occurs in the steel during the secondary recrystallization annealing, the secondary recrystallization does not sufficiently proceed, and the excellent magnetic flux density and iron loss are not obtained. Thus, the Si content is to 2.50% or more. The Si content is preferably 3.00% or more, and more preferably 3.20% or more. On the other hand, when the Si content is more than 4.0%, the steel sheet becomes brittle, and the possibility during the production significantly deteriorates. Thus, the Si content is to 4.0% or less. The Si content is preferably 3.80% or less, and more preferably 3.60% or less.

(0.010 to 0.50% of Mn)

Mn (manganese) is the base element. When the Mn content is less than 0.010%, it is difficult to include the Mn-containing oxide (Braunite or $Mn_3O_4$) in the glass film, even when the decarburization annealing process and the insulation coating forming process are controlled. Thus, the Mn content is set to 0.010% or more. The Mn content is preferably 0.03% or more, and more preferably 0.05% or more. On the other hand, when the Mn content is more than 0.5%, the phase transformation occurs in the steel during the secondary recrystallization annealing, the secondary recrystallization does not sufficiently proceed, and the excellent magnetic flux density and iron loss are not obtained. Thus, the Mn content is to 0.50% or less. The Mn content is preferably 0.2% or less, and more preferably 0.1% or less.

In the embodiment, the silicon steel sheet may include the impurities. The impurities correspond to elements which are contaminated during industrial production of steel from ores and scrap that are used as a raw material of steel, or from environment of a production process.

Moreover, in the embodiment, the silicon steel sheet may include the optional elements in addition to the base elements and the impurities. For example, as substitution for a part of Fe which is the balance, the silicon steel sheet may include the optional elements such as C, acid-soluble Al, N, S, Bi, Sn, Cr, and Cu. The optional elements may be included as necessary. Thus, a lower limit of the respective optional elements does not need to be limited, and the lower limit may be 0%. Moreover, even if the optional elements may be included as impurities, the above mentioned effects are not affected.

(0 to 0.20% of C)

C (carbon) is the optional element. When the C content is more than 0.20%, the phase transformation may occur in the steel during the secondary recrystallization annealing, the secondary recrystallization may not sufficiently proceed, and the excellent magnetic flux density and iron loss may be not obtained. Thus, the C content may be 0.20% or less. The C content is preferably 0.15% or less, and more preferably 0.10% or less. The lower limit of the C content is not particularly limited, and may be 0%. However, since C has the effect of improving the magnetic flux density by controlling the primary recrystallized texture, the lower limit of the C content may be 0.01%, 0.03%, or 0.06%. When C is excessively included as the impurity in the final product due to insufficient decarburization in the decarburization annealing, the magnetic characteristics may be adversely affected. Thus, the C content of silicon steel sheet is preferably 0.0050% or less. Although the C content of silicon steel sheet may be 0%, it is not industrially easy to control the C content to actually 0%, and thus the C content of silicon steel sheet may be 0.0001% or more.

(0 to 0.070% of acid-soluble Al)

The acid-soluble Al (aluminum) (sol-Al) is the optional element. When the acid-soluble Al content is more than 0.070%, the steel sheet may become brittle. Thus, the acid-soluble Al content may be 0.070% or less. The acid-soluble Al content is preferably 0.05% or less, and more preferably 0.03% or less. The lower limit of the acid-soluble Al content is not particularly limited, and may be 0%. However, since the acid-soluble Al has the effect of favorably developing the secondary recrystallization, the lower limit of the acid-soluble Al content may be 0.01% or 0.02%. When Al is excessively included as the impurity in the final product due to insufficient purification during the final annealing, the magnetic characteristics may be adversely affected. Thus the acid-soluble Al content of silicon steel sheet is preferably 0.0100% or less. Although the Al content of silicon steel sheet may be 0%, it is not industrially easy to control the Al content to actually 0%, and thus the acid-soluble Al content of silicon steel sheet may be 0.0001% or more.

(0 to 0.020% of N)

N (nitrogen) is the optional element. When the N content is more than 0.020%, blisters (voids) may be formed in the steel sheet during the cold rolling, the strength of steel sheet may increase, and the possibility during the production may deteriorate. Thus, the N content may be 0.020% or less. The N content is preferably 0.015% or less, and more preferably 0.010% or less. The lower limit of the N content is not particularly limited, and may be 0%. However, since N forms AlN and has the effect as the inhibitor for secondary recrystallization, the lower limit of the N content may be 0.0001% or 0.005%. When N is excessively included as the impurity in the final product due to insufficient purification during the final annealing, the magnetic characteristics may be adversely affected. Thus the N content of silicon steel sheet is preferably 0.0100% or less. Although the N content of silicon steel sheet may be 0%, it is not industrially easy to control the N content to actually 0%, and thus the N content of silicon steel sheet may be 0.0001% or more.

(0 to 0.080% of S)

S (sulfur) is the optional element. When the S content is more than 0.080%, the steel sheet may become brittle in the higher temperature range, and it may be difficult to conduct the hot rolling. Thus, the S content may be 0.080% or less. The S content is preferably 0.04% or less, and more preferably 0.03% or less. The lower limit of the S content is not particularly limited, and may be 0%. However, since S forms MnS and has the effect as the inhibitor for secondary recrystallization, the lower limit of the S content may be 0.005% or 0.01%. When S is excessively included as the impurity in the final product due to insufficient purification during the final annealing, the magnetic characteristics may be adversely affected. Thus the S content of silicon steel sheet is preferably 0.0100% or less. Although the S content of silicon steel sheet may be 0%, it is not industrially easy to control the S content to actually 0%, and thus the S content of silicon steel sheet may be 0.0001% or more.

(0 to 0.020% of Bi)

Bi (bismuth) is the optional element. When the Bi content is more than 0.020%, the possibility during cold rolling may deteriorate. Thus, the Bi content may be 0.020% or less. The Bi content is preferably 0.0100% or less, and more preferably 0.0050% or less. The lower limit of the Bi content is not particularly limited, and may be 0%. However, since Bi has the effect of improving the magnetic characteristics, the lower limit of the Bi content may be 0.0005% or 0.0010%. When Bi is excessively included as the impurity in the final product due to insufficient purification during the final annealing, the magnetic characteristics may be adversely affected. Thus the Bi content of silicon steel sheet is preferably 0.0010% or less. Although the Bi content of silicon steel sheet may be 0%, it is not industrially easy to control the Bi content to actually 0%, and thus the Bi content of silicon steel sheet may be 0.0001% or more.

(0 to 0.50% of Sn)

Sn (tin) is the optional element. When the Sn content is more than 0.50%, the secondary recrystallization may become unstable and the magnetic characteristics may deteriorate. Thus, the Sn content may be 0.50% or less. The Sn content is preferably 0.30% or less, and more preferably 0.15% or less. The lower limit of the Sn content is not particularly limited, and may be 0%. However, since Sn has the effect of improving the coating adhesion, the lower limit of the Sn content may be 0.005% or 0.01%.

(0 to 0.50% of Cr)

Cr (chromium) is the optional element. When the Cr content is more than 0.50%, Cr may form the Cr oxide and the magnetic characteristics may deteriorate. Thus, the Cr content may be 0.50% or less. The Cr content is preferably 0.30% or less, and more preferably 0.10% or less. The lower limit of the Cr content is not particularly limited, and may be 0%. However, since Cr has the effect of improving the coating adhesion, the lower limit of the Cr content may be 0.01% or 0.03%.

(0 to 1.0% of Cu)

Cu (copper) is the optional element. When the Cu content is more than 1.0%, the steel sheet may become brittle during hot rolling. Thus, the Cu content may be 1.0% or less. The Cu content is preferably 0.50% or less, and more preferably 0.10% or less. The lower limit of the Cu content is not particularly limited, and may be 0%. However, since Cu has the effect of improving the coating adhesion, the lower limit of the Cu content may be 0.01% or 0.03%.

In the embodiment, the silicon steel sheet may include, as the chemical composition, by mass %, at least one selected from a group consisting of 0.0001 to 0.0050% of C, 0.0001 to 0.0100% of acid-soluble Al, 0.0001 to 0.0100% of N, 0.0001 to 0.0100% of S, 0.0001 to 0.0010% of Bi, 0.005 to 0.50% of Sn, 0.01 to 0.50% of Cr, and 0.01 to 1.0% of Cu.

In addition, in the embodiment, the silicon steel sheet may include, as the optional element, at least one selected from a group consisting of Mo, W, In, B, Sb, Au, Ag, Te, Ce, V, Co, Ni, Se, Ca, Re, Os, Nb, Zr, Hf, Ta, Y, La, Cd, Pb, and As, as substitution for a part of Fe. The silicon steel sheet may include the above optional element of 5.00% or less, preferably 3.00% or less, and more preferably 1.00% or less in total. The lower limit of the amount of the above optional element is not particularly limited, and may be 0%.

2-3. Measuring Method of Technical Features

Next, the method for measuring the above mentioned technical features of the grain-oriented electrical steel sheet according to the embodiment is explained.

The layering structure of the grain-oriented electrical steel sheet according to the embodiment may be observed and measured as follows.

A test piece is cut out from the grain-oriented electrical steel sheet in which the film and coating is formed, and the layering structure of the test piece is observed with scanning electron microscope (SEM) or transmission electron microscope (TEM). For example, the layer whose thickness of 300 nm or more may be observed with SEM, and the layer whose thickness of less than 300 nm may be observed with TEM.

Specifically, at first, a test piece is cut out so that the cutting direction is parallel to the thickness direction (specifically, the test piece is cut out so that the in-plane direction of cross section is parallel to the thickness direction and the normal direction of cross section is perpendicular to the rolling direction), and the cross-sectional structure of this cross section is observed with SEM at a magnification at which each layer is included in the observed visual field (ex. magnification of 2000-fold). For example, in observation with a reflection electron composition image (COMP image), it can be inferred how many layers the cross-sectional structure includes. For example, in the COMP image, the silicon steel sheet can be distinguished as light color, the glass film as dark color, and the insulation coating as intermediate color.

In order to identify each layer in the cross-sectional structure, line analysis is performed along the thickness direction using SEM-EDS (energy dispersive X-ray spectroscopy), and quantitative analysis of the chemical composition of each layer is performed. The elements to be quantitatively analyzed are six elements Fe, P, Si, O, Mg, and Al. The analysis device is not particularly limited. In the embodiment, for example, SEM (JEOL JSM-7000F), EDS (AMETEK GENESIS 4000), and EDS analysis software (AMETEK GENESIS SPECTRUM Ver. 4.61J) may be used.

From the observation results in the COMP image and the quantitative analysis results by SEM-EDS, the silicon steel sheet is judged to be the area which is the layer located at the deepest position along the thickness direction, which has the Fe content of 80 atomic % or more and the O content of 30 atomic % or less excluding measurement noise, and which has 300 nm or more of the line segment (thickness) on the scanning line of the line analysis. Moreover, an area excluding the silicon steel sheet is judged to be the glass film and the insulation coating.

Regarding the area excluding the silicon steel sheet identified above, from the observation results in the COMP image and the quantitative analysis results by SEM-EDS, the phosphate based coating which is a kind of insulation coating is judged to be the area which has the Fe content of less than 80 atomic %, the P content of 5 atomic % or more, and the O content of 30 atomic % or more excluding the measurement noise, and which has 300 nm or more of the line segment (thickness) on the scanning line of the line analysis. Moreover, the phosphate based coating may include aluminum, magnesium, nickel, chromium, and the like derived from phosphate in addition to the above three elements which are utilized for the judgement of the phosphate based coating. Further, the phosphate based coating may include silicon derived from colloidal silica.

In order to judge the area which is the phosphate based coating, precipitates, inclusions, voids, and the like which are contained in the coating are not considered as judgment target, but the area which satisfies the quantitative analysis as the matrix is judged to be the phosphate based coating. For example, when precipitates, inclusions, voids, and the like on the scanning line of the line analysis are confirmed from the COMP image or the line analysis results, this area is not considered for the judgment, and the coating is determined by the quantitative analysis results as the matrix. The precipitates, inclusions, and voids can be distinguished from the matrix by contrast in the COMP image and can be distinguished from the matrix by the quantitative analysis results of constituent elements. When judging the phosphate based coating, it is preferable that the judgement is performed at the position which does not include precipitates, inclusions, and voids on the scanning line of the line analysis.

The glass film is judged to be the area which excludes the silicon steel sheet and the insulation coating (phosphate based coating) identified above and which has 300 nm or more of the line segment (thickness) on the scanning line of the line analysis. The glass film may satisfy, as a whole, the average Fe content of less than 80 atomic %, the average P content of less than 5 atomic %, the average Si content of 5 atomic % or more, the average O content of 30 atomic % or more, and the average Mg content of 10 atomic % or more. The quantitative analysis result of glass film is the analysis result which does not include the analysis result of precipitates, inclusions, voids, and the like included in the glass film and which is the analysis result as the matrix. When judging the glass film, it is preferable that the judgement is performed at the position which does not include precipitates, inclusions, and voids on the scanning line of the line analysis.

The identification of each layer and the measurement of the thickness by the above-mentioned COMP image observation and SEM-EDS quantitative analysis are performed on five places or more while changing the observed visual field. Regarding the thicknesses of each layer obtained from five places or more in total, an average value is calculated by excluding the maximum value and the minimum value from the values, and this average value is taken as the average thickness of each layer.

In addition, if a layer in which the line segment (thickness) on the scanning line of the line analysis is less than 300 nm is included in at least one of the observed visual fields of five places or more as described above, the layer is observed in detail by TEM, and the identification of the corresponding layer and the measurement of the thickness are performed by TEM.

A test piece including a layer to be observed in detail using TEM is cut out by focused ion beam (FIB) processing so that the cutting direction is parallel to the thickness direction (specifically, the test piece is cut out so that the in-plane direction of cross section is parallel to the thickness direction and the normal direction of cross section is perpendicular to the rolling direction), and the cross-sectional structure of this cross section is observed (bright-field image) with scanning-TEM (STEM) at a magnification at which the corresponding layer is included in the observed visual field. In the case where each layer is not included in the observed visual field, the cross-sectional structure is observed in a plurality of continuous visual fields.

In order to identify each layer in the cross-sectional structure, line analysis is performed along the thickness direction using TEM-EDS, and quantitative analysis of the chemical composition of each layer is performed. The elements to be quantitatively analyzed are six elements Fe, P, Si, O, Mg, and Al. The analysis device is not particularly limited. In the embodiment, for example, TEM (JEM-2100PLUS manufactured by JEOL Ltd.), EDS (JED-2100 manufactured by JEOL Ltd.), and EDS analysis software (Genesis Spectrum Version 4.61J) may be used.

From the observation results of the bright-field image by TEM described above and the quantitative analysis results by TEM-EDS, each layer is identified and the thickness of each layer is measured. The method for judging each layer using TEM and the method for measuring the thickness of each layer may be performed according to the method using SEM as described above.

In the method for judging each layer as described above, the silicon steel sheet is determined in the entire area at first, the insulation coating (phosphate based coating) is determined in the remaining area, and thereafter, the remaining area is determined to be the glass film. Thus, in the case of the grain-oriented electrical steel sheet satisfying the above features of the embodiment, there is no undetermined area other than the above-described layers in the entire area.

Whether or not the Mn-containing oxide (Braunite or $Mn_3O_4$) is included in the glass film specified above may be confirmed by TEM.

Measurement points with equal intervals are set on a line along the thickness direction in the glass film specified by the above method, and electron beam diffraction is performed at the measurement points. When performing the electron beam diffraction, for example, the measurement points with equal intervals are set on the line along the thickness direction from the interface with the silicon steel sheet to the interface with the insulation coating, and the intervals between the measurement points with equal intervals are set to 1/10 or less of the average thickness of the glass film. Moreover, wide-area electron beam diffraction is performed under conditions such that diameter of electron beam is approximately 1/10 of the glass film.

When it is confirmed that the crystalline phase is present in the diffraction pattern obtained by the wide-area electron beam diffraction, the above crystalline phase is checked by the bright field image. For the above crystalline phase, the electron beam diffraction is performed under conditions such that the electron beam is focused so as to obtain the information of the above crystalline phase. The crystal structure, lattice spacing, and the like of the above crystalline phase are identified by the diffraction pattern obtained by the above electron beam diffraction.

The crystal data such as the crystal structure and the lattice spacing identified above are collated with PDF (Powder Diffraction File). By the collation, it is possible to confirm whether or not the Mn-containing oxide is included in the glass film. For example, Braunite ($Mn_7SiO_{12}$) may be identified by JCPDS No. 01-089-5662. Trimanganese tetroxide ($Mn_3O_4$) may be identified by JCPDS No. 01-075-0765. It is possible to obtain the effect of the embodiment when the Mn-containing oxide is included in the glass film.

The above-mentioned line along the thickness direction is set at equal intervals along the direction perpendicular to the thickness direction on the observation visual field, and the electron beam diffraction as described above is performed on each line. The electron beam diffraction is performed on at least 50 or more of the lines set at equal intervals along the direction perpendicular to the thickness direction and at at least 500 or more of the measurement points in total.

As a result of the identification by the above electron beam diffraction, when the Mn-containing oxide (Braunite or $Mn_3O_4$) is detected on the line along the thickness direction and in the area from the interface with the silicon steel sheet to 1/5 of the thickness of glass film, the Mn-containing oxide (Braunite or $Mn_3O_4$) is judged to be arranged at the interface with the silicon steel sheet in the glass film.

In addition, on the basis of the identification by the above electron beam diffraction, a number of Mn-containing oxides (Braunite or $Mn_3O_4$) arranged in the area from the interface with the silicon steel sheet to 1/5 of the thickness of glass film is counted. By using the number of Mn-containing oxides and the area where the number of Mn-containing oxides is counted (area from the interface with the silicon steel sheet to 1/5 of the thickness of glass film to count the number of Mn-containing oxides), the number density of Mn-containing oxide (Braunite or $Mn_3O_4$) arranged at the interface with the silicon steel sheet in the glass film is obtained in units of pieces/$\mu m^2$. Specifically, the number density of the Mn-containing oxide (Braunite or $Mn_3O_4$) arranged at the interface in the glass film is regarded as the value obtained by dividing the number of the Mn-containing oxides (Braunite or $Mn_3O_4$) arranged in the area from the interface with the silicon steel sheet to 1/5 of the thickness of the glass film by the area of the glass film where the above number is counted.

Next, the X-ray diffraction spectrum of the above-mentioned glass film may be observed and measured as follows.

From the grain-oriented electrical steel sheet, the glass film is extracted by removing the silicon steel sheet and the insulation coating. Specifically, at first, the insulating coating is removed from the grain-oriented electrical steel sheet by immersing in alkaline solution. For example, it is possible to remove the insulating coating from the grain-oriented electrical steel sheet by immersing the steel sheet in sodium hydroxide aqueous solution which includes 30 to 50 mass % of NaOH and 50 to 70 mass % of Hao at 80 to 90° C. for 5 to 10 minutes, washing it with water, and then, drying it. Moreover, the immersing time in sodium hydroxide aqueous solution may be adjusted depending on the thickness of insulating coating.

Next, a sample of 30×40 mm which is taken from the electrical steel sheet whose insulating film is removed is subjected to electrolysis treatment, the electrolysis extracted residue corresponding to the glass film is only collected, and the residue is subjected to the X-ray diffraction. For example, the electrolysis conditions may be constant current electrolysis at 500 mA, the electrolysis solution may be solution obtained by adding 1% of tetramethylammonium chloride methanol to 10% of acetylacetone, the electrolysis treatment may be conducted for 30 to 60 minutes., and the film may be collected as the electrolysis extracted residue by using sieving screen with mesh size Φ 0.2 μm.

The above electrolysis extracted residue (glass film) is subjected to the X-ray diffraction. For example, the X-ray diffraction is conducted by using CuKα-ray (Kα1) as an incident X-ray. The X-ray diffraction may be conducted by using a circular sample of Φ 26 mm and an X-ray diffractometer (RIGAKU RINT2500). Tube voltage may be 40 kV, tube current may be 200 mA, measurement angle may be 5 to 90°, stepsize may be 0.02°, scan speed may be 4°/minute, divergence and scattering slit may be ½°, length limiting slit may be 10 mm, and optical receiving slit may be 0.15 mm.

The obtained X-ray diffraction spectrum are collated with PDF (Powder Diffraction File). For example, Forsterite ($Mg_2SiO_4$) may be identified by JCPDS No. 01-084-1402, and Titanium nitride (TiN, specifically TiN0.90) may be identified by JCPDS No. 031-1403.

On the basis of the results of collation, $I_{For}$ is the diffracted intensity of the peak originated in the forsterite and $I_{TiN}$ is the diffracted intensity of the peak originated in the titanium nitride in the range of 41°<2θ<43° of the X-ray diffraction spectrum.

The peak intensity of X-ray diffraction is defined as the area of the diffracted peak after removing the background. The removal of the background and the determination of the peak area may be performed by using typical software for XRD analysis. In determining the peak area, the spectrum after removing the background (experimental value) may be profile-fitted, and the peak area may be calculated from the fitting spectrum (calculated value) obtained above. For example, the profile fitting method of XRD spectrum (experimental value) by Rietveld analysis as described in Non-Patent Document 1 may be utilized.

Next, the maximum diameter and the number fraction of coarse secondary recrystallized grains in the silicon steel sheet may be observed and measured as follows.

From the grain-oriented electrical steel sheet, the silicon steel sheet is taken by removing the glass film and the insulation coating. For example, in order to remove the insulation coating, the grain-oriented electrical steel sheet with film and coating may be immersed in hot alkaline solution as described above. Specifically, it is possible to remove the insulating coating from the grain-oriented electrical steel sheet by immersing the steel sheet in sodium hydroxide aqueous solution which includes 30 to 50 mass % of NaOH and 50 to 70 mass % of $H_2O$ at 80 to 90° C. for 5 to 10 minutes, washing it with water, and then, drying it. Moreover, the immersing time in sodium hydroxide aqueous solution may be adjusted depending on the thickness of insulating coating.

Moreover, for example, in order to remove the glass film, the grain-oriented electrical steel sheet in which the insulation coating is removed may be immersed in hot hydrochloric acid. Specifically, it is possible to remove the glass film by previously investigating the preferred concentration of hydrochloric acid for removing the glass film to be dissolved, immersing the steel sheet in the hydrochloric acid with the above concentration such as 30 to 40 mass % of HCl at 80 to 90° C. for 1 to 5 minutes, washing it with water, and then, drying it. In general, film and coating are removed by selectively using the solution, for example, the alkaline solution is used for removing the insulation coating, and the hydrochloric acid is used for removing the glass film.

By removing the insulating coating and the glass film, the metallographic structure of silicon steel sheet appears and becomes observable, and the maximum diameter of secondary recrystallized grain can be measured.

The metallographic structure of silicon steel sheet revealed above is observed. The grain with the maximum diameter of 15 mm or more is regarded as the secondary recrystallized grain, and the number fraction of coarse secondary recrystallized grains is regarded as a fraction of the grains with the maximum diameter of 30 to 100 mm in the entire secondary recrystallized grains. Specifically, the number fraction of coarse secondary recrystallized grains is regarded as the percentage of the value obtained by dividing the total number of the grains with the maximum diameter of 30 to 100 mm by the total number of the grains with the maximum diameter of 15 mm or more.

Next, the chemical composition of steel may be measured by typical analytical methods.

The steel composition of silicon steel sheet may be measured after removing the glass film and the insulation coating from the grain-oriented electrical steel sheet which the final product by the above method. Moreover, the steel composition of silicon steel slab (steel piece) may be measured by using a sample taken from molten steel before casting or a sample which is the silicon steel slab after casting but removing a surface oxide film. The steel composition may be measured by using ICP-AES (Inductively Coupled Plasma-Atomic Emission Spectrometer: inductively coupled plasma emission spectroscopy spectrometry). In addition, C and S may be measured by the infrared absorption method after combustion, N may be measured by the thermal conductometric method after fusion in a current of inert gas, and O may be measured by, for example, the non-dispersive infrared absorption method after fusion in a current of inert gas.

3. Method for Producing Grain-Oriented Electrical Steel Sheet

The method for producing grain-oriented electrical steel sheet according to the embodiment is described.

A typical method for producing the grain-oriented electrical steel sheet is as follows. A silicon steel slab including 7 mass % or less of Si is hot-rolled, and is hot-band-annealed. The hot band annealed sheet is pickled, and then is cold-rolled once or cold-rolled two times with intermediate annealing therebetween, whereby a steel sheet having a final thickness is obtained. Thereafter, an annealing in wet hydrogen atmosphere (decarburization annealing) is conducted for decarburization and primary recrystallization. In the decarburization annealing, an oxide film ($Fe_2SiO_4$, $SiO_2$, and the like) is formed on the surface of steel sheet. Then, an annealing separator containing MgO (magnesia) as a main component is applied to the decarburization annealed sheet. After drying the annealing separator, a final annealing is conducted. By the final annealing, secondary recrystallization occurs in the steel sheet, and the grains are aligned with {110}<001> orientation. Simultaneously, MgO in the annealing separator reacts with the oxide film of decarburization annealing, whereby the glass film ($Mg_2SiO_4$ and the like) is formed on the surface of steel sheet. After washing with water or pickling, a solution mainly containing a phosphate is applied onto the surface of final annealed sheet, namely on the surface of glass film, and then, baking is conducted, whereby the insulation coating (phosphate based coating) is formed.

Figure 2:
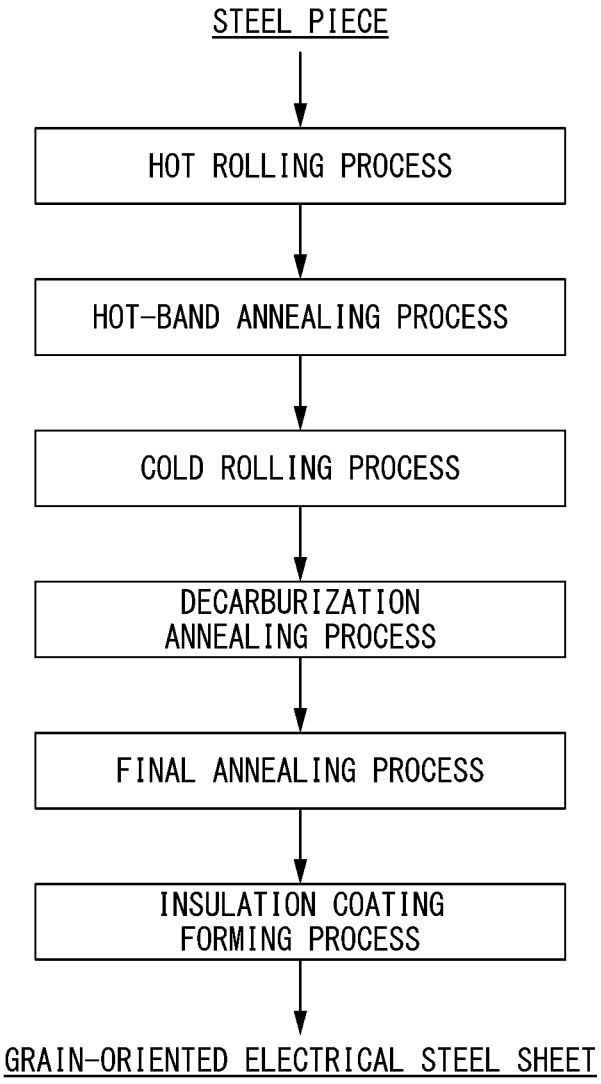
FIG. 2 is a flow chart illustrating a method for producing the grain-oriented electrical steel sheet according to the embodiment.

FIG. 2 is a flow chart illustrating a method for producing the grain-oriented electrical steel sheet according to the embodiment. The method for producing the grain-oriented electrical steel sheet according to the embodiment mainly includes: a hot rolling process of hot-rolling a silicon steel slab (steel piece) including predetermined chemical composition to obtain a hot rolled steel sheet; a hot band annealing process of annealing the hot rolled steel sheet to obtain a hot band annealed sheet; a cold rolling process of cold-rolling the hot band annealed sheet by cold-rolling once or by cold-rolling plural times with an intermediate annealing to obtain a cold rolled steel sheet; a decarburization annealing process of decarburization-annealing the cold rolled steel sheet to obtain a decarburization annealed sheet; a final annealing process of applying an annealing separator to the decarburization annealed sheet and then final-annealing the decarburization annealed sheet so as to form a glass film on a surface of the decarburization annealed sheet to obtain a final annealed sheet; and an insulation coating forming process of applying an insulation coating forming solution to the final annealed sheet and then heat-treating the final annealed sheet so as to form an insulation coating on a surface of the final annealed sheet.

The above processes are respectively described in detail. In the following description, when the conditions of each process are not described, known conditions may be appropriately applied.

3-1. Hot Rolling Process

In the hot rolling process, the steel piece (ex. steel ingot such as slab) including predetermined chemical composition is hot-rolled. The chemical composition of steel piece may be the same as that of the silicon steel sheet described above.

For example, the silicon steel slab (steel piece) subjected to the hot rolling process may include, as the chemical composition, by mass %, 2.50 to 4.0% of Si, 0.010 to 0.50% of Mn, 0 to 0.20% of C, 0 to 0.070% of acid-soluble Al, 0 to 0.020% of N, 0 to 0.080% of S, 0 to 0.020% of Bi, 0 to 0.50% of Sn, 0 to 0.50% of Cr, 0 to 1.0% of Cu, and a balance consisting of Fe and impurities.

In the embodiment, the silicon steel slab (steel piece) may include, as the chemical composition, by mass %, at least one selected from the group consisting of 0.01 to 0.20% of C, 0.01 to 0.070% of acid-soluble Al, 0.0001 to 0.020% of N, 0.005 to 0.080% of S, 0.001 to 0.020% of Bi, 0.005 to 0.50% of Sn, 0.01 to 0.50% of Cr, and 0.01 to 1.0% of Cu.

In the hot rolling process, at first, the steel piece is heated. The heating temperature may be 1200 to 1600° C. The lower limit of heating temperature is preferably 1280° C. The upper limit of heating temperature is preferably 1500° C. Subsequently, the heated steel piece is hot-rolled. The thickness of hot rolled steel sheet after hot rolling is preferably within the range of 2.0 to 3.0 mm.

3-2. Hot Band Annealing Process

In the hot band annealing process, the hot rolled steel sheet after the hot rolling process is annealed. By the hot band annealing, the recrystallization occurs in the steel sheet, and finally, the excellent magnetic characteristics can be obtained. The conditions of hot band annealing are not particularly limited. For example, the hot rolled steel sheet may be subjected to the annealing in the temperature range of 900 to 1200° C. for 10 seconds to 5 minutes. Moreover, after the hot band annealing and before the cold rolling, the surface of hot band annealed sheet may be pickled.

3-3. Cold Rolling Process

In the cold rolling process, the hot band annealed sheet after the hot band annealing process is cold-rolled once or plural times with an intermediate annealing. Since the sheet shape of hot band annealed sheet is excellent due to the hot band annealing, it is possible to reduce the possibility such that the steel sheet is fractured in the first cold rolling. When the intermediate annealing is conducted at the interval of cold rolling, the heating method for intermediate annealing is not particularly limited. Although the cold rolling may be conducted three or more times with the intermediate annealing, it is preferable to conduct the cold rolling once or twice because the producing cost increases.

Final cold rolling reduction in cold rolling (cumulative cold rolling reduction without intermediate annealing or cumulative cold rolling reduction after intermediate annealing) may be within the range of 80 to 95%. By controlling the final cold rolling reduction to be within the above range, it is possible to finally increase the orientation degree of {110}<001> and to suppress the instability of secondary recrystallization. In general, the thickness of cold rolled steel sheet after cold rolling becomes the thickness (final thickness) of silicon steel sheet in the grain-oriented electrical steel sheet which is finally obtained.

3-4. Decarburization Annealing Process

In the decarburization annealing process, the cold rolled steel after the cold rolling process is decarburization-annealed.

(1) Heating Conditions

In the embodiment, the heating conditions for heating the cold rolled steel sheet are controlled. Specifically, the cold rolled steel sheet is heated under the following conditions. When dec-$S_{500-600}$ is an average heating rate in units of ° C./second and dec-$P_{500-600}$ is an oxidation degree $PH_2O/PH_2$ of an atmosphere in a temperature range of 500 to 600° C. during raising a temperature of the cold rolled steel sheet and when dec-$S_{600-700}$ is an average heating rate in units of ° C./second and dec-$P_{600-700}$ is an oxidation degree $PH_2O/PH_2$ of an atmosphere in a temperature range of 600 to 700° C. during raising the temperature of the cold rolled steel sheet, the dec-$S_{500-600}$ is 300 to 2000° C./second, the dec-$S_{600-700}$ is 300 to 3000° C./second, the dec-$S_{500-600}$ and the dec-$S_{600-700}$ satisfy dec-$S_{500-600}$<dec-$S_{600-700}$, the dec-$P_{500-600}$ is 0.00010 to 0.50, and the dec-$P_{600-700}$ is 0.00001 to 0.50.

In the heating stage of decarburization annealing, $SiO_2$ oxide film tends to be easily formed in the temperature range of 600 to 700° C. It seems that the above reason is that the diffusion velocity of Si and the diffusion velocity of O in steel are balanced on the steel sheet surface in the temperature range. On the other hand, the precursor of Mn-containing oxide (Mn-containing precursor) tends to be easily formed in the temperature range of 500 to 600° C. The embodiment is directed to form the Mn-containing precursor during the decarburization annealing and thereby to improve the coating adhesion of final product. Thus, it is necessary to prolong the detention time in the range of 500 to 600° C. where the Mn-containing precursor forms, as compared with the detention time in the range of 600 to 700° C. where the $SiO_2$ oxide film forms.

Thus, it is necessary to satisfy dec-$S_{500-600}$<dec-$S_{600-700}$, in addition to control the dec-$S_{500-600}$ to be 300 to 2000° C./second and the dec-$S_{600-700}$ to be 300 to 3000° C./second. The detention time in the range of 500 to 600° C. in the heating stage relates to the amount of formed Mn-containing precursor, and the detention time in the range of 600 to 700° C. in the heating stage relates to the amount of formed $SiO_2$ oxide film. When the value of dec-$S_{500-600}$ is more than that of dec-$S_{600-700}$, the amount of formed Mn-containing precursor becomes less than that of formed $SiO_2$ oxide film. In the case, it may be difficult to control the Mn-containing oxide in glass film of final product. The dec-$S_{600-700}$ is preferably 1.2 to 5.0 times as compared with the dec-$S_{500-600}$.

When the dec-$S_{500-600}$ is less than 300° C./second, excellent magnetic characteristics is not obtained. The dec-$S_{500-600}$ is preferably 400° C./second or more. On the other hand, when the dec-$S_{500-600}$ is more than 2000° C./second, the Mn-containing precursor is not preferably formed. The dec-$S_{500-600}$ is preferably 1700° C./second or less.

In addition, it is important to control the dec-$S_{600-700}$. For example, when the amount of formed $SiO_2$ oxide film is significantly insufficient, the formation of glass film may be unstable, and the defects such as holes may occur in the glass film. Thus, the dec-$S_{600-700}$ is to be 300 to 3000° C./second. The dec-$S_{600-700}$ is preferably 500° C./second or more. In order to suppress the overshoot, the dec-$S_{600-700}$ is preferably 2500° C./second or less.

In the case where the isothermal holding is conducted at 600° C. in the heating stage of decarburization annealing, the dec-$S_{500-600}$ and the dec-$S_{600-700}$ may become unclear respectively. In the embodiment, in the case where the isothermal holding is conducted at 600° C. in the heating stage of decarburization annealing, the dec-$S_{500-600}$ is defined as the heating rate on the basis of the point of reaching 500° C. and the point of starting the isothermal holding at 600° C. Similarly, the dec-$S_{600-700}$ is defined as the heating rate on the basis of the point of finishing the isothermal holding at 600° C. and the point of reaching 700° C.

In the embodiment, in addition to the heating rate, the atmosphere is controlled in the decarburization annealing. As described above, the Mn-containing precursor tends to be easily formed in the temperature range of 500 to 600° C., and the $SiO_2$ oxide film tends to be easily formed in the temperature range of 600 to 700° C. The oxidation degree $PH_2O/PH_2$ in each of the temperature ranges affects the thermodynamic stability of formed Mn-containing precursor and formed $SiO_2$ oxide film. Thus, in order to balance the amount of formed Mn-containing precursor and the amount of formed $SiO_2$ oxide film, and to control the thermodynamic stability of formed Mn-containing precursor and formed $SiO_2$ oxide film, it is necessary to control the oxidation degree in each of the temperature ranges.

Specifically, it is necessary to control the dec-$P_{500-600}$ to be 0.00010 to 0.50 and the dec-$P_{600-700}$ to be 0.00001 to 0.50. When the dec-$P_{500-600}$ or the dec-$P_{600-700}$ is out of the above range, it may be difficult to preferably control the amount and the thermodynamic stability of formed Mn-containing precursor and formed $SiO_2$ oxide film, and to control the Mn-containing oxide in glass film of final product.

The oxidation degree $PH_2O/PH_2$ is defined as the ratio of water vapor partial pressure $PH_2O$ to hydrogen partial pressure $PH_2$ in the atmosphere. When the dec-$P_{500-600}$ is more than 0.50, the fayalite ($Fe_2SiO_4$) may be excessively formed, and thereby the formation of Mn-containing precursor may be suppressed. The upper limit of dec-$P_{500-600}$ is preferably 0.3. On the other hand, the lower limit of dec-$P_{500-600}$ is not particularly limited. However, the lower limit may be 0.00010. The lower limit of dec-$P_{500-600}$ is preferably 0.0005.

When the dec-$P_{600-700}$ is more than 0.50, $Fe_2SiO_4$ may be excessively formed, the $SiO_2$ oxide film may tend not to be uniformly formed, and thereby the defects in the glass film may be formed. The upper limit of dec-$P_{600-700}$ is preferably 0.3. On the other hand, the lower limit of dec-$P_{600-700}$ is not particularly limited. However, the lower limit may be 0.00001. The lower limit of dec-$P_{600-700}$ is preferably 0.00005.

In addition to control the dec-$P_{500-600}$ and the dec-$P_{600-700}$ to be the above ranges, it is preferable that the dec-$P_{500-600}$ and the dec-$P_{600-700}$ satisfy dec-$P_{500-600}$>dec-$P_{600-700}$. When the value of dec-$P_{600-700}$ is less than that of dec-$P_{500-600}$, it is possible to more preferably control the amount and the thermodynamic stability of formed Mn-containing precursor and formed $SiO_2$ oxide film.

Although the precursor of Mn-containing oxide (Mn-containing precursor) which is formed in the decarburization annealing process of the embodiment is not clear at present, it seems that the Mn-containing precursor is composed of various manganese oxides such as MnO, $Mn_2O_3$, $MnO_2$, $MnO_3$, and $Mn_2O_7$, and/or various Mn—Si-based complex oxides such as tephroite ($Mn_2SiO_4$) and knebelite ($(Fe, Mn)_2SiO_4$).

In the case where the isothermal holding is conducted at 600° C. in the heating stage of decarburization annealing, the dec-$P_{500-600}$ is defined as the oxidation degree $PH_2O/PH_2$ on the basis of the point of reaching 500° C. and the point of finishing the isothermal holding at 600° C. Similarly, the dec-$P_{600-700}$ is defined as the oxidation degree $PH_2O/PH_2$ on the basis of the point of finishing the isothermal holding at 600° C. and the point of reaching 700° C.

(2) Holding Conditions

In the decarburization annealing process, it is important to satisfy the heating rate and the atmosphere in the above heating stage, and the holding conditions in the decarburization annealing temperature are not particularly limited. In general, in the holding stage of decarburization annealing, the holding is conducted in the temperature range of 700 to 1000° C. for 10 seconds to 10 minutes. Multi-step annealing may be conducted. In the embodiment, two-step annealing as explained below may be conducted in the holding stage of decarburization annealing.

For example, in the decarburization annealing process, the cold rolled steel sheet is held under the following conditions. The first annealing and the second annealing are conducted after raising the temperature of cold rolled steel sheet. When dec-$T_I$ is a holding temperature in units of ° C., dec-$t_I$ is a holding time in units of second, and dec-$P_I$ is an oxidation degree $PH_2O/PH_2$ of an atmosphere during the first annealing and when dec-$T_{II}$ is a holding temperature in units of ° C., dec-$t_{II}$ is a holding time in units of second, and dec-$P_{II}$ is an oxidation degree $PH_2O/PH_2$ of an atmosphere during the second annealing, the dec-$T_I$ is 700 to 900° C., the dec-$t_I$ is 10 to 1000 seconds, the dec-$P_I$ is 0.10 to 1.0, the dec-$T_{II}$ is (dec-$T_I$+50°) C. or more and 1000° C. or less, the dec-$t_{II}$ is 5 to 500 seconds, the dec-$P_{II}$ is 0.00001 to 0.10, and the dec-$P_I$ and the dec-$P_{II}$ satisfy dec-$P_I$>dec-$P_{II}$.

In the embodiment, although it is important to control the formation of the precursor of Mn-containing oxide (Mn-containing precursor) in the heating stage of decarburization annealing, the formation of Mn-containing precursor may be preferably controlled by conducting the two-step annealing where the first annealing is conducted in lower temperature and the second annealing is conducted in higher temperature in the holding stage.

For example, in the first annealing, the dec-$T_I$ (sheet temperature) may be 700 to 900° C., and the dec-$t_I$ may be 10 seconds or more for improving the decarburization. The lower limit of dec-$T_I$ is preferably 780° C. The upper limit of dec-$T_I$ is preferably 860° C. The lower limit of dec-$t_I$ is preferably 50 seconds. The upper limit of dec-$t_I$ is not particularly limited, but may be 1000 seconds for the productivity. The upper limit of dec-$t_I$ is preferably 300 seconds.

In the first annealing, the dec-PI may be 0.10 to 1.0 for controlling the Mn-containing precursor. In addition to the above, it is preferable to control the dec-PI to be large value as compared with the dec-$P_{500-600}$ and the dec-$P_{600-700}$. In the first annealing, when the oxidation degree is sufficiently large, it is possible to suppress the replacement of the Mn-containing precursor with $SiO_2$. Moreover, when the oxidation degree is sufficiently large, it is possible to sufficiently proceed the decarburization reaction. However, when the dec-PI is excessively large, the Mn-containing precursor may be replaced with the fayalite ($Fe_2SiO_4$). $Fe_2SiO_4$ deteriorates the adhesion of glass film. The lower limit of dec-PI is preferably 0.2. The upper limit of dec-$P_I$ is preferably 0.8.

Even when the first annealing is controlled, it is difficult to perfectly suppress the formation of $Fe_2SiO_4$. Thus, it is preferable to control the second-stage annealing. For example, in the second annealing, the dec-$T_{II}$ (sheet temperature) may be (dec-$T_I$+50°) C. or more and 1000° C. or less, and the dec-$t_{II}$ may be 5 to 500 seconds. When the second annealing is conducted under the above conditions, $Fe_2SiO_4$ is reduced to the Mn-containing precursor during the second annealing, even if $Fe_2SiO_4$ is formed during the first annealing. The lower limit of dec-$T_{II}$ is preferably (dec-$T_I$+100°) C. The lower limit of dec-$t_{II}$ is preferably 10 seconds. When the dec-$t_{II}$ is more than 500 seconds, the Mn-containing precursor may be reduced to $SiO_2$. The upper limit of dec-$t_{II}$ is preferably 100 seconds.

In order to control the second annealing to be reducing atmosphere, it is preferable to satisfy dec-$P_I$>dec-$P_{II}$, in addition to control the dec-$P_{II}$ to be 0.00001 to 0.10. By conducting the second annealing under the above atmosphere conditions, it is possible to preferably obtain excellent coating adhesion as the final product.

In addition, in the embodiment, it is preferable to control the oxidation degree $PH_2O/PH_2$ through the heating stage and the holding stage of decarburization annealing. Specifically, in the decarburization annealing process, it is preferable that the dec-$P_{500-600}$, the dec-$P_{600-700}$, the dec-$P_I$, and the dec-$P_{II}$ satisfy dec-$P_{500-600}$>dec-$P_{600-700}$<dec-$P_I$>dec-$P_{II}$. Namely, it is preferable that: the oxidation degree is changed to smaller value at the time of switching from the temperature range of 500 to 600° C. to the temperature range of 600 to 700° C. in the heating stage; the oxidation degree is changed to larger value at the time of switching from the temperature range of 600 to 700° C. in the heating stage to the first annealing in the holding stage; and the oxidation degree is changed to smaller value at the time of switching from the first annealing to the second annealing in the holding stage. By controlling the oxidation degree as described above, it is possible to preferably control the formation of Mn-containing precursor.

In addition, in the method for producing the grain-oriented electrical steel sheet according to the embodiment, nitridation may be conducted after the decarburization annealing and before applying the annealing separator. In the nitridation, the steel sheet after the decarburization annealing is subjected to the nitridation, and then the nitrided steel sheet is obtained.

The nitridation may be conducted under the known conditions. For example, the preferable conditions for nitridation are as follows.

Nitridation temperature: 700 to 850° C.

Atmosphere in nitridation furnace (nitridation atmosphere): atmosphere including gas with nitriding ability such as hydrogen, nitrogen, and ammonia.

When the nitridation temperature is 700° C. or more, or when the nitridation temperature is 850° C. or less, nitrogen tends to penetrate into the steel sheet during the nitridation. When the nitridation is conducted within the temperature range, it is possible to preferably secure the amount of nitrogen in the steel sheet. Thus, the fine AlN is preferably formed in the steel sheet before the secondary recrystallization. As a result, the secondary recrystallization preferably occurs during the final annealing. The time for holding the steel sheet during the nitridation is not particularly limited, but may be 10 to 60 seconds.

3-5. Final Annealing Process

In the final annealing process, the annealing separator is applied to the decarburization annealed sheet after the decarburization annealing process, and then the final annealing is conducted. In the final annealing, the coiled steel sheet may be annealed for a long time. In order to suppress the seizure of coiled steel sheet during the final annealing, the annealing separator is applied to the decarburization annealed sheet and dried before the final annealing.

The annealing separator may include the magnesia (MgO) as main component. Moreover, the annealing separator may include the Ti-compound of 0.5 to 10 mass % in metallic Ti equivalent. During the final annealing, MgO in the annealing separator reacts with the oxide film of decarburization annealing, whereby the glass film ($Mg_2SiO_4$ and the like) is formed. In general, when the annealing separator includes Ti, TiN is formed in the glass film. On the other hand, in the embodiment, since the Mn-containing precursor and the interfacial segregation Mn are present, it is suppressed to form TiN in the glass film.

The annealing conditions of final annealing are not particularly limited, and known conditions may be appropriately applied. For example, in the final annealing, the decarburization annealed sheet after applying and drying the annealing separator may be held in the temperature range of 1000 to 1300° C. for 10 to 60 hours. By conducting the final annealing under the above conditions, the secondary recrystallization occurs, and Mn segregates between the glass film and the silicon steel sheet. As a result, it is possible to improve the coating adhesion without deteriorating the magnetic characteristics. The atmosphere during the final annealing may be nitrogen atmosphere or the mixed atmosphere of nitrogen and hydrogen. When the atmosphere during the final annealing is the mixed atmosphere of nitrogen and hydrogen, the oxidation degree may be adjusted to 0.5 or less.

By the final annealing, the secondary recrystallization occurs in the steel sheet, and the grains are aligned with {110}<001> orientation. In the secondary recrystallized structure, the easy axis of magnetization is aligned in the rolling direction, and the grains are coarse. Due to the secondary recrystallized structure, it is possible to obtain the excellent magnetic characteristics. After the final annealing and before the formation of the insulation coating, the surface of final annealed sheet may be washed with water or pickled to remove powder and the like.

In the embodiment, Mn in the steel diffuses during the final annealing, and Mn segregates in the interface between the glass film and the silicon steel sheet (interfacial segregation Mn). The reason why Mn segregates in the interface is not clear at present, it seems that the above Mn segregation is affected by the presence of the Mn-containing precursor near the surface of decarburization annealed sheet. In the case where the Mn-containing precursor does not exist near the surface of decarburization annealed sheet as the conventional technics, Mn tends not segregate in the interface between the glass film and the silicon steel sheet. Even when Mn segregates in the interface, it is difficult to obtain the interfacial segregation Mn as in the embodiment.

3-6. Insulation Coating Forming Process

In the insulation coating forming process, the insulation coating forming solution is applied to the final annealed sheet after the final annealing process, and then the heat treatment is conducted. By the heat treatment, the insulation coating is formed on the surface of the final annealed sheet. For example, the insulation coating forming solution may include colloidal silica and phosphate. The insulation coating forming solution also may include chromium.

(1) Heating Conditions

In the embodiment, the heating conditions for heating the final annealed sheet to which the insulation coating forming solution is applied are controlled. Specifically, the final annealed sheet is heated under the following conditions. When ins-$S_{600-700}$ is an average heating rate in units of ° C./second in a temperature range of 600 to 700° C. and ins-$S_{700-800}$ is an average heating rate in units of ° C./second in a temperature range of 700 to 800° C. during raising a temperature of the final annealed sheet, the ins-$S_{600-700}$ is 10 to 200° C./second, the ins-$S_{700-800}$ is 5 to 100° C./second, and the ins-$S_{600-700}$ and the ins-$S_{700-800}$ satisfy ins-$S_{600-700}$>ins-$S_{700-800}$.

As described above, in the final annealed sheet, the Mn-containing precursor exists and Mn segregates in the interface between the glass film and the silicon steel sheet (base steel sheet). At the time after the final annealing and before the formation of the insulation coating, Mn may exist in the interface with the Mn-containing precursor or as the interfacial segregation Mn (Mn atom alone). When the insulation coating is formed under the above heating conditions by using the above final annealed sheet, the Mn-containing oxide (Braunite or Trimanganese tetroxide) is formed from the Mn-containing precursor and the interfacial segregation Mn.

In order to preferentially form the Mn-containing oxide, in particular $Mn_7SiO_{12}$ (Braunite) and Trimanganese tetroxide ($Mn_3O_4$), it is necessary to suppress the formation of $SiO_2$ or Fe-based oxide during the heating stage for forming the insulating coating. $SiO_2$ or Fe-based oxide has the highly symmetrical shape such as sphere or rectangle. Thus, $SiO_2$ or Fe-based oxide does not sufficiently act as the anchor, and hard to contribute to the improvement of coating adhesion. $SiO_2$ or Fe-based oxide preferentially forms in the temperature range of 600 to 700° C. during the heating stage for forming the insulating coating. On the other hand, the Mn-containing oxide (Braunite or $Mn_3O_4$) preferentially forms in the temperature range of 700 to 800° C. Thus, it is necessary to shorten the detention time in the range of 600 to 700° C. where $SiO_2$ or Fe-based oxide forms, as compared with the detention time in the range of 700 to 800° C. where the Mn-containing oxide (Braunite or $Mn_3O_4$) forms.

Thus, it is necessary to satisfy ins-$S_{600-700}$>ins-$S_{700-800}$, in addition to control the ins-$S_{600-700}$ to be 10 to 200° C./second and the ins-$S_{700-800}$ to be 5 to 100° C./second. When the value of ins-$S_{700-800}$ is more than that of ins-$S_{600-700}$, the amount of formed $SiO_2$ or Fe-based oxide becomes more than that of formed Mn-containing oxide (Braunite or $Mn_3O_4$). In the case, it may be difficult to improve the coating adhesion. The ins-$S_{600-700}$ is preferably 1.2 to 20 times as compared with the ins-$S_{700-800}$.

When the ins-$S_{600-700}$ is less than 10° C./second, $SiO_2$ or Fe-based oxide forms excessively, and then it is difficult to preferably control the Mn-containing oxide (Braunite or $Mn_3O_4$). The ins-$S_{600-700}$ is preferably 40° C./second or more. In order to suppress the overshoot, the ins-$S_{600-700}$ may be 200° C./second.

In addition, it is important to control the ins-$S_{700-800}$. In the temperature range, the Mn-containing oxide (Braunite or $Mn_3O_4$) forms preferentially. Thus, in order to secure the detention time in the temperature range, it is necessary to decrease the value of ins-$S_{700-800}$. When the ins-$S_{700-800}$ is more than 100° C./second, the Mn-containing oxide (Braunite or $Mn_3O_4$) does not form sufficiently. The ins-$S_{700-800}$ is preferably 50° C./second or less. The lower limit of ins-$S_{700-800}$ is not particularly limited, but may be 5° C./second for the productivity.

In the insulation coating forming process, it is preferable to control the oxidation degree of atmosphere in the heating stage, in addition to the above heating rate. Specifically, the final annealed sheet is preferably heated under the following conditions. When ins-$P_{600-700}$ is an oxidation degree $PH_2O/PH_2$ of an atmosphere in the temperature range of 600 to 700° C. and ins-$P_{700-800}$ is an oxidation degree $PH_2O/PH_2$ of an atmosphere in the temperature range of 700 to 800° C. during raising the temperature of the final annealed sheet, the ins-$P_{600-700}$ is 1.0 or more, the ins-$P_{700-800}$ is 0.1 to 5.0, and the ins-$P_{600-700}$ and the ins-$P_{700-800}$ satisfy ins-$P_{600-700}$>ins-$P_{700-800}$.

Although the insulation coating shows oxidation resistance, the structure thereof may be damaged in reducing atmosphere, and thereby it may be difficult to obtain the desired tension and coating adhesion. Thus, the oxidation degree is preferably higher value in the temperature range of 600 to 700° C. where it seems that the insulation coating is started to be dried and be solidified. Specifically, the oxidation degree ins-$P_{600-700}$ is preferably 1.0 or more.

On the other hand, the higher oxidation degree is unnecessary in the temperature range of 700° C. or more. Instead, when the heating is conducted in the higher oxidation degree such as 5.0 or more, it may be difficult to obtain the desired coating tension and coating adhesion. Although the detailed mechanism is not clear at present, it seems that: the crystallization of insulation coating proceeds; the grain boundaries are formed; the atmospheric gas passes through the grain boundaries; the oxidation degree increases in the glass film or the interface between the glass film and the silicon steel sheet; and the oxides harmful to the coating adhesion such as Fe-based oxide are formed. The oxidation degree in the temperature range of 700 to 800° C. is preferably smaller than that in the temperature range of 600 to 700° C.

Specifically, it is preferable to satisfy ins-$P_{600-700}$>ins-$P_{700-800}$, in addition to control the ins-$P_{600-700}$ to be 1.0 or more and the ins-$P_{700-800}$ to be 0.1 to 5.0.

In the case where the annealing is conducted in the atmosphere without hydrogen, the value of $PH_2O/PH_2$ diverges indefinitely. Thus, the upper limit of oxidation degree ins-$P_{600-700}$ is not particularly limited, but may be 100.

When the ins-$P_{700-800}$ is more than 5.0, $SiO_2$ or Fe-based oxide may form excessively. Thus, the upper limit of ins-$P_{700-800}$ is preferably 5.0. On the other hand, the lower limit of ins-$P_{700-800}$ is not particularly limited, but may be 0. The lower limit of ins-$P_{700-800}$ may be 0.1.

In the case where the holding at 700° C. or the primary cooling is conducted in the heating stage for forming the insulation coating, the ins-$P_{600-700}$ is defined as the heating rate on the basis of the point of reaching 600° C. and the point of starting the holding at 700° C. or the point of starting the cooling. Similarly, the ins-$P_{700-800}$ is defined as the heating rate on the basis of the point of finishing the holding at 700° C. or the point of reaching 700° C. by reheating after the cooling and the point of reaching 800° C.

(2) Holding Conditions

In the insulation coating forming process, the holding conditions in the insulation coating forming temperature are not particularly limited. In general, in the holding stage for forming the insulation coating, the holding is conducted in the temperature range of 800 to 1000° C. for 5 to 100 seconds. The holding time is preferably 50 seconds or less.

It is possible to produce the grain-oriented electrical steel sheet according to the embodiment by the above producing method. In the grain-oriented electrical steel sheet produced by the above producing method, the Mn-containing oxide (Braunite or $Mn_3O_4$) is included in the glass film, and thereby, the coating adhesion is preferably improved without deteriorating the magnetic characteristics.

EXAMPLES

Hereinafter, the effects of an aspect of the present invention are described in detail with reference to the following examples. However, the condition in the examples is an example condition employed to confirm the operability and the effects of the present invention, so that the present invention is not limited to the example condition. The present invention can employ various types of conditions as long as the conditions do not depart from the scope of the present invention and can achieve the object of the present invention.

Example 1

A silicon steel slab (steel piece) having the composition shown in Tables 1 to 10 was heated in the range of 1280 to 1400° C. and then hot-rolled to obtain a hot rolled steel sheet having the thickness of 2.3 to 2.8 mm. The hot rolled steel sheet was annealed in the range of 900 to 1200° C., and then cold-rolled once or cold-rolled plural times with an intermediate annealing to obtain a cold rolled steel sheet having the final thickness. The cold rolled steel sheet was decarburization-annealed in wet hydrogen atmosphere. Thereafter, an annealing separator including magnesia as main component was applied, and then, a final annealing was conducted to obtain a final annealed sheet.

An insulation coating was formed by applying the insulation coating forming solution including colloidal silica and phosphate to the surface of final annealed sheet and then being baked, and thereby a grain-oriented electrical steel sheet was produced. The technical features of grain-oriented electrical steel were evaluated on the basis of the above method. Moreover, with respect to the grain-oriented electrical steel, the coating adhesion of the insulation coating and the magnetic characteristics (magnetic flux density) were evaluated.

The magnetic characteristics were evaluated on the basis of the epstein method regulated by JIS C2550: 2011. The magnetic flux density B8 was measured. B8 is the magnetic flux density along rolling direction under the magnetizing field of 800 A/m, and becomes the judgment criteria whether the secondary recrystallization occurs properly. When B8 is 1.89 T or more, the secondary recrystallization was judged to occur properly.

The coating adhesion of the insulation coating was evaluated by rolling a test piece around cylinder with 20 mm of diameter and by measuring an area fraction of remained coating after bending 180°. The area fraction of remained coating was obtained on the basis of an area of the steel sheet which contacted with the cylinder. The area of the steel sheet which contacted with the cylinder was obtained by calculation. The area of remained coating was obtained by taking a photograph of the steel sheet after the above test and by conducting image analysis on the photographic image. In regard to the area fraction of remained coating, the area fraction of 98% or more was judged to be "Excellent", the area fraction of 95% to less than 98% was judged to be "Very Good (VG)", the area fraction of 90% to less than 95% was judged to be "Good", the area fraction of 85% to less than 90% was judged to be "Fair", the area fraction of 80% to less than 85% was judged to be "Poor", and the area fraction of less than 80% was judged to be "Bad". When the area fraction of remained coating was 85% or more, the adhesion was judged to be acceptable.

The production conditions, production results, and evaluation results are shown in Tables 1 to 40. In the tables, "–" with respect to the chemical composition indicates that no alloying element was intentionally added or that the content was less than detection limit. In the tables, "–" other than the chemical components indicates that the test was not performed. Moreover, in the tables, the underlined value indicates out of the range of the present invention.

In the tables, "S1" indicates the dec-$S_{500-600}$, "S2" indicates the dec-$S_{600-700}$, "P1" indicates the dec-$P_{500-600}$, "P2" indicates the dec-$P_{600-700}$, "TI" indicates the dec-$T_I$, "TII" indicates the dec-$T_{II}$, "tI" indicates the dec-$t_I$, "tII" indicates the dec-$t_{II}$, "PI" indicates the dec-$P_I$, "PII" indicates the dec-$P_{II}$, "S3" indicates the ins-$S_{600-700}$, "S4" indicates the ins-$S_{700-800}$, "P3" indicates the ins-$P_{600-700}$, and "P4" indicates the ins-$P_{700-800}$. Moreover, in the tables, "OVERALL OXIDATION DEGREE CONTROL" indicates whether or not dec-$P_{500-600}$>dec-$P_{600-700}$<dec-$P_I$>dec-$P_{II}$ is satisfied. In the tables, "NUMBER FRACTION OF COARSE SECONDARY RECRYSTALLIZED GRAINS IN SECONDARY RECRYSTALLIZED GRAINS" indicates the number fraction of secondary recrystallized grains with the maximum diameter of 30 to 100 mm in the entire secondary recrystallized grains. In the tables, type "B" of "Mn-CONTAINING OXIDE" indicates Braunite, type "M" of "Mn-CONTAINING OXIDE" indicates $Mn_3O_4$. Moreover, in the tables, "DIFFRACTED INTENSITY OF $I_{For}$ AND $I_{TiN}$ BY XRD" indicates whether or not $I_{TiN}<I_{For}$ is satisfied.

In the test Nos. B4 and B48, the rupture occurred during cold rolling. In the test Nos. B11 and B51, the rupture occurred during hot rolling. In the test Nos. A131 to A133 and B43, the annealing separator included the Ti-compound of 0.5 to 10 mass % in metallic Ti equivalent. In the test No. A127, Braunite or $Mn_3O_4$ was not included as the Mn-containing oxide, and the Mn—Si-based complex oxides and the manganese oxides such as MnO were included. Moreover, the evaluation other than magnetic flux density was not performed for the steel sheet showing the magnetic flux density B8 of less than 1.89 T.

In the test Nos. A1 to A133 which are the inventive examples, the examples show excellent coating adhesion and excellent magnetic characteristics. On the other hand, in the test Nos. B1 to B53 which are the comparative examples, sufficient magnetic characteristics are not obtained, sufficient coating adhesion is not obtained, or the rupture occurred during cold rolling.

TABLE 1

| | PRODUCTION CONDITIONS | | | | | | | | | | | | |
|---|---|---|---|---|---|---|---|---|---|---|---|---|---|
| | | | | | | | | | | | DECARBURIZATION ANNEALING PROCESS HEATING STAGE | | |
| | | | | | | | | | | | AVERAGE HEATING RATE | | |
| | HOT ROLLING PROCESS CHEMICAL COMPOSITION OF SILICON STEEL SLAB (STEEL PIECE) (UNIT: mass %, BALANCE CONSISTING OF Fe AND IMPURITIES) | | | | | | | | | | TEMPERATURE RANGE OF 500 TO 600° C. S1 | TEMPERATURE RANGE OF 600 TO 700° C. S2 | HEATING RATE CONTROL S1 < S2 |
| TEST No. | Si | Mn | C | ACID-SOLUBLE Al | N | S | Bi | Sn | Cr | Cu | ° C./sec | ° C./sec | — |
| A1 | 2.65 | 0.030 | 0.012 | 0.019 | 0.017 | 0.009 | — | — | — | — | 800 | 1000 | Good |
| A2 | 2.82 | 0.040 | 0.192 | 0.019 | 0.018 | 0.007 | — | — | — | — | 800 | 1000 | Good |
| A3 | 2.65 | 0.040 | 0.035 | 0.018 | 0.018 | 0.008 | — | — | — | — | 800 | 1000 | Good |
| A4 | 3.95 | 0.030 | 0.152 | 0.017 | 0.018 | 0.009 | — | — | — | — | 800 | 1000 | Good |
| A5 | 2.91 | 0.040 | 0.122 | 0.011 | 0.019 | 0.008 | — | — | — | — | 800 | 1000 | Good |
| A6 | 2.94 | 0.320 | 0.038 | 0.067 | 0.016 | 0.055 | — | — | — | — | 800 | 1000 | Good |
| A7 | 2.90 | 0.450 | 0.187 | 0.061 | 0.018 | 0.045 | — | — | — | — | 800 | 1000 | Good |
| A8 | 3.85 | 0.010 | 0.015 | 0.066 | 0.013 | 0.052 | — | — | — | — | 800 | 1000 | Good |
| A9 | 3.81 | 0.490 | 0.036 | 0.064 | 0.014 | 0.051 | — | — | — | — | 800 | 1000 | Good |
| A10 | 2.72 | 0.330 | 0.028 | 0.062 | 0.015 | 0.006 | — | — | — | — | 800 | 1000 | Good |
| A11 | 2.95 | 0.170 | 0.121 | 0.014 | 0.011 | 0.078 | — | — | — | — | 800 | 1000 | Good |
| A12 | 3.25 | 0.160 | 0.156 | 0.015 | 0.013 | 0.009 | — | 0.006 | — | — | 800 | 1000 | Good |
| A13 | 3.21 | 0.120 | 0.171 | 0.017 | 0.011 | 0.009 | — | 0.48 | — | — | 800 | 1000 | Good |
| A14 | 3.30 | 0.180 | 0.186 | 0.055 | 0.015 | 0.041 | — | — | 0.01 | — | 800 | 1000 | Good |
| A15 | 3.28 | 0.140 | 0.152 | 0.054 | 0.015 | 0.043 | — | — | 0.48 | — | 800 | 1000 | Good |
| A16 | 3.25 | 0.160 | 0.122 | 0.062 | 0.014 | 0.008 | — | — | — | 0.01 | 800 | 1000 | Good |
| A17 | 3.21 | 0.150 | 0.112 | 0.051 | 0.015 | 0.009 | — | — | — | 0.95 | 800 | 1000 | Good |
| A18 | 3.25 | 0.180 | 0.116 | 0.055 | 0.012 | 0.008 | 0.018 | — | — | — | 800 | 1000 | Good |
| A19 | 3.22 | 0.051 | 0.042 | 0.045 | 0.006 | 0.038 | — | — | — | — | 800 | 1000 | Good |

| | PRODUCTION CONDITIONS DECARBURIZATION ANNEALING PROCESS HEATING STAGE OXIDATION DEGREE | | |
|---|---|---|---|
| TEST No. | TEMPERATURE RANGE OF 500 TO 600° C. P1 — | TEMPERATURE RANGE OF 600 TO 700° C. P2 — | OXIDATION DEGREE CONTROL P1 > P2 — |
| A1 | 0.1 | 0.1 | — |
| A2 | 0.1 | 0.1 | — |
| A3 | 0.1 | 0.1 | — |
| A4 | 0.1 | 0.1 | — |
| A5 | 0.1 | 0.1 | — |
| A6 | 0.1 | 0.1 | — |
| A7 | 0.1 | 0.1 | — |
| A8 | 0.1 | 0.1 | — |
| A9 | 0.1 | 0.1 | — |
| A10 | 0.1 | 0.1 | — |
| A11 | 0.1 | 0.1 | — |
| A12 | 0.1 | 0.05 | Good |
| A13 | 0.1 | 0.05 | Good |
| A14 | 0.1 | 0.05 | Good |
| A15 | 0.1 | 0.05 | Good |
| A16 | 0.1 | 0.05 | Good |
| A17 | 0.1 | 0.05 | Good |
| A18 | 0.1 | 0.05 | Good |
| A19 | 0.1 | 0.05 | Good |

TABLE 2

| TEST No. | HOT ROLLING PROCESS CHEMICAL COMPOSITION OF SILICON STEEL SLAB (STEEL PIECE) (UNIT: mass %, BALANCE CONSISTING OF Fe AND IMPURITIES) Si | Mn | C | ACID-SOLUBLE Al | N | S | Bi | Sn | Cr | Cu | PRODUCTION CONDITIONS DECARBURIZATION ANNEALING PROCESS HEATING STAGE AVERAGE HEATING RATE TEMPERATURE RANGE OF 500 TO 600° C. S1 ° C./sec | TEMPERATURE RANGE OF 600 TO 700° C. S2 ° C./sec | HEATING RATE CONTROL S1 < S2 — |
|---|---|---|---|---|---|---|---|---|---|---|---|---|---|
| A20 | 3.26 | 0.052 | 0.091 | 0.042 | 0.006 | 0.017 | — | — | — | — | 800 | 1000 | Good |
| A21 | 3.26 | 0.095 | 0.071 | 0.032 | 0.006 | 0.033 | — | — | — | — | 800 | 1000 | Good |
| A22 | 3.28 | 0.081 | 0.081 | 0.022 | 0.007 | 0.023 | — | — | — | — | 800 | 1000 | Good |
| A23 | 3.25 | 0.051 | 0.072 | 0.025 | 0.009 | 0.022 | 0.001 | 0.11 | — | — | 800 | 1000 | Good |
| A24 | 3.27 | 0.075 | 0.051 | 0.047 | 0.005 | 0.022 | — | — | 0.06 | 0.15 | 800 | 1000 | Good |
| A25 | 3.25 | 0.085 | 0.060 | 0.025 | 0.008 | 0.028 | 0.002 | — | — | 0.08 | 800 | 1000 | Good |
| A26 | 3.25 | 0.091 | 0.052 | 0.022 | 0.005 | 0.038 | — | 0.14 | 0.02 | — | 800 | 1000 | Good |
| A27 | 3.25 | 0.092 | 0.052 | 0.031 | 0.009 | 0.039 | — | 0.02 | 0.12 | 0.03 | 800 | 1000 | Good |
| A28 | 3.35 | 0.078 | 0.056 | 0.046 | 0.006 | 0.032 | — | 0.33 | — | 0.11 | 800 | 1000 | Good |
| A29 | 3.36 | 0.065 | 0.042 | 0.042 | 0.009 | 0.011 | 0.001 | — | 0.37 | — | 800 | 1000 | Good |
| A30 | 3.39 | 0.092 | 0.041 | 0.048 | 0.005 | 0.017 | 0.007 | 0.28 | 0.035 | — | 800 | 1000 | Good |
| B1 | 3.23 | 0.060 | 0.007 | 0.023 | 0.008 | 0.013 | — | — | — | — | 800 | 1000 | Good |
| B2 | 3.25 | 0.040 | 0.215 | 0.031 | 0.007 | 0.017 | — | — | — | — | 800 | 1000 | Good |
| B3 | 2.45 | 0.060 | 0.042 | 0.045 | 0.007 | 0.015 | — | — | — | — | 800 | 1000 | Good |
| B4 | 4.10 | 0.070 | 0.048 | 0.026 | 0.007 | 0.008 | — | — | — | — | — | — | — |
| B5 | 3.20 | 0.080 | 0.056 | 0.008 | 0.006 | 0.008 | — | — | — | — | 800 | 1000 | Good |
| B6 | 3.12 | 0.050 | 0.062 | 0.077 | 0.008 | 0.052 | — | — | — | — | 800 | 1000 | Good |
| B7 | 3.20 | 0.480 | 0.055 | 0.022 | 0.025 | 0.045 | — | — | — | — | 800 | 1000 | Good |
| B8 | 3.31 | 0.009 | 0.031 | 0.045 | 0.008 | 0.066 | — | — | — | — | 800 | 1000 | Good |

| TEST No. | PRODUCTION CONDITIONS DECARBURIZATION ANNEALING PROCESS HEATING STAGE OXIDATION DEGREE TEMPERATURE RANGE OF 500 TO 600° C. P1 — | TEMPERATURE RANGE OF 600 TO 700° C. P2 — | OXIDATION DEGREE CONTROL P1 > P2 — |
|---|---|---|---|
| A20 | 0.1 | 0.05 | Good |
| A21 | 0.1 | 0.05 | Good |
| A22 | 0.1 | 0.05 | Good |
| A23 | 0.1 | 0.05 | Good |
| A24 | 0.1 | 0.05 | Good |
| A25 | 0.1 | 0.05 | Good |
| A26 | 0.1 | 0.05 | Good |
| A27 | 0.1 | 0.05 | Good |
| A28 | 0.1 | 0.05 | Good |
| A29 | 0.1 | 0.05 | Good |
| A30 | 0.1 | 0.05 | Good |
| B1 | 0.1 | 0.05 | Good |
| B2 | 0.1 | 0.05 | Good |
| B3 | 0.1 | 0.05 | Good |
| B4 | — | — | — |
| B5 | 0.1 | 0.05 | Good |
| B6 | 0.1 | 0.05 | Good |
| B7 | 0.1 | 0.05 | Good |
| B8 | 0.1 | 0.05 | Good |

TABLE 3

| TEST No. | HOT ROLLING PROCESS CHEMICAL COMPOSITION OF SILICON STEEL SLAB (STEEL PIECE) (UNIT: mass %, BALANCE CONSISTING OF Fe AND IMPURITIES) Si | Mn | C | ACID-SOLUBLE Al | N | S | Bi | Sn | Cr | Cu | PRODUCTION CONDITIONS DECARBURIZATION ANNEALING PROCESS HEATING STAGE AVERAGE HEATING RATE TEMPERATURE RANGE OF 500 TO 600° C. S1 ° C./sec | TEMPERATURE RANGE OF 600 TO 700° C. S2 ° C./sec | HEATING RATE CONTROL S1 < S2 — |
|---|---|---|---|---|---|---|---|---|---|---|---|---|---|
| B9 | 3.36 | 0.520 | 0.078 | 0.032 | 0.007 | 0.024 | — | — | — | — | 800 | 1000 | Good |
| B10 | 3.34 | 0.440 | 0.062 | 0.020 | 0.008 | 0.004 | — | — | — | — | 800 | 1000 | Good |
| B11 | 3.35 | 0.210 | 0.062 | 0.022 | 0.007 | 0.082 | — | — | — | — | — | — | — |
| B12 | 2.65 | 0.030 | 0.012 | 0.019 | 0.017 | 0.009 | — | — | — | — | 620 | 3700 | Good |
| B13 | 2.51 | 0.040 | 0.035 | 0.018 | 0.018 | 0.008 | — | — | — | — | 360 | 3500 | Good |
| B14 | 2.91 | 0.040 | 0.122 | 0.011 | 0.019 | 0.008 | — | — | — | — | 1850 | 3150 | Good |
| B15 | 2.90 | 0.450 | 0.187 | 0.061 | 0.018 | 0.045 | — | — | — | — | 310 | 310 | Bad |
| B16 | 3.81 | 0.490 | 0.036 | 0.064 | 0.014 | 0.051 | — | — | — | — | 1880 | 3890 | Good |
| B17 | 2.72 | 0.330 | 0.028 | 0.062 | 0.015 | 0.006 | — | — | — | — | 420 | 450 | Good |
| A31 | 2.95 | 0.170 | 0.121 | 0.014 | 0.011 | 0.078 | — | — | — | — | 360 | 420 | Good |
| B18 | 3.25 | 0.160 | 0.156 | 0.015 | 0.013 | 0.009 | — | 0.006 | — | — | 380 | 470 | Good |
| B19 | 3.21 | 0.120 | 0.171 | 0.017 | 0.011 | 0.009 | — | 0.48 | — | — | 390 | 480 | Good |
| B20 | 3.30 | 0.180 | 0.186 | 0.055 | 0.015 | 0.041 | — | — | 0.01 | — | 400 | 490 | Good |
| B21 | 3.21 | 0.150 | 0.112 | 0.051 | 0.015 | 0.009 | — | — | — | 0.95 | 1550 | 3900 | Good |
| B22 | 3.25 | 0.180 | 0.116 | 0.055 | 0.012 | 0.008 | 0.018 | — | — | — | 410 | 1400 | Good |
| A32 | 3.22 | 0.051 | 0.042 | 0.045 | 0.006 | 0.038 | — | — | — | — | 860 | 2700 | Good |
| A33 | 3.26 | 0.052 | 0.091 | 0.042 | 0.006 | 0.017 | — | — | — | — | 410 | 700 | Good |
| B23 | 3.26 | 0.052 | 0.091 | 0.042 | 0.006 | 0.017 | — | — | — | — | 490 | 980 | Good |
| B24 | 3.26 | 0.095 | 0.071 | 0.032 | 0.006 | 0.033 | — | — | — | — | 770 | 1100 | Good |

| TEST No. | PRODUCTION CONDITIONS DECARBURIZATION ANNEALING PROCESS HEATING STAGE OXIDATION DEGREE TEMPERATURE RANGE OF 500 TO 600° C. P1 — | TEMPERATURE RANGE OF 600 TO 700° C. P2 — | OXIDATION DEGREE CONTROL P1 > P2 — |
|---|---|---|---|
| B9 | 0.1 | 0.05 | Good |
| B10 | 0.1 | 0.05 | Good |
| B11 | — | — | — |
| B12 | 0.00007 | 0.00005 | Good |
| B13 | 0.00009 | 0.00005 | Good |
| B14 | 0.14 | 0.1 | Good |
| B15 | 0.13 | 0.1 | Good |
| B16 | 0.00009 | 0.00005 | Good |
| B17 | 0.00001 | 0.00001 | — |
| A31 | 0.49 | 0.49 | — |
| B18 | 0.00007 | 0.00005 | Good |
| B19 | 0.00009 | 0.00005 | Good |
| B20 | 0.00007 | 0.00005 | Good |
| B21 | 0.16 | 0.1 | Good |
| B22 | 0.00007 | 0.00005 | Good |
| A32 | 0.19 | 0.1 | Good |
| A33 | 0.13 | 0.1 | Good |
| B23 | 0.00008 | 0.00005 | Good |
| B24 | 0.00006 | 0.00005 | Good |

TABLE 4

| | PRODUCTION CONDITIONS | | | | | | | | | | | | |
|---|---|---|---|---|---|---|---|---|---|---|---|---|---|
| | | | | | | | | | | | DECARBURIZATION ANNEALING PROCESS HEATING STAGE AVERAGE HEATING RATE | | |
| | HOT ROLLING PROCESS CHEMICAL COMPOSITION OF SILICON STEEL SLAB (STEEL PIECE) (UNIT: mass %, BALANCE CONSISTING OF Fe AND IMPURITIES) | | | | | | | | | | TEMPERATURE RANGE OF 500 TO 600° C. S1 ° C./sec | TEMPERATURE RANGE OF 600 TO 700° C. S2 ° C./sec | HEATING RATE CONTROL S1 < S2 — |
| TEST No. | Si | Mn | C | ACID-SOLUBLE Al | N | S | Bi | Sn | Cr | Cu | | | |
| B25 | 3.28 | 0.081 | 0.081 | 0.022 | 0.007 | 0.023 | — | — | — | — | 900 | 1450 | Good |
| A34 | 3.28 | 0.081 | 0.081 | 0.022 | 0.007 | 0.023 | — | — | — | — | 550 | 2550 | Good |
| A35 | 3.26 | 0.052 | 0.091 | 0.042 | 0.006 | 0.017 | — | — | — | — | 780 | 2600 | Good |
| A36 | 3.26 | 0.052 | 0.091 | 0.042 | 0.006 | 0.017 | — | — | — | — | 720 | 1200 | Good |
| A37 | 3.28 | 0.081 | 0.081 | 0.022 | 0.007 | 0.023 | — | — | — | — | 810 | 1180 | Good |
| A38 | 3.28 | 0.081 | 0.081 | 0.022 | 0.007 | 0.023 | — | — | — | — | 1100 | 1590 | Good |
| A39 | 3.28 | 0.081 | 0.081 | 0.022 | 0.007 | 0.023 | — | — | — | — | 1500 | 2100 | Good |
| A40 | 3.28 | 0.081 | 0.081 | 0.022 | 0.007 | 0.023 | — | — | — | — | 820 | 990 | Good |
| A41 | 3.28 | 0.081 | 0.081 | 0.022 | 0.007 | 0.023 | — | — | — | — | 520 | 1550 | Good |
| A42 | 3.28 | 0.081 | 0.081 | 0.022 | 0.007 | 0.023 | — | — | — | — | 1700 | 2400 | Good |
| A43 | 3.25 | 0.051 | 0.072 | 0.025 | 0.009 | 0.022 | 0.001 | 0.11 | — | — | 780 | 950 | Good |
| A44 | 3.25 | 0.051 | 0.072 | 0.025 | 0.009 | 0.022 | 0.001 | 0.11 | — | — | 500 | 1600 | Good |
| A45 | 3.25 | 0.051 | 0.072 | 0.025 | 0.009 | 0.022 | 0.001 | 0.11 | — | — | 1600 | 2500 | Good |
| A46 | 3.25 | 0.085 | 0.060 | 0.025 | 0.008 | 0.028 | 0.002 | — | — | 0.08 | 810 | 1000 | Good |
| A47 | 3.25 | 0.085 | 0.060 | 0.025 | 0.008 | 0.028 | 0.002 | — | — | 0.08 | 550 | 1600 | Good |
| A48 | 3.25 | 0.085 | 0.060 | 0.025 | 0.008 | 0.028 | 0.002 | — | — | 0.08 | 1500 | 2200 | Good |
| A49 | 3.25 | 0.091 | 0.052 | 0.022 | 0.005 | 0.038 | — | 0.14 | 0.02 | — | 1200 | 2550 | Good |
| A50 | 3.25 | 0.091 | 0.052 | 0.022 | 0.005 | 0.038 | — | 0.14 | 0.02 | — | 780 | 2600 | Good |
| A51 | 3.25 | 0.092 | 0.052 | 0.031 | 0.009 | 0.039 | — | 0.02 | 0.12 | 0.03 | 1550 | 1900 | Good |

| | PRODUCTION CONDITIONS DECARBURIZATION ANNEALING PROCESS HEATING STAGE OXIDATION DEGREE | | |
|---|---|---|---|
| TEST No. | TEMPERATURE RANGE OF 500 TO 600° C. P1 — | TEMPERATURE RANGE OF 600 TO 700° C. P2 — | OXIDATION DEGREE CONTROL P1 > P2 — |
| B25 | 0.00009 | 0.00005 | Good |
| A34 | 0.0002 | 0.0001 | Good |
| A35 | 0.085 | 0.05 | Good |
| A36 | 0.0005 | 0.0001 | Good |
| A37 | 0.0012 | 0.0005 | Good |
| A38 | 0.0031 | 0.001 | Good |
| A39 | 0.0012 | 0.0005 | Good |
| A40 | 0.15 | 0.1 | Good |
| A41 | 0.08 | 0.05 | Good |
| A42 | 0.12 | 0.05 | Good |
| A43 | 0.15 | 0.1 | Good |
| A44 | 0.08 | 0.01 | Good |
| A45 | 0.12 | 0.05 | Good |
| A46 | 0.15 | 0.1 | Good |
| A47 | 0.09 | 0.05 | Good |
| A48 | 0.12 | 0.05 | Good |
| A49 | 0.15 | 0.1 | Good |
| A50 | 0.005 | 0.001 | Good |
| A51 | 0.003 | 0.001 | Good |

TABLE 5

| | PRODUCTION CONDITIONS | | | | | | | | | | | | |
|---|---|---|---|---|---|---|---|---|---|---|---|---|---|
| | | | | | | | | | | | DECARBURIZATION ANNEALING PROCESS HEATING STAGE AVERAGE HEATING RATE | | |
| | HOT ROLLING PROCESS CHEMICAL COMPOSITION OF SILICON STEEL SLAB (STEEL PIECE) (UNIT: mass %, BALANCE CONSISTING OF Fe AND IMPURITIES) | | | | | | | | | | TEMPERATURE RANGE OF 500 TO 600° C. S1 ° C./sec | TEMPERATURE RANGE OF 600 TO 700° C. S2 ° C./sec | HEATING RATE CONTROL S1 < S2 — |
| TEST No. | Si | Mn | C | ACID-SOLUBLE Al | N | S | Bi | Sn | Cr | Cu | | | |
| A52 | 3.25 | 0.092 | 0.052 | 0.031 | 0.009 | 0.039 | — | 0.02 | 0.12 | 0.03 | 410 | 1400 | Good |
| A53 | 3.35 | 0.078 | 0.056 | 0.046 | 0.006 | 0.032 | — | 0.33 | — | 0.11 | 900 | 2700 | Good |
| A54 | 3.36 | 0.065 | 0.042 | 0.042 | 0.009 | 0.011 | 0.001 | — | 0.37 | — | 410 | 800 | Good |
| A55 | 3.36 | 0.065 | 0.042 | 0.042 | 0.009 | 0.011 | 0.001 | — | 0.37 | — | 800 | 2400 | Good |
| A56 | 3.39 | 0.092 | 0.041 | 0.048 | 0.005 | 0.017 | 0.007 | 0.28 | 0.035 | — | 790 | 2500 | Good |
| B26 | 3.28 | 0.140 | 0.152 | 0.054 | 0.015 | 0.043 | — | — | 0.48 | — | 590 | 450 | Bad |
| B27 | 3.25 | 0.160 | 0.122 | 0.062 | 0.014 | 0.008 | — | — | — | 0.01 | 270 | 480 | Good |
| B28 | 3.21 | 0.150 | 0.112 | 0.051 | 0.015 | 0.009 | — | — | — | 0.95 | 2200 | 2700 | Good |
| B29 | 3.25 | 0.180 | 0.116 | 0.055 | 0.012 | 0.008 | 0.018 | — | — | — | 310 | 280 | Bad |
| B30 | 3.22 | 0.051 | 0.042 | 0.045 | 0.006 | 0.038 | — | — | — | — | 460 | 880 | Good |
| B31 | 3.28 | 0.140 | 0.152 | 0.054 | 0.015 | 0.043 | — | — | 0.48 | — | 620 | 1700 | Good |
| B32 | 3.25 | 0.160 | 0.122 | 0.062 | 0.014 | 0.008 | — | — | — | 0.01 | 350 | 1500 | Good |
| B33 | 3.22 | 0.051 | 0.042 | 0.045 | 0.006 | 0.038 | — | — | — | — | 550 | 2500 | Good |
| A57 | 3.22 | 0.051 | 0.042 | 0.045 | 0.006 | 0.038 | — | — | — | — | 600 | 1300 | Good |
| A58 | 3.22 | 0.051 | 0.042 | 0.045 | 0.006 | 0.038 | — | — | — | — | 600 | 1300 | Good |
| A59 | 3.26 | 0.052 | 0.091 | 0.042 | 0.006 | 0.017 | — | — | — | — | 600 | 1300 | Good |
| A60 | 3.26 | 0.052 | 0.091 | 0.042 | 0.006 | 0.017 | — | — | — | — | 600 | 1300 | Good |
| A61 | 3.26 | 0.095 | 0.071 | 0.032 | 0.006 | 0.033 | — | — | — | — | 600 | 1300 | Good |
| A62 | 3.26 | 0.095 | 0.071 | 0.032 | 0.006 | 0.033 | — | — | — | — | 600 | 1300 | Good |

| | PRODUCTION CONDITIONS DECARBURIZATION ANNEALING PROCESS HEATING STAGE OXIDATION DEGREE | | |
|---|---|---|---|
| TEST No. | TEMPERATURE RANGE OF 500 TO 600° C. P1 — | TEMPERATURE RANGE OF 600 TO 700° C. P2 — | OXIDATION DEGREE CONTROL P1 > P2 — |
| A52 | 0.25 | 0.15 | Good |
| A53 | 0.27 | 0.2 | Good |
| A54 | 0.25 | 0.2 | Good |
| A55 | 0.29 | 0.25 | Good |
| A56 | 0.28 | 0.2 | Good |
| B26 | 0.005 | 0.001 | Good |
| B27 | 0.004 | 0.001 | Good |
| B28 | 0.006 | 0.001 | Good |
| B29 | 0.007 | 0.001 | Good |
| B30 | 0.51 | 0.45 | Good |
| B31 | 0.0009 | 0.0001 | Good |
| B32 | 0.0008 | 0.0001 | Good |
| B33 | 0.08 | 0.05 | Good |
| A57 | 0.1 | 0.05 | Good |
| A58 | 0.1 | 0.05 | Good |
| A59 | 0.1 | 0.05 | Good |
| A60 | 0.1 | 0.05 | Good |
| A61 | 0.1 | 0.05 | Good |
| A62 | 0.1 | 0.05 | Good |

TABLE 6

| | PRODUCTION CONDITIONS | | | | | | | | | | | | |
|---|---|---|---|---|---|---|---|---|---|---|---|---|---|
| | | | | | | | | | | | DECARBURIZATION ANNEALING PROCESS HEATING STAGE AVERAGE HEATING RATE | | |
| | HOT ROLLING PROCESS CHEMICAL COMPOSITION OF SILICON STEEL SLAB (STEEL PIECE) (UNIT: mass %, BALANCE CONSISTING OF Fe AND IMPURITIES) | | | | | | | | | | TEMPERATURE RANGE OF 500 TO | TEMPERATURE RANGE OF 600 TO | HEATING RATE |
| TEST No. | Si | Mn | C | ACID-SOLUBLE Al | N | S | Bi | Sn | Or | Cu | 600° C. S1 ° C./sec | 700° C. S2 ° C./sec | CONTROL S1 < S2 — |
| A63 | 3.28 | 0.081 | 0.081 | 0.022 | 0.007 | 0.023 | — | — | — | — | 600 | 1300 | Good |
| A64 | 3.28 | 0.081 | 0.081 | 0.022 | 0.007 | 0.023 | — | — | — | — | 600 | 1300 | Good |
| A65 | 3.25 | 0.051 | 0.072 | 0.025 | 0.009 | 0.022 | 0.001 | 0.11 | — | — | 600 | 1300 | Good |
| A66 | 3.25 | 0.051 | 0.072 | 0.025 | 0.009 | 0.022 | 0.001 | 0.11 | — | — | 600 | 1300 | Good |
| A67 | 3.22 | 0.051 | 0.042 | 0.045 | 0.006 | 0.038 | — | — | — | — | 600 | 1300 | Good |
| A68 | 3.22 | 0.051 | 0.042 | 0.045 | 0.006 | 0.038 | — | — | — | — | 600 | 1300 | Good |
| A69 | 3.26 | 0.052 | 0.091 | 0.042 | 0.006 | 0.017 | — | — | — | — | 600 | 1300 | Good |
| A70 | 3.26 | 0.052 | 0.091 | 0.042 | 0.006 | 0.017 | — | — | — | — | 600 | 1300 | Good |
| A71 | 3.26 | 0.095 | 0.071 | 0.032 | 0.006 | 0.033 | — | — | — | — | 600 | 1300 | Good |
| A72 | 3.26 | 0.095 | 0.071 | 0.032 | 0.006 | 0.033 | — | — | — | — | 600 | 1300 | Good |
| A73 | 3.28 | 0.081 | 0.081 | 0.022 | 0.007 | 0.023 | — | — | — | — | 600 | 1300 | Good |
| A74 | 3.28 | 0.081 | 0.081 | 0.022 | 0.007 | 0.023 | — | — | — | — | 600 | 1300 | Good |
| A75 | 3.25 | 0.051 | 0.072 | 0.025 | 0.009 | 0.022 | 0.001 | 0.11 | — | — | 600 | 1300 | Good |
| A76 | 3.25 | 0.051 | 0.072 | 0.025 | 0.009 | 0.022 | 0.001 | 0.11 | — | — | 600 | 1300 | Good |
| A77 | 3.26 | 0.095 | 0.071 | 0.032 | 0.006 | 0.033 | — | — | — | — | 600 | 1300 | Good |
| A78 | 3.28 | 0.081 | 0.081 | 0.022 | 0.007 | 0.023 | — | — | — | — | 600 | 1300 | Good |
| A79 | 3.28 | 0.081 | 0.081 | 0.022 | 0.007 | 0.023 | — | — | — | — | 600 | 1500 | Good |
| A80 | 3.28 | 0.081 | 0.081 | 0.022 | 0.007 | 0.023 | — | — | — | — | 600 | 1500 | Good |
| A81 | 3.28 | 0.081 | 0.081 | 0.022 | 0.007 | 0.023 | — | — | — | — | 600 | 1500 | Good |

| | PRODUCTION CONDITIONS DECARBURIZATION ANNEALING PROCESS HEATING STAGE OXIDATION DEGREE | | |
|---|---|---|---|
| | TEMPERATURE RANGE OF 500 TO 600° C. | TEMPERATURE RANGE OF 600 TO 700° C. | OXIDATION DEGREE CONTROL |
| TEST No. | P1 — | P2 — | P1 > P2 — |
| A63 | 0.1 | 0.05 | Good |
| A64 | 0.1 | 0.05 | Good |
| A65 | 0.1 | 0.05 | Good |
| A66 | 0.1 | 0.05 | Good |
| A67 | 0.1 | 0.05 | Good |
| A68 | 0.1 | 0.05 | Good |
| A69 | 0.1 | 0.05 | Good |
| A70 | 0.1 | 0.05 | Good |
| A71 | 0.1 | 0.05 | Good |
| A72 | 0.1 | 0.05 | Good |
| A73 | 0.1 | 0.05 | Good |
| A74 | 0.1 | 0.05 | Good |
| A75 | 0.1 | 0.05 | Good |
| A76 | 0.1 | 0.05 | Good |
| A77 | 0.1 | 0.05 | Good |
| A78 | 0.1 | 0.05 | Good |
| A79 | 0.1 | 0.05 | Good |
| A80 | 0.1 | 0.05 | Good |
| A81 | 0.1 | 0.05 | Good |

TABLE 7

| | PRODUCTION CONDITIONS | | | | | | | | | | | | |
|---|---|---|---|---|---|---|---|---|---|---|---|---|---|
| | | | | | | | | | | | DECARBURIZATION ANNEALING PROCESS HEATING STAGE AVERAGE HEATING RATE | | |
| | HOT ROLLING PROCESS CHEMICAL COMPOSITION OF SILICON STEEL SLAB (STEEL PIECE) (UNIT: mass %, BALANCE CONSISTING OF Fe AND IMPURITIES) | | | | | | | | | | TEMPERATURE RANGE OF 500 TO 600° C. S1 | TEMPERATURE RANGE OF 600 TO 700° C. S2 | HEATING RATE CONTROL S1 < S2 |
| TEST No. | Si | Mn | C | ACID-SOLUBLE Al | N | S | Bi | Sn | Cr | Cu | ° C./sec | ° C./sec | — |
| A82 | 3.25 | 0.051 | 0.072 | 0.025 | 0.009 | 0.022 | 0.001 | 0.11 | — | — | 600 | 1500 | Good |
| A83 | 3.25 | 0.051 | 0.072 | 0.025 | 0.009 | 0.022 | 0.001 | 0.11 | — | — | 600 | 1500 | Good |
| A84 | 3.25 | 0.051 | 0.072 | 0.025 | 0.009 | 0.022 | 0.001 | 0.11 | — | — | 600 | 1500 | Good |
| A85 | 3.25 | 0.085 | 0.060 | 0.025 | 0.008 | 0.028 | 0.002 | — | — | 0.08 | 600 | 1500 | Good |
| A86 | 3.25 | 0.085 | 0.060 | 0.025 | 0.008 | 0.028 | 0.002 | — | — | 0.08 | 600 | 1500 | Good |
| A87 | 3.25 | 0.091 | 0.052 | 0.022 | 0.005 | 0.038 | — | 0.14 | 0.02 | — | 600 | 1500 | Good |
| A88 | 3.25 | 0.091 | 0.052 | 0.022 | 0.005 | 0.038 | — | 0.14 | 0.02 | — | 600 | 1500 | Good |
| A89 | 3.25 | 0.092 | 0.052 | 0.031 | 0.009 | 0.039 | — | 0.02 | 0.12 | 0.03 | 600 | 1500 | Good |
| A90 | 3.25 | 0.092 | 0.052 | 0.031 | 0.009 | 0.039 | — | 0.02 | 0.12 | 0.03 | 600 | 1500 | Good |
| A91 | 3.35 | 0.078 | 0.056 | 0.046 | 0.006 | 0.032 | — | 0.33 | — | 0.11 | 600 | 1500 | Good |
| A92 | 3.35 | 0.078 | 0.056 | 0.046 | 0.006 | 0.032 | — | 0.33 | — | 0.11 | 600 | 1500 | Good |
| A93 | 3.36 | 0.065 | 0.042 | 0.042 | 0.009 | 0.011 | 0.001 | — | 0.37 | — | 600 | 1500 | Good |
| A94 | 3.39 | 0.092 | 0.041 | 0.048 | 0.005 | 0.017 | 0.007 | 0.28 | 0.035 | — | 600 | 1500 | Good |
| A95 | 3.39 | 0.092 | 0.041 | 0.048 | 0.005 | 0.017 | 0.007 | 0.28 | 0.035 | — | 600 | 1500 | Good |
| A96 | 2.65 | 0.030 | 0.012 | 0.019 | 0.017 | 0.009 | — | — | — | — | 700 | 1100 | Good |
| A97 | 2.82 | 0.040 | 0.192 | 0.019 | 0.018 | 0.007 | — | — | — | — | 700 | 1100 | Good |
| A98 | 2.51 | 0.040 | 0.035 | 0.018 | 0.018 | 0.008 | — | — | — | — | 700 | 1100 | Good |
| A99 | 3.95 | 0.030 | 0.152 | 0.017 | 0.018 | 0.009 | — | — | — | — | 700 | 1100 | Good |
| A100 | 2.91 | 0.040 | 0.122 | 0.011 | 0.019 | 0.008 | — | — | — | — | 700 | 1100 | Good |

| | PRODUCTION CONDITIONS DECARBURIZATION ANNEALING PROCESS HEATING STAGE OXIDATION DEGREE | | |
|---|---|---|---|
| TEST No. | TEMPERATURE RANGE OF 500 TO 600° C. P1 — | TEMPERATURE RANGE OF 600 TO 700° C. P2 — | OXIDATION DEGREE CONTROL P1 > P2 — |
| A82 | 0.1 | 0.05 | Good |
| A83 | 0.1 | 0.05 | Good |
| A84 | 0.1 | 0.05 | Good |
| A85 | 0.1 | 0.05 | Good |
| A86 | 0.1 | 0.05 | Good |
| A87 | 0.1 | 0.05 | Good |
| A88 | 0.1 | 0.05 | Good |
| A89 | 0.1 | 0.05 | Good |
| A90 | 0.1 | 0.05 | Good |
| A91 | 0.1 | 0.05 | Good |
| A92 | 0.1 | 0.05 | Good |
| A93 | 0.1 | 0.05 | Good |
| A94 | 0.1 | 0.05 | Good |
| A95 | 0.1 | 0.05 | Good |
| A96 | 0.05 | 0.01 | Good |
| A97 | 0.05 | 0.01 | Good |
| A98 | 0.05 | 0.01 | Good |
| A99 | 0.05 | 0.01 | Good |
| A100 | 0.05 | 0.01 | Good |

TABLE 8

| | PRODUCTION CONDITIONS | | | | | | | | | | | | |
|---|---|---|---|---|---|---|---|---|---|---|---|---|---|
| | | | | | | | | | | | DECARBURIZATION ANNEALING PROCESS HEATING STAGE AVERAGE HEATING RATE | | |
| | HOT ROLLING PROCESS CHEMICAL COMPOSITION OF SILICON STEEL SLAB (STEEL PIECE) (UNIT: mass %, BALANCE CONSISTING OF Fe AND IMPURITIES) | | | | | | | | | | TEMPERATURE RANGE OF 500 TO 600° C. S1 | TEMPERATURE RANGE OF 600 TO 700° C. S2 | HEATING RATE CONTROL S1 > S2 |
| TEST No. | Si | Mn | C | ACID-SOLUBLE Al | N | S | Bi | Sn | Cr | Cu | ° C./sec | ° C./sec | — |
| A101 | 2.94 | 0.320 | 0.038 | 0.067 | 0.016 | 0.055 | — | — | — | — | 700 | 1100 | Good |
| A102 | 2.90 | 0.450 | 0.187 | 0.061 | 0.018 | 0.045 | — | — | — | — | 700 | 1100 | Good |
| A103 | 3.85 | 0.010 | 0.015 | 0.066 | 0.013 | 0.052 | — | — | — | — | 700 | 1100 | Good |
| A104 | 3.81 | 0.490 | 0.036 | 0.064 | 0.014 | 0.051 | — | — | — | — | 700 | 1100 | Good |
| A105 | 2.72 | 0.330 | 0.028 | 0.062 | 0.015 | 0.006 | — | — | — | — | 700 | 1100 | Good |
| A106 | 2.95 | 0.170 | 0.121 | 0.014 | 0.011 | 0.078 | — | — | — | — | 700 | 1100 | Good |
| A107 | 3.25 | 0.160 | 0.156 | 0.015 | 0.013 | 0.009 | — | 0.006 | — | — | 700 | 1100 | Good |
| A108 | 3.21 | 0.120 | 0.171 | 0.017 | 0.011 | 0.009 | — | 0.48 | — | — | 700 | 1100 | Good |
| A109 | 3.30 | 0.180 | 0.186 | 0.055 | 0.015 | 0.041 | — | — | 0.01 | — | 700 | 1100 | Good |
| A110 | 3.28 | 0.140 | 0.152 | 0.054 | 0.015 | 0.043 | — | — | 0.48 | — | 700 | 1100 | Good |
| A111 | 3.25 | 0.160 | 0.122 | 0.062 | 0.014 | 0.008 | — | — | — | 0.01 | 700 | 1100 | Good |
| A112 | 3.21 | 0.150 | 0.112 | 0.051 | 0.015 | 0.009 | — | — | — | 0.95 | 700 | 1100 | Good |
| A113 | 3.25 | 0.180 | 0.116 | 0.055 | 0.012 | 0.008 | 0.018 | — | — | — | 700 | 1100 | Good |
| A114 | 3.22 | 0.051 | 0.042 | 0.045 | 0.006 | 0.038 | — | — | — | — | 700 | 1100 | Good |
| A115 | 3.26 | 0.052 | 0.091 | 0.042 | 0.006 | 0.017 | — | — | — | — | 700 | 1100 | Good |
| A116 | 3.26 | 0.095 | 0.071 | 0.032 | 0.006 | 0.033 | — | — | — | — | 700 | 1100 | Good |
| A117 | 3.28 | 0.081 | 0.081 | 0.022 | 0.007 | 0.023 | — | — | — | — | 700 | 1100 | Good |
| A118 | 3.25 | 0.051 | 0.072 | 0.025 | 0.009 | 0.022 | 0.001 | 0.11 | — | — | 700 | 1100 | Good |
| A119 | 3.27 | 0.075 | 0.051 | 0.047 | 0.005 | 0.022 | — | — | 0.06 | 0.15 | 700 | 1100 | Good |

| | PRODUCTION CONDITIONS DECARBURIZATION ANNEALING PROCESS HEATING STAGE OXIDATION DEGREE | | |
|---|---|---|---|
| | TEMPERATURE RANGE OF 500 TO 600° C. | TEMPERATURE RANGE OF 600 TO 700° C. | OXIDATION DEGREE CONTROL P1 > P2 |
| TEST No. | P1 — | P2 — | — |
| A101 | 0.05 | 0.01 | Good |
| A102 | 0.05 | 0.01 | Good |
| A103 | 0.05 | 0.01 | Good |
| A104 | 0.05 | 0.01 | Good |
| A105 | 0.05 | 0.01 | Good |
| A106 | 0.05 | 0.01 | Good |
| A107 | 0.05 | 0.01 | Good |
| A108 | 0.05 | 0.01 | Good |
| A109 | 0.05 | 0.01 | Good |
| A110 | 0.05 | 0.01 | Good |
| A111 | 0.05 | 0.01 | Good |
| A112 | 0.05 | 0.01 | Good |
| A113 | 0.05 | 0.01 | Good |
| A114 | 0.05 | 0.01 | Good |
| A115 | 0.05 | 0.01 | Good |
| A116 | 0.05 | 0.01 | Good |
| A117 | 0.05 | 0.01 | Good |
| A118 | 0.05 | 0.01 | Good |
| A119 | 0.05 | 0.01 | Good |

TABLE 9

| | PRODUCTION CONDITIONS | | | | | | | | | | | | |
|---|---|---|---|---|---|---|---|---|---|---|---|---|---|
| | | | | | | | | | | | DECARBURIZATION ANNEALING PROCESS HEATING STAGE AVERAGE HEATING RATE | | |
| | HOT ROLLING PROCESS CHEMICAL COMPOSITION OF SILICON STEEL SLAB (STEEL PIECE) (UNIT: mass %, BALANCE CONSISTING OF Fe AND IMPURITIES) | | | | | | | | | | TEMPERATURE RANGE OF 500 TO 600° C. S1 | TEMPERATURE RANGE OF 600 TO 700° C. S2 | HEATING RATE CONTROL S1 < S2 |
| TEST No. | Si | Mn | C | ACID-SOLUBLE Al | N | S | Bi | Sn | Cr | Cu | ° C./sec | ° C./sec | — |
| A120 | 3.25 | 0.085 | 0.060 | 0.025 | 0.008 | 0.028 | 0.002 | — | — | 0.08 | 700 | 1100 | Good |
| A121 | 3.25 | 0.091 | 0.052 | 0.022 | 0.005 | 0.038 | — | 0.14 | 0.02 | — | 700 | 1100 | Good |
| A122 | 3.25 | 0.092 | 0.052 | 0.031 | 0.009 | 0.039 | — | 0.02 | 0.12 | 0.03 | 700 | 1100 | Good |
| A123 | 3.35 | 0.078 | 0.056 | 0.046 | 0.006 | 0.032 | — | 0.33 | — | 0.11 | 700 | 1100 | Good |
| A124 | 3.36 | 0.065 | 0.042 | 0.042 | 0.009 | 0.011 | 0.001 | — | 0.37 | — | 700 | 1100 | Good |
| A125 | 3.39 | 0.092 | 0.041 | 0.048 | 0.005 | 0.017 | 0.007 | 0.28 | 0.035 | — | 700 | 1100 | Good |
| B34 | 3.23 | 0.060 | 0.007 | 0.023 | 0.008 | 0.013 | — | — | — | — | 700 | 1100 | Good |
| B35 | 3.25 | 0.040 | 0.215 | 0.031 | 0.007 | 0.017 | — | — | — | — | 700 | 1100 | Good |
| B36 | 2.45 | 0.060 | 0.042 | 0.045 | 0.007 | 0.015 | — | — | — | — | 700 | 1100 | Good |
| B37 | 3.20 | 0.080 | 0.056 | 0.008 | 0.006 | 0.008 | — | — | — | — | 700 | 1100 | Good |
| B38 | 3.12 | 0.050 | 0.062 | 0.077 | 0.008 | 0.052 | — | — | — | — | 700 | 1100 | Good |
| B39 | 3.20 | 0.480 | 0.055 | 0.022 | 0.025 | 0.045 | — | — | — | — | 700 | 1100 | Good |
| B40 | 3.31 | 0.009 | 0.031 | 0.045 | 0.008 | 0.066 | — | — | — | — | 700 | 1100 | Good |
| B41 | 3.36 | 0.520 | 0.078 | 0.032 | 0.007 | 0.024 | — | — | — | — | 700 | 1100 | Good |
| B42 | 3.34 | 0.440 | 0.062 | 0.020 | 0.008 | 0.004 | — | — | — | — | 700 | 1100 | Good |
| A126 | 2.73 | 0.010 | 0.015 | 0.019 | 0.019 | 0.009 | — | — | — | — | 900 | 1000 | Good |
| A127 | 2.95 | 0.310 | 0.045 | 0.025 | 0.007 | 0.023 | — | — | — | — | 310 | 2500 | Good |
| A128 | 3.90 | 0.490 | 0.039 | 0.047 | 0.009 | 0.039 | — | — | — | — | 310 | 350 | Good |
| A129 | 2.51 | 0.495 | 0.041 | 0.044 | 0.011 | 0.040 | — | — | — | — | 310 | 2500 | Good |

| | PRODUCTION CONDITIONS DECARBURIZATION ANNEALING PROCESS HEATING STAGE OXIDATION DEGREE | | |
|---|---|---|---|
| | TEMPERATURE RANGE OF 500 TO 600° C. | TEMPERATURE RANGE OF 600 TO 700° C. | OXIDATION DEGREE CONTROL P1 > P2 |
| TEST No. | P1 — | P2 — | — |
| A120 | 0.05 | 0.01 | Good |
| A121 | 0.05 | 0.01 | Good |
| A122 | 0.05 | 0.01 | Good |
| A123 | 0.05 | 0.01 | Good |
| A124 | 0.05 | 0.01 | Good |
| A125 | 0.05 | 0.01 | Good |
| B34 | 0.05 | 0.01 | Good |
| B35 | 0.05 | 0.01 | Good |
| B36 | 0.05 | 0.01 | Good |
| B37 | 0.05 | 0.01 | Good |
| B38 | 0.05 | 0.01 | Good |
| B39 | 0.05 | 0.01 | Good |
| B40 | 0.05 | 0.01 | Good |
| B41 | 0.05 | 0.01 | Good |
| B42 | 0.05 | 0.01 | Good |
| A126 | 0.3 | 0.3 | — |
| A127 | 0.0001 | 0.0001 | — |
| A128 | 0.4 | 0.4 | — |
| A129 | 0.0001 | 0.0001 | — |

TABLE 10

| | PRODUCTION CONDITIONS | | | | | | | | | | | | |
|---|---|---|---|---|---|---|---|---|---|---|---|---|---|
| | HOT ROLLING PROCESS CHEMICAL COMPOSITION OF SILICON STEEL SLAB (STEEL PIECE) (UNIT: mass %, BALANCE CONSISTING OF Fe AND IMPURITIES) | | | | | | | | | | DECARBURIZATION ANNEALING PROCESS HEATING STAGE AVERAGE HEATING RATE | | |
| | | | | | | | | | | | TEMPERATURE RANGE OF 500 TO 600° C. | TEMPERATURE RANGE OF 600 TO 700° C. | HEATING RATE CONTROL |
| TEST No. | Si | Mn | C | ACID-SOLUBLE Al | N | S | Bi | Sn | Cr | Cu | S1 ° C./sec | S2 ° C./sec | S1 < S2 — |
| A130 | 2.78 | 0.080 | 0.051 | 0.031 | 0.005 | 0.010 | — | — | — | — | 1800 | 2700 | Good |
| A131 | 2.90 | 0.450 | 0.187 | 0.061 | 0.018 | 0.045 | — | — | — | — | 800 | 1000 | Good |
| A132 | 2.90 | 0.450 | 0.187 | 0.061 | 0.018 | 0.045 | — | — | — | — | 800 | 1000 | Good |
| A133 | 3.25 | 0.051 | 0.072 | 0.025 | 0.009 | 0.022 | 0.001 | 0.11 | — | — | 500 | 1500 | Good |
| B43 | 2.90 | 0.450 | 0.187 | 0.061 | 0.018 | 0.045 | — | — | — | — | 800 | 800 | Bad |
| B44 | 2.68 | 0.001 | 0.013 | 0.021 | 0.017 | 0.010 | — | — | — | — | 900 | 1000 | Good |
| B45 | 3.10 | 0.050 | 0.220 | 0.029 | 0.011 | 0.022 | — | — | — | — | 800 | 1000 | Good |
| B46 | 3.07 | 0.045 | 0.055 | 0.081 | 0.012 | 0.045 | — | — | — | — | 800 | 1000 | Good |
| B47 | 3.15 | 0.055 | 0.048 | 0.018 | 0.031 | 0.045 | — | — | — | — | 800 | 1000 | Good |
| B48 | 2.95 | 0.065 | 0.050 | 0.018 | 0.009 | 0.018 | 0.021 | — | — | — | — | — | — |
| B49 | 3.10 | 0.053 | 0.049 | 0.022 | 0.015 | 0.040 | — | 0.53 | — | — | 800 | 1000 | Good |
| B50 | 3.02 | 0.045 | 0.045 | 0.020 | 0.012 | 0.035 | — | — | 0.51 | — | 800 | 1000 | Good |
| B51 | 3.07 | 0.043 | 0.039 | 0.017 | 0.017 | 0.040 | — | — | — | 1.05 | — | — | — |
| B52 | 3.08 | 0.038 | 0.046 | 0.026 | 0.010 | 0.035 | — | — | — | — | 800 | 1000 | Good |
| B53 | 3.10 | 0.045 | 0.030 | 0.038 | 0.011 | 0.044 | — | — | — | — | 800 | 1000 | Good |

| | PRODUCTION CONDITIONS DECARBURIZATION ANNEALING PROCESS HEATING STAGE OXIDATION DEGREE | | |
|---|---|---|---|
| | TEMPERATURE RANGE OF 500 TO 600° C. | TEMPERATURE RANGE OF 600 TO 700° C. | OXIDATION DEGREE CONTROL |
| TEST No. | P1 — | P2 — | P1 > P2 — |
| A130 | 0.0001 | 0.0001 | — |
| A131 | 0.1 | 0.1 | — |
| A132 | 0.1 | 0.05 | Good |
| A133 | 0.1 | 0.05 | Good |
| B43 | 0.1 | 0.05 | Good |
| B44 | 0.3 | 0.2 | Good |
| B45 | 0.1 | 0.05 | Good |
| B46 | 0.1 | 0.05 | Good |
| B47 | 0.1 | 0.05 | Good |
| B48 | — | — | — |
| B49 | 0.1 | 0.05 | Good |
| B50 | 0.1 | 0.05 | Good |
| B51 | — | — | — |
| B52 | 0.0005 | 0.000003 | Good |
| B53 | 0.48 | 0.51 | — |

TABLE 11

| | PRODUCTION CONDITIONS | | | | | | | |
|---|---|---|---|---|---|---|---|---|
| | DECARBURIZATION ANNEALING PROCESS | | | | | | | |
| | HOLDING STAGE | | | | | | | |
| | | | | | OXIDATION DEGREE | | | |
| | HOLDING TEMPERATURE | | HOLDING TIME | | | | | |
| TEST No. | FIRST ANNEALING TI ° C. | SECOND ANNEALING TII ° C. | FIRST ANNEALING tI sec | SECOND ANNEALING tII sec | FIRST ANNEALING PI — | SECOND ANNEALING PII — | OXIDATION DEGREE CONTROL PI > PII — | OVERALL OXIDATION DEGREE CONTROL |
| A1 | 820 | — | 160 | — | 0.5 | — | — | — |
| A2 | 820 | — | 160 | — | 0.5 | — | — | — |
| A3 | 820 | — | 160 | — | 0.5 | — | — | — |

TABLE 11-continued

| | | | | | | | | |
|---|---|---|---|---|---|---|---|---|
| A4 | 820 | — | 160 | — | 0.5 | — | — | — |
| A5 | 820 | — | 160 | — | 0.5 | — | — | — |
| A6 | 820 | — | 160 | — | 0.5 | — | — | — |
| A7 | 820 | — | 160 | — | 0.5 | — | — | — |
| A8 | 820 | — | 160 | — | 0.5 | — | — | — |
| A9 | 820 | — | 160 | — | 0.5 | — | — | — |
| A10 | 820 | — | 160 | — | 0.5 | — | — | — |
| A11 | 820 | — | 160 | — | 0.5 | — | — | — |
| A12 | 820 | — | 160 | — | 0.5 | — | — | — |
| A13 | 820 | — | 160 | — | 0.5 | — | — | — |
| A14 | 820 | — | 160 | — | 0.5 | — | — | — |
| A15 | 820 | — | 160 | — | 0.5 | — | — | — |
| A16 | 820 | — | 160 | — | 0.5 | — | — | — |
| A17 | 820 | — | 160 | — | 0.5 | — | — | — |
| A18 | 820 | — | 160 | — | 0.5 | — | — | — |
| A19 | 820 | — | 160 | — | 0.5 | — | — | — |

| | PRODUCTION CONDITIONS | | | | | | | |
|---|---|---|---|---|---|---|---|---|
| | | | INSULATION COATING FORMING PROCESS HEATING STAGE | | | | | |
| | | | AVERAGE HEATING RATE | | | OXIDATION DEGREE | | |
| | FINAL ANNEALING PROCESS | | TEMPERATURE RANGE OF | TEMPERATURE RANGE OF | HEATING | TEMPERATURE RANGE OF | TEMPERATURE RANGE OF | OXIDATION |
| TEST No. | FINAL ANNEALING TEMPERATURE ° C. | FINAL ANNEALING TIME hour | 600 TO 700° C. S3 ° C./sec | 700 TO 800° C. S4 ° C./sec | RATE CONTROL S3 > S4 — | 600 TO 700° C. P3 — | 700 TO 800° C. P4 — | DEGREE CONTROL P3 > P4 — |
| A1 | 1200 | 20 | 60 | 10 | Good | 1.2 | 1.2 | — |
| A2 | 1200 | 20 | 60 | 10 | Good | 1.2 | 1.2 | — |
| A3 | 1200 | 20 | 60 | 10 | Good | 1.2 | 1.2 | — |
| A4 | 1200 | 20 | 60 | 10 | Good | 1.2 | 1.2 | — |
| A5 | 1200 | 20 | 60 | 10 | Good | 1.2 | 1.2 | — |
| A6 | 1200 | 20 | 60 | 10 | Good | 1.2 | 1.2 | — |
| A7 | 1200 | 20 | 60 | 10 | Good | 1.2 | 1.2 | — |
| A8 | 1200 | 20 | 60 | 10 | Good | 1.2 | 1.2 | — |
| A9 | 1200 | 20 | 60 | 10 | Good | 1.2 | 1.2 | — |
| A10 | 1200 | 20 | 60 | 10 | Good | 1.2 | 1.2 | — |
| A11 | 1200 | 20 | 60 | 10 | Good | 1.2 | 1.2 | — |
| A12 | 1200 | 20 | 60 | 10 | Good | 1.2 | 1.2 | — |
| A13 | 1200 | 20 | 60 | 10 | Good | 1.2 | 1.2 | — |
| A14 | 1200 | 20 | 60 | 10 | Good | 1.2 | 1.2 | — |
| A15 | 1200 | 20 | 60 | 10 | Good | 1.2 | 1.2 | — |
| A16 | 1200 | 20 | 60 | 10 | Good | 1.2 | 1.2 | — |
| A17 | 1200 | 20 | 60 | 10 | Good | 1.2 | 1.2 | — |
| A18 | 1200 | 20 | 60 | 10 | Good | 1.2 | 1.2 | — |
| A19 | 1200 | 20 | 60 | 10 | Good | 1.2 | 1.2 | — |

TABLE 12

| | PRODUCTION CONDITIONS | | | | | | | |
|---|---|---|---|---|---|---|---|---|
| | DECARBURIZATION ANNEALING PROCESS | | | | | | | |
| | HOLDING STAGE | | | | | | | |
| | | | | | OXIDATION DEGREE | | | |
| | HOLDING TEMPERATURE | | HOLDING TIME | | | | OXIDATION | |
| TEST No. | FIRST ANNEALING TI ° C. | SECOND ANNEALING TII ° C. | FIRST ANNEALING tI sec | SECOND ANNEALING tII sec | FIRST ANNEALING PI — | SECOND ANNEALING PII — | DEGREE CONTROL PI > PII — | OVERALL OXIDATION DEGREE CONTROL |
| A20 | 820 | — | 160 | — | 0.5 | — | — | — |
| A21 | 820 | — | 160 | — | 0.5 | — | — | — |
| A22 | 820 | — | 160 | — | 0.5 | — | — | — |
| A23 | 820 | — | 160 | — | 0.5 | — | — | — |
| A24 | 820 | — | 160 | — | 0.5 | — | — | — |
| A25 | 820 | — | 160 | — | 0.5 | — | — | — |
| A26 | 820 | — | 160 | — | 0.5 | — | — | — |
| A27 | 820 | — | 160 | — | 0.5 | — | — | — |

TABLE 12-continued

| | | | | | | | | |
|---|---|---|---|---|---|---|---|---|
| A28 | 820 | — | 160 | — | 0.5 | — | — | — |
| A29 | 820 | — | 160 | — | 0.5 | — | — | — |
| A30 | 820 | — | 160 | — | 0.5 | — | — | — |
| B1 | 820 | — | 160 | — | 0.5 | — | — | — |
| B2 | 820 | — | 160 | — | 0.5 | — | — | — |
| B3 | 820 | — | 160 | — | 0.5 | — | — | — |
| B4 | — | — | — | — | — | — | — | — |
| B5 | 820 | — | 160 | — | 0.5 | — | — | — |
| B6 | 820 | — | 160 | — | 0.5 | — | — | — |
| B7 | 820 | — | 160 | — | 0.5 | — | — | — |
| B8 | 820 | — | 160 | — | 0.5 | — | — | — |

| | PRODUCTION CONDITIONS | | | | | | | |
|---|---|---|---|---|---|---|---|---|
| | | | INSULATION COATING FORMING PROCESS HEATING STAGE | | | | | |
| | | | AVERAGE HEATING RATE | | | OXIDATION DEGREE | | |
| | FINAL ANNEALING PROCESS | | TEMPERATURE RANGE OF | TEMPERATURE RANGE OF | HEATING | TEMPERATURE RANGE OF | TEMPERATURE RANGE OF | OXIDATION |
| TEST No. | FINAL ANNEALING TEMPERATURE ° C. | FINAL ANNEALING TIME hour | 600 TO 700° C. S3 ° C./sec | 700 TO 800° C. S4 ° C./sec | RATE CONTROL S3 > S4 — | 600 TO 700° C. P3 — | 700 TO 800° C. P4 — | DEGREE CONTROL P3 > P4 — |
| A20 | 1200 | 20 | 60 | 10 | Good | 1.2 | 1.2 | — |
| A21 | 1200 | 20 | 60 | 10 | Good | 1.2 | 1.2 | — |
| A22 | 1200 | 20 | 60 | 10 | Good | 1.2 | 1.2 | — |
| A23 | 1200 | 20 | 60 | 10 | Good | 2.0 | 1.5 | Good |
| A24 | 1200 | 20 | 60 | 10 | Good | 2.0 | 1.5 | Good |
| A25 | 1200 | 20 | 60 | 10 | Good | 2.0 | 1.5 | Good |
| A26 | 1200 | 20 | 60 | 10 | Good | 2.0 | 1.5 | Good |
| A27 | 1200 | 20 | 60 | 10 | Good | 2.0 | 1.5 | Good |
| A28 | 1200 | 20 | 60 | 10 | Good | 2.0 | 1.5 | Good |
| A29 | 1200 | 20 | 60 | 10 | Good | 2.0 | 1.5 | Good |
| A30 | 1200 | 20 | 60 | 10 | Good | 2.0 | 1.5 | Good |
| B1 | 1200 | _2 | 60 | 10 | Good | 1.2 | 1.2 | — |
| B2 | 1200 | _2 | 60 | 10 | Good | 1.2 | 1.2 | — |
| B3 | 1200 | 20 | 60 | 10 | Good | 1.2 | 1.2 | — |
| B4 | — | — | — | — | — | — | — | — |
| B5 | 1200 | _2 | 60 | 10 | Good | 1.2 | 1.2 | — |
| B6 | 1200 | _2 | 60 | 10 | Good | 1.2 | 1.2 | — |
| B7 | 1200 | _2 | 60 | 10 | Good | 1.2 | 1.2 | — |
| B8 | 1200 | _2 | 60 | 10 | Good | 1.2 | 1.2 | — |

TABLE 13

| | PRODUCTION CONDITIONS | | | | | | | |
|---|---|---|---|---|---|---|---|---|
| | DECARBURIZATION ANNEALING PROCESS | | | | | | | |
| | HOLDING STAGE | | | | | | | |
| | | | | | OXIDATION DEGREE | | | |
| | HOLDING TEMPERATURE | | HOLDING TIME | | | | OXIDATION | |
| TEST No. | FIRST ANNEALING TI ° C. | SECOND ANNEALING TII ° C. | FIRST ANNEALING tI sec | SECOND ANNEALING tII sec | FIRST ANNEALING PI — | SECOND ANNEALING PII — | DEGREE CONTROL PI > PII — | OVERALL OXIDATION DEGREE CONTROL |
| B9 | 820 | — | 160 | — | 0.5 | — | — | — |
| B10 | 820 | — | 160 | — | 0.5 | — | — | — |
| B11 | — | — | — | — | — | — | — | — |
| B12 | 830 | — | 150 | — | 0.4 | — | — | — |
| B13 | 830 | — | 150 | — | 0.4 | — | — | — |
| B14 | 830 | — | 150 | — | 0.4 | — | — | — |
| B15 | 830 | — | 150 | — | 0.4 | — | — | — |
| B16 | 830 | — | 150 | — | 0.4 | — | — | — |
| B17 | 830 | — | 150 | — | 0.4 | — | — | — |
| A31 | 830 | — | 150 | — | 0.4 | — | — | — |
| B18 | 830 | — | 150 | — | 0.4 | — | — | — |
| B19 | 830 | — | 150 | — | 0.4 | — | — | — |
| B20 | 830 | — | 150 | — | 0.4 | — | — | — |

TABLE 13-continued

| | | | | | | | | |
|---|---|---|---|---|---|---|---|---|
| B21 | 830 | — | 150 | — | 0.4 | — | — | — |
| B22 | 830 | — | 150 | — | 0.4 | — | — | — |
| A32 | 830 | — | 150 | — | 0.4 | — | — | — |
| A33 | 830 | — | 150 | — | 0.4 | — | — | — |
| B23 | 830 | — | 150 | — | 0.4 | — | — | — |
| B24 | 830 | — | 150 | — | 0.4 | — | — | — |

| | PRODUCTION CONDITIONS | | | | | | | |
|---|---|---|---|---|---|---|---|---|
| | | | INSULATION COATING FORMING PROCESS HEATING STAGE | | | | | |
| | | | AVERAGE HEATING RATE | | | OXIDATION DEGREE | | |
| | FINAL ANNEALING PROCESS | | TEMPERATURE RANGE OF | TEMPERATURE RANGE OF | HEATING | TEMPERATURE RANGE OF | TEMPERATURE RANGE OF | OXIDATION |
| TEST No. | FINAL ANNEALING TEMPERATURE ° C. | FINAL ANNEALING TIME hour | 600 TO 700° C. S3 ° C./sec | 700 TO 800° C. S4 ° C./sec | RATE CONTROL S3 > S4 — | 600 TO 700° C. P3 — | 700 TO 800° C. P4 — | DEGREE CONTROL P3 > P4 — |
| B9 | 1200 | 20 | 60 | 10 | Good | 1.2 | 1.2 | — |
| B10 | 1200 | 2 | 60 | 10 | Good | 1.2 | 1.2 | — |
| B11 | — | — | — | — | — | — | — | — |
| B12 | 1200 | 20 | 17 | 15 | Good | 1.2 | 1.2 | — |
| B13 | 1200 | 20 | 17 | 15 | Good | 1.2 | 1.2 | — |
| B14 | 1200 | 20 | 190 | 20 | Good | 1.2 | 1.2 | — |
| B15 | 1200 | 20 | 200 | 15 | Good | 1.2 | 1.2 | — |
| B16 | 1200 | 20 | 160 | 45 | Good | 1.2 | 1.2 | — |
| B17 | 1200 | 20 | 110 | 48 | Good | 1.2 | 1.2 | — |
| A31 | 1200 | 20 | 130 | 42 | Good | 1.2 | 1.2 | — |
| B18 | 1200 | 20 | 50 | 50 | Bad | 1.2 | 1.2 | — |
| B19 | 1200 | 20 | 200 | 5 | Good | 1.2 | 1.2 | — |
| B20 | 1200 | 20 | 11 | 7 | Good | 1.2 | 1.2 | — |
| B21 | 1200 | 20 | 180 | 95 | Good | 1.2 | 1.2 | — |
| B22 | 1200 | 20 | 32 | 17 | Good | 1.2 | 1.2 | — |
| A32 | 1200 | 20 | 24 | 14 | Good | 1.2 | 1.2 | — |
| A33 | 1200 | 20 | 29 | 19 | Good | 1.2 | 1.2 | — |
| B23 | 1200 | 20 | 29 | 15 | Good | 1.2 | 1.2 | — |
| B24 | 1200 | 20 | 31 | 22 | Good | 1.2 | 1.2 | — |

TABLE 14

| | PRODUCTION CONDITIONS | | | | | | | |
|---|---|---|---|---|---|---|---|---|
| | DECARBURIZATION ANNEALING PROCESS | | | | | | | |
| | HOLDING STAGE | | | | | | | |
| | | | | | OXIDATION DEGREE | | | |
| | HOLDING TEMPERATURE | | HOLDING TIME | | | | OXIDATION | |
| TEST No. | FIRST ANNEALING TI ° C. | SECOND ANNEALING TII ° C. | FIRST ANNEALING tI sec | SECOND ANNEALING tII sec | FIRST ANNEALING PI — | SECOND ANNEALING PII — | DEGREE CONTROL PI > PII — | OVERALL OXIDATION DEGREE CONTROL |
| B25 | 830 | — | 150 | — | 0.4 | — | — | — |
| A34 | 830 | — | 150 | — | 0.4 | — | — | — |
| A35 | 830 | — | 150 | — | 0.4 | — | — | — |
| A36 | 830 | — | 150 | — | 0.4 | — | — | — |
| A37 | 830 | — | 150 | — | 0.4 | — | — | — |
| A38 | 830 | — | 150 | — | 0.4 | — | — | — |
| A39 | 830 | — | 150 | — | 0.4 | — | — | — |
| A40 | 830 | — | 150 | — | 0.4 | — | — | — |
| A41 | 830 | — | 150 | — | 0.4 | — | — | — |
| A42 | 830 | — | 150 | — | 0.4 | — | — | — |
| A43 | 830 | — | 150 | — | 0.4 | — | — | — |
| A44 | 830 | — | 150 | — | 0.4 | — | — | — |
| A45 | 830 | — | 150 | — | 0.4 | — | — | — |
| A46 | 830 | — | 150 | — | 0.4 | — | — | — |
| A47 | 830 | — | 150 | — | 0.4 | — | — | — |
| A48 | 830 | — | 150 | — | 0.4 | — | — | — |

TABLE 14-continued

| | | | | | | | | |
|---|---|---|---|---|---|---|---|---|
| A49 | 830 | — | 150 | — | 0.4 | — | — | — |
| A50 | 830 | — | 150 | — | 0.4 | — | — | — |
| A51 | 830 | — | 150 | — | 0.4 | — | — | — |

| | PRODUCTION CONDITIONS | | | | | | | |
|---|---|---|---|---|---|---|---|---|
| | | | INSULATION COATING FORMING PROCESS HEATING STAGE | | | | | |
| | | | AVERAGE HEATING RATE | | | OXIDAT ON DEGREE | | |
| | FINAL ANNEALING PROCESS | | TEMPERATURE RANGE OF | TEMPERATURE RANGE OF | HEATING | TEMPERATURE RANGE OF | TEMPERATURE RANGE OF | OXIDATION |
| TEST No. | FINAL ANNEALING TEMPERATURE ° C. | FINAL ANNEALING TIME hour | 600 TO 700° C. S3 ° C./sec | 700 TO 800° C. S4 ° C./sec | RATE CONTROL S3 > S4 — | 600 TO 700° C. P3 — | 700 TO 800° C. P4 — | DEGREE CONTROL P3 > P4 — |
| B25 | 1200 | 20 | 180 | 78 | Good | 1.2 | 1.2 | — |
| A34 | 1200 | 20 | 160 | 92 | Good | 2.0 | 1.5 | Good |
| A35 | 1200 | 20 | 120 | 56 | Good | 2.0 | 1.5 | Good |
| A36 | 1200 | 20 | 189 | 72 | Good | 2.0 | 1.5 | Good |
| A37 | 1200 | 20 | 150 | 78 | Good | 2.0 | 1.5 | Good |
| A38 | 1200 | 20 | 180 | 65 | Good | 2.0 | 1.5 | Good |
| A39 | 1200 | 20 | 190 | 90 | Good | 2.0 | 1.5 | Good |
| A40 | 1200 | 20 | 60 | 10 | Good | 2.0 | 1.5 | Good |
| A41 | 1200 | 20 | 55 | 15 | Good | 2.0 | 1.5 | Good |
| A42 | 1200 | 20 | 68 | 29 | Good | 2.0 | 1.5 | Good |
| A43 | 1200 | 20 | 60 | 10 | Good | 2.0 | 1.5 | Good |
| A44 | 1200 | 20 | 62 | 13 | Good | 2.0 | 1.5 | Good |
| A45 | 1200 | 20 | 58 | 30 | Good | 2.0 | 1.5 | Good |
| A46 | 1200 | 20 | 60 | 10 | Good | 2.0 | 1.5 | Good |
| A47 | 1200 | 20 | 70 | 14 | Good | 2.0 | 1.5 | Good |
| A48 | 1200 | 20 | 55 | 28 | Good | 2.0 | 1.5 | Good |
| A49 | 1200 | 20 | 180 | 40 | Good | 2.0 | 1.5 | Good |
| A50 | 1200 | 20 | 175 | 40 | Good | 2.0 | 1.5 | Good |
| A51 | 1200 | 20 | 192 | 11 | Good | 2.0 | 1.5 | Good |

TABLE 15

| | PRODUCTION CONDITIONS DECARBURIZATION ANNEALING PROCESS | | | | | | | |
|---|---|---|---|---|---|---|---|---|
| | HOLDING STAGE | | | | | | | |
| | | | | | OXIDATION DEGREE | | | |
| | HOLDING TEMPERATURE | | HOLDING TIME | | | | OXIDATION | OVERALL |
| TEST No. | FIRST ANNEALING TI ° C. | SECOND ANNEALING TII ° C. | FIRST ANNEALING tI sec | SECOND ANNEALING tII sec | FIRST ANNEALING PI — | SECOND ANNEALING PII — | DEGREE CONTROL PI > PII — | OXIDATION DEGREE CONTROL — |
| A52 | 830 | — | 150 | — | 0.4 | — | — | — |
| A53 | 830 | — | 150 | — | 0.4 | — | — | — |
| A54 | 830 | — | 150 | — | 0.4 | — | — | — |
| A55 | 830 | — | 150 | — | 0.4 | — | — | — |
| A56 | 830 | — | 150 | — | 0.4 | — | — | — |
| B26 | 830 | — | 150 | — | 0.4 | — | — | — |
| B27 | 830 | — | 150 | — | 0.4 | — | — | — |
| B28 | 830 | — | 150 | — | 0.4 | — | — | — |
| B29 | 830 | — | 150 | — | 0.4 | — | — | — |
| B30 | 830 | — | 150 | — | 0.4 | — | — | — |
| B31 | 830 | — | 150 | — | 0.4 | — | — | — |
| B32 | 830 | — | 150 | — | 0.4 | — | — | — |
| B33 | 830 | — | 150 | — | 0.4 | — | — | — |
| A57 | 715 | 800 | 38 | 7 | 0.86 | 0.73 | Good | Good |
| A58 | 895 | 965 | 36 | 8 | 0.93 | 0.68 | Good | Good |
| A59 | 772 | 857 | 12 | 8 | 0.86 | 0.61 | Good | Good |
| A60 | 883 | 958 | 995 | 7 | 0.89 | 0.52 | Good | Good |
| A61 | 872 | 952 | 324 | 7 | 0.12 | 0.11 | Good | Good |
| A62 | 771 | 854 | 318 | 8 | 0.96 | 0.51 | Good | Good |

TABLE 15-continued

| | PRODUCTION CONDITIONS | | | | | | | |
|---|---|---|---|---|---|---|---|---|
| | | | INSULATION COATING FORMING PROCESS HEATING STAGE | | | | | |
| | | | AVERAGE HEATING RATE | | | OXIDATION DEGREE | | |
| | FINAL ANNEALING PROCESS | | TEMPERATURE RANGE OF | TEMPERATURE RANGE OF | HEATING | TEMPERATURE RANGE OF | TEMPERATURE RANGE OF | OXIDATION |
| TEST No. | FINAL ANNEALING TEMPERATURE ° C. | FINAL ANNEALING TIME hour | 600 TO 700° C. S3 ° C./sec | 700 TO 800° C. S4 ° C./sec | RATE CONTROL S3 > S4 — | 600 TO 700° C. P3 — | 700 TO 800° C. P4 — | DEGREE CONTROL P3 > P4 — |
| A52 | 1200 | 20 | 185 | 15 | Good | 2.0 | 1.5 | Good |
| A53 | 1200 | 20 | 190 | 15 | Good | 2.0 | 1.5 | Good |
| A54 | 1200 | 20 | 195 | 14 | Good | 2.0 | 1.5 | Good |
| A55 | 1200 | 20 | 188 | 15 | Good | 2.0 | 1.5 | Good |
| A56 | 1200 | 20 | 190 | 10 | Good | 2.0 | 1.5 | Good |
| B26 | 1200 | 20 | 180 | 71 | Good | 1.2 | 1.2 | — |
| B27 | 1200 | 20 | 190 | 65 | Good | 1.2 | 1.2 | — |
| B28 | 1200 | 20 | 45 | 15 | Good | 1.2 | 1.2 | — |
| B29 | 1200 | 20 | 56 | 18 | Good | 1.2 | 1.2 | — |
| B30 | 1200 | 20 | 28 | 19 | Good | 1.2 | 1.2 | — |
| B31 | 1200 | 20 | 80 | 85 | Bad | 1.2 | 1.2 | — |
| B32 | 1200 | 20 | 9 | 6 | Good | 1.2 | 1.2 | — |
| B33 | 1200 | 20 | 150 | 102 | Good | 1.2 | 1.2 | — |
| A57 | 1200 | 20 | 22 | 20 | Good | 1.2 | 1.2 | — |
| A58 | 1200 | 20 | 22 | 20 | Good | 1.2 | 1.2 | — |
| A59 | 1200 | 20 | 22 | 20 | Good | 1.2 | 1.2 | — |
| A60 | 1200 | 20 | 22 | 20 | Good | 1.2 | 1.2 | — |
| A61 | 1200 | 20 | 22 | 20 | Good | 1.2 | 1.2 | — |
| A62 | 1200 | 20 | 22 | 20 | Good | 1.2 | 1.2 | — |

TABLE 16

| | PRODUCTION CONDITIONS DECARBURIZATION ANNEALING PROCESS | | | | | | | |
|---|---|---|---|---|---|---|---|---|
| | HOLDING STAGE | | | | | | | |
| | | | | | OXIDATION DEGREE | | | |
| | HOLDING TEMPERATURE | | HOLDING TIME | | | | OXIDATION | OVERALL |
| TEST No. | FIRST ANNEALING TI ° C. | SECOND ANNEALING TII ° C. | FIRST ANNEALING tI sec | SECOND ANNEALING tII sec | FIRST ANNEALING PI — | SECOND ANNEALING PII — | DEGREE CONTROL PI > PII — | OXIDATION DEGREE CONTROL — |
| A63 | 772 | 824 | 335 | 140 | 0.81 | 0.55 | Good | Good |
| A64 | 773 | 843 | 342 | 5 | 0.16 | 0.13 | Good | Good |
| A65 | 879 | 950 | 338 | 490 | 0.18 | 0.15 | Good | Good |
| A66 | 864 | 947 | 336 | 120 | 0.15 | 0.14 | Good | Good |
| A67 | 785 | 860 | 37 | 7 | 0.17 | 0.11 | Good | Good |
| A68 | 843 | 913 | 347 | 140 | 0.84 | 0.53 | Good | Good |
| A69 | 767 | 850 | 52 | 230 | 0.91 | 0.55 | Good | Good |
| A70 | 864 | 932 | 293 | 7 | 0.82 | 0.65 | Good | Good |
| A71 | 744 | 823 | 32 | 8 | 0.20 | 0.16 | Good | Good |
| A72 | 869 | 939 | 310 | 180 | 0.79 | 0.30 | Good | Good |
| A73 | 862 | 967 | 37 | 7 | 0.17 | 0.15 | Good | Good |
| A74 | 871 | 993 | 353 | 165 | 0.87 | 0.55 | Good | Good |
| A75 | 864 | 948 | 44 | 12 | 0.18 | 0.11 | Good | Good |
| A76 | 883 | 955 | 345 | 98 | 0.89 | 0.12 | Good | Good |
| A77 | 872 | 938 | 42 | 7 | 0.15 | 0.00003 | Good | Good |
| A78 | 762 | 845 | 315 | 240 | 0.09 | 0.08 | Good | Good |
| A79 | 820 | 925 | 180 | 25 | 0.59 | 0.006 | Good | Good |
| A80 | 820 | 920 | 150 | 30 | 0.22 | 0.005 | Good | Good |
| A81 | 840 | 940 | 120 | 25 | 0.75 | 0.003 | Good | Good |

TABLE 16-continued

| | PRODUCTION CONDITIONS | | | | | | | |
|---|---|---|---|---|---|---|---|---|
| | | | INSULATION COATING FORMING PROCESS HEATING STAGE | | | | | |
| | | | AVERAGE HEATING RATE | | | OXIDATION DEGREE | | |
| | FINAL ANNEALING PROCESS | | TEMPERATURE RANGE OF | TEMPERATURE RANGE OF | HEATING | TEMPERATURE RANGE OF | TEMPERATURE RANGE OF | OXIDATION |
| TEST No. | FINAL ANNEALING TEMPERATURE ° C. | FINAL ANNEALING TIME hour | 600 TO 700° C. S3 ° C./sec | 700 TO 800° C. S4 ° C./sec | RATE CONTROL S3 > S4 — | 600 TO 700° C. P3 — | 700 TO 800° C. P4 — | DEGREE CONTROL P3 > P4 — |
| A63 | 1200 | 20 | 22 | 20 | Good | 1.2 | 1.2 | — |
| A64 | 1200 | 20 | 22 | 20 | Good | 1.2 | 1.2 | — |
| A65 | 1200 | 20 | 22 | 20 | Good | 2.0 | 1.5 | Good |
| A66 | 1200 | 20 | 22 | 20 | Good | 2.0 | 1.5 | Good |
| A67 | 1200 | 20 | 22 | 20 | Good | 2.0 | 1.5 | Good |
| A68 | 1200 | 20 | 22 | 20 | Good | 2.0 | 1.5 | Good |
| A69 | 1200 | 20 | 22 | 20 | Good | 2.0 | 1.5 | Good |
| A70 | 1200 | 20 | 22 | 20 | Good | 2.0 | 1.5 | Good |
| A71 | 1200 | 20 | 22 | 20 | Good | 2.0 | 1.5 | Good |
| A72 | 1200 | 20 | 22 | 20 | Good | 2.0 | 1.5 | Good |
| A73 | 1200 | 20 | 22 | 20 | Good | 2.0 | 1.5 | Good |
| A74 | 1200 | 20 | 22 | 20 | Good | 2.0 | 1.5 | Good |
| A75 | 1200 | 20 | 22 | 20 | Good | 2.0 | 1.5 | Good |
| A76 | 1200 | 20 | 22 | 20 | Good | 2.0 | 1.5 | Good |
| A77 | 1200 | 20 | 22 | 20 | Good | 2.0 | 1.5 | Good |
| A78 | 1200 | 20 | 22 | 20 | Good | 2.0 | 1.5 | Good |
| A79 | 1200 | 20 | 70 | 10 | Good | 2.0 | 1.5 | Good |
| A80 | 1200 | 20 | 70 | 10 | Good | 2.0 | 1.5 | Good |
| A81 | 1200 | 20 | 70 | 10 | Good | 2.0 | 1.5 | Good |

TABLE 17

| | PRODUCTION CONDITIONS DECARBURIZATION ANNEALING PROCESS | | | | | | | |
|---|---|---|---|---|---|---|---|---|
| | HOLDING STAGE | | | | | | | |
| | | | | | OXIDATION DEGREE | | | |
| | HOLDING TEMPERATURE | | HOLDING TIME | | | | OXIDATION | OVERALL |
| TEST No. | FIRST ANNEALING TI ° C. | SECOND ANNEALING TII ° C. | FIRST ANNEALING tI sec | SECOND ANNEALING tII sec | FIRST ANNEALING PI — | SECOND ANNEALING PII — | DEGREE CONTROL PI > PII — | OXIDATION DEGREE CONTROL — |
| A82 | 830 | 930 | 140 | 40 | 0.78 | 0.008 | Good | Good |
| A83 | 835 | 935 | 160 | 20 | 0.43 | 0.002 | Good | Good |
| A84 | 840 | 940 | 150 | 30 | 0.55 | 0.004 | Good | Good |
| A85 | 830 | 940 | 120 | 15 | 0.67 | 0.008 | Good | Good |
| A86 | 825 | 975 | 140 | 20 | 0.71 | 0.006 | Good | Good |
| A87 | 800 | 920 | 65 | 13 | 0.24 | 0.05 | Good | Good |
| A88 | 810 | 930 | 275 | 25 | 0.59 | 0.02 | Good | Good |
| A89 | 820 | 940 | 72 | 50 | 0.45 | 0.05 | Good | Good |
| A90 | 843 | 950 | 288 | 75 | 0.33 | 0.03 | Good | Good |
| A91 | 849 | 950 | 292 | 90 | 0.78 | 0.05 | Good | Good |
| A92 | 851 | 960 | 65 | 72 | 0.49 | 0.15 | Good | Good |
| A93 | 845 | 950 | 150 | 83 | 0.51 | 0.23 | Good | Good |
| A94 | 800 | 920 | 172 | 33 | 0.63 | 0.24 | Good | Good |
| A95 | 823 | 980 | 180 | 20 | 0.65 | 0.35 | Good | Good |
| A96 | 820 | — | 130 | — | 0.5 | — | — | — |
| A97 | 820 | — | 130 | — | 0.5 | — | — | — |
| A98 | 820 | — | 130 | — | 0.5 | — | — | — |
| A99 | 820 | — | 130 | — | 0.5 | — | — | — |
| A100 | 820 | — | 130 | — | 0.5 | — | — | — |

TABLE 17-continued

| | PRODUCTION CONDITIONS | | | | | | | |
|---|---|---|---|---|---|---|---|---|
| | | | INSULATION COATING FORMING PROCESS HEATING STAGE | | | | | |
| | | | AVERAGE HEATING RATE | | | OXIDATION DEGREE | | |
| | FINAL ANNEALING PROCESS | | TEMPERATURE RANGE OF | TEMPERATURE RANGE OF | HEATING | TEMPERATURE RANGE OF | TEMPERATURE RANGE OF | OXIDATION |
| TEST No. | FINAL ANNEALING TEMPERATURE ° C. | FINAL ANNEALING TIME hour | 600 TO 700° C. S3 ° C./sec | 700 TO 800° C. S4 ° C./sec | RATE CONTROL S3 > S4 — | 600 TO 700° C. P3 — | 700 TO 800° C. P4 — | DEGREE CONTROL P3 > P4 — |
| A82 | 1200 | 20 | 70 | 10 | Good | 2.0 | 1.5 | Good |
| A83 | 1200 | 20 | 70 | 10 | Good | 2.0 | 1.5 | Good |
| A84 | 1200 | 20 | 70 | 10 | Good | 2.0 | 1.5 | Good |
| A85 | 1200 | 20 | 70 | 10 | Good | 2.0 | 1.5 | Good |
| A86 | 1200 | 20 | 70 | 10 | Good | 2.0 | 1.5 | Good |
| A87 | 1200 | 20 | 70 | 10 | Good | 2.0 | 1.5 | Good |
| A88 | 1200 | 20 | 70 | 10 | Good | 2.0 | 1.5 | Good |
| A89 | 1200 | 20 | 70 | 10 | Good | 2.0 | 1.5 | Good |
| A90 | 1200 | 20 | 70 | 10 | Good | 2.0 | 1.5 | Good |
| A91 | 1200 | 20 | 70 | 10 | Good | 2.0 | 1.5 | Good |
| A92 | 1200 | 20 | 70 | 10 | Good | 2.0 | 1.5 | Good |
| A93 | 1200 | 20 | 70 | 10 | Good | 2.0 | 1.5 | Good |
| A94 | 1200 | 20 | 70 | 10 | Good | 2.0 | 1.5 | Good |
| A95 | 1200 | 20 | 70 | 10 | Good | 2.0 | 1.5 | Good |
| A96 | 1200 | 20 | 65 | 30 | Good | 1.2 | 1.2 | — |
| A97 | 1200 | 20 | 65 | 30 | Good | 1.2 | 1.2 | — |
| A98 | 1200 | 20 | 65 | 30 | Good | 1.2 | 1.2 | — |
| A99 | 1200 | 20 | 65 | 30 | Good | 1.2 | 1.2 | — |
| A100 | 1200 | 20 | 65 | 30 | Good | 1.2 | 1.2 | — |

TABLE 18

| | PRODUCTION CONDITIONS DECARBURIZATION ANNEALING PROCESS | | | | | | | |
|---|---|---|---|---|---|---|---|---|
| | HOLDING STAGE | | | | | | | |
| | | | | | OXIDATION DEGREE | | | |
| | HOLDING TEMPERATURE | | HOLDING TIME | | | | OXIDATION | OVERALL |
| TEST No. | FIRST ANNEALING TI ° C. | SECOND ANNEALING TII ° C. | FIRST ANNEALING tI sec | SECOND ANNEALING tII sec | FIRST ANNEALING PI — | SECOND ANNEALING PII — | DEGREE CONTROL PI > PII — | OXIDATION DEGREE CONTROL — |
| A101 | 820 | — | 130 | — | 0.5 | — | — | — |
| A102 | 820 | — | 130 | — | 0.5 | — | — | — |
| A103 | 820 | — | 130 | — | 0.5 | — | — | — |
| A104 | 820 | — | 130 | — | 0.5 | — | — | — |
| A105 | 820 | — | 130 | — | 0.5 | — | — | — |
| A106 | 820 | — | 130 | — | 0.5 | — | — | — |
| A107 | 820 | — | 130 | — | 0.5 | — | — | — |
| A108 | 820 | — | 130 | — | 0.5 | — | — | — |
| A109 | 820 | — | 130 | — | 0.5 | — | — | — |
| A110 | 820 | — | 130 | — | 0.5 | — | — | — |
| A111 | 820 | — | 130 | — | 0.5 | — | — | — |
| A112 | 820 | — | 130 | — | 0.5 | — | — | — |
| A113 | 820 | — | 130 | — | 0.5 | — | — | — |
| A114 | 820 | — | 130 | — | 0.5 | — | — | — |
| A115 | 820 | — | 130 | — | 0.5 | — | — | — |
| A116 | 820 | — | 130 | — | 0.5 | — | — | — |
| A117 | 820 | — | 130 | — | 0.5 | — | — | — |
| A118 | 820 | — | 130 | — | 0.5 | — | — | — |
| A119 | 820 | — | 130 | — | 0.5 | — | — | — |

TABLE 18-continued

| | PRODUCTION CONDITIONS | | | | | | | |
|---|---|---|---|---|---|---|---|---|
| | | | INSULATION COATING FORMING PROCESS HEATING STAGE | | | | | |
| | | | AVERAGE HEATING RATE | | | OXIDATION DEGREE | | |
| | FINAL ANNEALING PROCESS | | TEMPERATURE RANGE OF | TEMPERATURE RANGE OF | HEATING | TEMPERATURE RANGE OF | TEMPERATURE RANGE OF | OXIDATION |
| TEST No. | FINAL ANNEALING TEMPERATURE ° C. | FINAL ANNEALING TIME hour | 600 TO 700° C. S3 ° C./sec | 700 TO 800° C. S4 ° C./sec | RATE CONTROL S3 > S4 — | 600 TO 700° P3 — | 700 TO 800° P4 — | DEGREE CONTROL P3 > P4 — |
| A101 | 1200 | 20 | 65 | 30 | Good | 1.2 | 1.2 | — |
| A102 | 1200 | 20 | 65 | 30 | Good | 1.2 | 1.2 | — |
| A103 | 1200 | 20 | 65 | 30 | Good | 1.2 | 1.2 | — |
| A104 | 1200 | 20 | 65 | 30 | Good | 1.2 | 1.2 | — |
| A105 | 1200 | 20 | 65 | 30 | Good | 1.2 | 1.2 | — |
| A106 | 1200 | 20 | 65 | 30 | Good | 1.2 | 1.2 | — |
| A107 | 1200 | 20 | 65 | 30 | Good | 1.2 | 1.2 | — |
| A108 | 1200 | 20 | 65 | 30 | Good | 1.2 | 1.2 | — |
| A109 | 1200 | 20 | 65 | 30 | Good | 1.2 | 1.2 | — |
| A110 | 1200 | 20 | 65 | 30 | Good | 1.2 | 1.2 | — |
| A111 | 1200 | 20 | 65 | 30 | Good | 1.2 | 1.2 | — |
| A112 | 1200 | 20 | 65 | 30 | Good | 1.2 | 1.2 | — |
| A113 | 1200 | 20 | 65 | 30 | Good | 1.2 | 1.2 | — |
| A114 | 1200 | 20 | 65 | 30 | Good | 1.2 | 1.2 | — |
| A115 | 1200 | 20 | 65 | 30 | Good | 1.2 | 1.2 | — |
| A116 | 1200 | 20 | 65 | 30 | Good | 1.2 | 1.2 | — |
| A117 | 1200 | 20 | 65 | 30 | Good | 1.2 | 1.2 | — |
| A118 | 1200 | 20 | 65 | 30 | Good | 2.0 | 1.5 | Good |
| A119 | 1200 | 20 | 65 | 30 | Good | 2.0 | 1.5 | Good |

TABLE 19

| | PRODUCTION CONDITIONS DECARBURIZATION ANNEALING PROCESS | | | | | | | |
|---|---|---|---|---|---|---|---|---|
| | HOLDING STAGE | | | | | | | |
| | | | | | OXIDATION DEGREE | | | |
| | HOLDING TEMPERATURE | | HOLDING TIME | | | | OXIDATION | OVERALL |
| TEST No. | FIRST ANNEALING TI ° C. | SECOND ANNEALING TII ° C. | FIRST ANNEALING tI sec | SECOND ANNEALING tII sec | FIRST ANNEALING PI — | SECOND ANNEALING PII — | DEGREE CONTROL PI > PII — | OXIDATION DEGREE CONTROL — |
| A120 | 820 | — | 130 | — | 0.5 | — | — | — |
| A121 | 820 | — | 130 | — | 0.5 | — | — | — |
| A122 | 820 | — | 130 | — | 0.5 | — | — | — |
| A123 | 820 | — | 130 | — | 0.5 | — | — | — |
| A124 | 820 | — | 130 | — | 0.5 | — | — | — |
| A125 | 820 | — | 130 | — | 0.5 | — | — | — |
| B34 | 820 | — | 130 | — | 0.5 | — | — | — |
| B35 | 820 | — | 130 | — | 0.5 | — | — | — |
| B36 | 820 | — | 130 | — | 0.5 | — | — | — |
| B37 | 820 | — | 130 | — | 0.5 | — | — | — |
| B38 | 820 | — | 130 | — | 0.5 | — | — | — |
| B39 | 820 | — | 130 | — | 0.5 | — | — | — |
| B40 | 820 | — | 130 | — | 0.5 | — | — | — |
| B41 | 820 | — | 130 | — | 0.5 | — | — | — |
| B42 | 820 | — | 130 | — | 0.5 | — | — | — |
| A126 | 820 | — | 160 | — | 0.5 | — | — | — |
| A127 | 720 | 780 | 15 | 8 | 0.1 | 0.00005 | Good | — |
| A128 | 880 | 990 | 800 | 450 | 0.9 | 0.1 | Good | — |
| A129 | 720 | 780 | 15 | 8 | 0.1 | 0.00005 | Good | — |

TABLE 19-continued

| | PRODUCTION CONDITIONS | | | | | | | |
|---|---|---|---|---|---|---|---|---|
| | | | INSULATION COATING FORMING PROCESS HEATING STAGE | | | | | |
| | | | AVERAGE HEATING RATE | | | OXIDATION DEGREE | | |
| | FINAL ANNEALING PROCESS | | TEMPERATURE RANGE OF | TEMPERATURE RANGE OF | HEATING | TEMPERATURE RANGE OF | TEMPERATURE RANGE OF | OXIDATION |
| TEST No. | FINAL ANNEALING TEMPERATURE ° C. | FINAL ANNEALING TIME hour | 600 TO 700° C. S3 ° C./sec | 700 TO 800° C. S4 ° C./sec | RATE CONTROL S3 > S4 — | 600 TO 700° C. P3 — | 700 TO 800° C. P4 — | DEGREE CONTROL P3 > P4 — |
| A120 | 1200 | 20 | 65 | 30 | Good | 2.0 | 1.5 | Good |
| A121 | 1200 | 20 | 65 | 30 | Good | 2.0 | 1.5 | Good |
| A122 | 1200 | 20 | 65 | 30 | Good | 2.0 | 1.5 | Good |
| A123 | 1200 | 20 | 65 | 30 | Good | 2.0 | 1.5 | Good |
| A124 | 1200 | 20 | 65 | 30 | Good | 2.0 | 1.5 | Good |
| A125 | 1200 | 20 | 65 | 30 | Good | 2.0 | 1.5 | Good |
| B34 | 1200 | 2 | 65 | 30 | Good | 1.2 | 1.2 | — |
| B35 | 1200 | 2 | 65 | 30 | Good | 1.2 | 1.2 | — |
| B36 | 1200 | 20 | 65 | 30 | Good | 1.2 | 1.2 | — |
| B37 | 1200 | 2 | 65 | 30 | Good | 1.2 | 1.2 | — |
| B38 | 1200 | 2 | 65 | 30 | Good | 1.2 | 1.2 | — |
| B39 | 1200 | 2 | 65 | 30 | Good | 1.2 | 1.2 | — |
| B40 | 1200 | 2 | 65 | 30 | Good | 1.2 | 1.2 | — |
| B41 | 1200 | 20 | 65 | 30 | Good | 1.2 | 1.2 | — |
| B42 | 1200 | 2 | 65 | 30 | Good | 1.2 | 1.2 | — |
| A126 | 1200 | 20 | 100 | 20 | Good | 1.2 | 1.2 | — |
| A127 | 1200 | 20 | 190 | 100 | Good | 0.2 | 0.2 | — |
| A128 | 1070 | 10 | 20 | 10 | Good | 4.5 | 4.5 | — |
| A129 | 1220 | 50 | 180 | 10 | Good | 1.0 | 1.0 | — |

TABLE 20

| | PRODUCTION CONDITIONS DECARBURIZATION ANNEALING PROCESS | | | | | | | |
|---|---|---|---|---|---|---|---|---|
| | HOLDING STAGE | | | | | | | |
| | | | | | OXIDATION DEGREE | | | |
| | HOLDING TEMPERATURE | | HOLDING TIME | | | | OXIDATION | OVERALL |
| TEST No. | FIRST ANNEALING TI ° C. | SECOND ANNEALING TII ° C. | FIRST ANNEALING tI sec | SECOND ANNEALING tII sec | FIRST ANNEALING PI — | SECOND ANNEALING PII — | DEGREE CONTROL PI > PII — | OXIDATION DEGREE CONTROL — |
| A130 | 750 | — | 75 | — | 0.2 | — | — | — |
| A131 | 820 | — | 160 | — | 0.5 | — | — | — |
| A132 | 820 | — | 160 | — | 0.5 | — | — | — |
| A133 | 840 | 940 | 150 | 30 | 0.55 | 0.004 | Good | Good |
| B43 | 820 | — | 160 | — | 0.5 | — | — | — |
| B44 | 820 | — | 160 | — | 0.5 | — | — | — |
| B45 | 820 | — | 3 | — | 0.5 | — | — | — |
| B46 | 820 | — | 160 | — | 0.5 | — | — | — |
| B47 | 820 | — | 160 | — | 0.5 | — | — | — |
| B48 | — | — | — | — | — | — | — | — |
| B49 | 820 | — | 160 | — | 0.5 | — | — | — |
| B50 | 820 | — | 160 | — | 0.5 | — | — | — |
| B51 | — | — | — | — | — | — | — | — |
| B52 | 830 | — | 150 | — | 0.4 | — | — | — |
| B53 | 830 | — | 150 | — | 0.4 | — | — | — |

TABLE 20-continued

| | PRODUCTION CONDITIONS | | | | | | | |
|---|---|---|---|---|---|---|---|---|
| | | | INSULATION COATING FORMING PROCESS HEATING STAGE | | | | | |
| | | | AVERAGE HEATING RATE | | | OXIDATION DEGREE | | |
| | FINAL ANNEALING PROCESS | | TEMPERATURE RANGE OF | TEMPERATURE RANGE OF | HEATING | TEMPERATURE RANGE OF | TEMPERATURE RANGE OF | OXIDATION |
| TEST No. | FINAL ANNEALING TEMPERATURE ° C. | FINAL ANNEALING TIME hour | 600 TO 700° C. S3 ° C./sec | 700 TO 800° C. S4 ° C./sec | RATE CONTROL S3 > S4 — | 600 TO 700° C. P3 — | 700 TO 800° C. P4 — | DEGREE CONTROL P3 > P4 — |
| A130 | 1110 | 10 | 15 | 8 | Good | 4.0 | 4.0 | — |
| A131 | 1200 | 20 | 60 | 10 | Good | 1.2 | 1.2 | — |
| A132 | 1200 | 20 | 60 | 10 | Good | 1.2 | 1.2 | — |
| A133 | 1200 | 20 | 100 | 10 | Good | 2.0 | 1.5 | Good |
| B43 | 1200 | 20 | 60 | 10 | Good | 1.2 | 1.2 | — |
| B44 | 1200 | 20 | 100 | 20 | Good | 1.2 | 1.2 | — |
| B45 | 1200 | 20 | 60 | 10 | Good | 1.2 | 1.2 | — |
| B46 | 1200 | 20 | 60 | 10 | Good | 1.2 | 1.2 | — |
| B47 | 1200 | 20 | 60 | 10 | Good | 1.2 | 1.2 | — |
| B48 | — | — | — | — | — | — | — | — |
| B49 | 1200 | 20 | 60 | 10 | Good | 1.2 | 1.2 | — |
| B50 | 1200 | 20 | 60 | 10 | Good | 1.2 | 1.2 | — |
| B51 | — | — | — | — | — | — | — | — |
| B52 | 1200 | 20 | 60 | 10 | Good | 1.2 | 1.2 | — |
| B53 | 1200 | 20 | 60 | 10 | Good | 1.2 | 1.2 | — |

TABLE 21

| | PRODUCTION RESULTS PRODUCTION RESULTS OF SILICON STEEL SHEET | | | | | | | | | | | |
|---|---|---|---|---|---|---|---|---|---|---|---|---|
| | CHEMICAL COMPOSITION OF SILICON STEEL SHEET (UNIT: mass %, BALANCE CONSISTING OF Fe AND IMPURITIES) | | | | | | | | | | NUMBER FRACTION OF COARSE SECONDARY RECRYSTALLIZED | |
| TEST No. | Si | Mn | C | ACID-SOLUBLE Al | N | S | Bi | Sn | Cr | Cu | GRAINS IN SECONDARY RECRYSTALLIZED GRAINS % | AVERAGE THICKNESS mm |
| A1 | 2.55 | 0.030 | 0.002 | 0.001 | 0.001 | 0.0003 | — | — | — | — | 21 | 0.22 |
| A2 | 2.74 | 0.040 | 0.002 | 0.001 | 0.001 | 0.0005 | — | — | — | — | 25 | 0.22 |
| A3 | 2.51 | 0.040 | 0.002 | 0.001 | 0.002 | 0.0003 | — | — | — | — | 20 | 0.22 |
| A4 | 3.85 | 0.030 | 0.002 | 0.001 | 0.001 | 0.0004 | — | — | — | — | 28 | 0.22 |
| A5 | 2.85 | 0.040 | 0.002 | 0.001 | 0.001 | 0.0004 | — | — | — | — | 25 | 0.22 |
| A6 | 2.89 | 0.320 | 0.002 | 0.001 | 0.001 | 0.0004 | — | — | — | — | 20 | 0.22 |
| A7 | 2.75 | 0.450 | 0.002 | 0.001 | 0.001 | 0.0004 | — | — | — | — | 22 | 0.22 |
| A8 | 3.68 | 0.010 | 0.002 | 0.001 | 0.002 | 0.0004 | — | — | — | — | 27 | 0.22 |
| A9 | 3.75 | 0.490 | 0.002 | 0.001 | 0.001 | 0.0004 | — | — | — | — | 25 | 0.22 |
| A10 | 2.65 | 0.330 | 0.002 | 0.001 | 0.001 | 0.0004 | — | — | — | — | 24 | 0.22 |
| A11 | 2.85 | 0.170 | 0.002 | 0.001 | 0.001 | 0.0004 | — | — | — | — | 32 | 0.22 |
| A12 | 3.19 | 0.160 | 0.002 | 0.001 | 0.001 | 0.0004 | — | 0.006 | — | — | 22 | 0.22 |
| A13 | 3.18 | 0.120 | 0.002 | 0.001 | 0.001 | 0.0004 | — | 0.48 | — | — | 23 | 0.22 |
| A14 | 3.26 | 0.180 | 0.002 | 0.001 | 0.002 | 0.0004 | — | — | 0.01 | — | 20 | 0.22 |
| A15 | 3.25 | 0.140 | 0.002 | 0.001 | 0.003 | 0.0002 | — | — | 0.48 | — | 27 | 0.22 |
| A16 | 3.18 | 0.160 | 0.002 | 0.001 | 0.001 | 0.0002 | — | — | — | 0.01 | 25 | 0.22 |
| A17 | 3.15 | 0.150 | 0.002 | 0.001 | 0.001 | 0.0002 | — | — | — | 0.95 | 26 | 0.22 |
| A18 | 3.19 | 0.180 | 0.002 | 0.001 | 0.001 | 0.0002 | 0.0010 | — | — | — | 34 | 0.22 |
| A19 | 3.21 | 0.051 | 0.002 | 0.001 | 0.001 | 0.0002 | — | — | — | — | 41 | 0.22 |

TABLE 22

| | PRODUCTION RESULTS PRODUCTION RESULTS OF SILICON STEEL SHEET | | | | | | | | | | | |
|---|---|---|---|---|---|---|---|---|---|---|---|---|
| | CHEMICAL COMPOSITION OF SILICON STEEL SHEET (UNIT: mass %, BALANCE CONSISTING OF Fe AND IMPURITIES) | | | | | | | | | | NUMBER FRACTION OF COARSE SECONDARY RECRYSTALLIZED | |
| TEST No. | Si | Mn | C | ACID-SOLUBLE Al | N | S | Bi | Sn | Cr | Cu | GRAINS IN SECONDARY RECRYSTALLIZED GRAINS % | AVERAGE THICKNESS mm |
| A20 | 3.25 | 0.052 | 0.002 | 0.001 | 0.001 | 0.0002 | — | — | — | — | 36 | 0.22 |
| A21 | 3.18 | 0.095 | 0.002 | 0.001 | 0.002 | 0.0002 | — | — | — | — | 29 | 0.22 |
| A22 | 3.15 | 0.081 | 0.002 | 0.001 | 0.003 | 0.0002 | — | — | — | — | 25 | 0.22 |
| A23 | 3.14 | 0.051 | 0.002 | 0.001 | 0.001 | 0.0002 | 0.0005 | 0.11 | — | — | 28 | 0.22 |
| A24 | 3.16 | 0.075 | 0.002 | 0.001 | 0.001 | 0.0002 | — | — | 0.06 | 0.15 | 24 | 0.22 |
| A25 | 3.15 | 0.085 | 0.002 | 0.001 | 0.001 | 0.0002 | 0.0010 | — | — | 0.08 | 33 | 0.22 |
| A26 | 3.20 | 0.091 | 0.002 | 0.001 | 0.001 | 0.0002 | — | 0.14 | 0.02 | — | 51 | 0.22 |
| A27 | 3.15 | 0.092 | 0.002 | 0.001 | 0.001 | 0.0002 | — | 0.02 | 0.12 | 0.03 | 31 | 0.22 |
| A28 | 3.22 | 0.078 | 0.002 | 0.001 | 0.001 | 0.0002 | — | 0.33 | — | 0.11 | 27 | 0.22 |
| A29 | 3.19 | 0.065 | 0.002 | 0.001 | 0.001 | 0.0002 | 0.0005 | — | 0.37 | — | 34 | 0.22 |
| A30 | 3.22 | 0.092 | 0.002 | 0.001 | 0.002 | 0.0002 | 0.0010 | 0.28 | 0.035 | — | 28 | 0.22 |
| B1 | 3.16 | 0.060 | 0.002 | 0.001 | 0.001 | 0.0002 | — | — | — | — | — | 0.22 |
| B2 | 3.14 | 0.040 | 0.013 | 0.001 | 0.001 | 0.0002 | — | — | — | — | — | 0.22 |
| B3 | 2.35 | 0.060 | 0.002 | 0.001 | 0.001 | 0.0002 | — | — | — | — | — | 0.22 |
| B4 | — | — | — | — | — | — | — | — | — | — | — | — |
| B5 | 3.08 | 0.080 | 0.002 | 0.001 | 0.001 | 0.0001 | — | — | — | — | — | 0.22 |
| B6 | 3.09 | 0.050 | 0.002 | 0.018 | 0.001 | 0.0001 | — | — | — | — | — | 0.22 |
| B7 | 3.10 | 0.480 | 0.002 | 0.001 | 0.015 | 0.0002 | — | — | — | — | — | 0.22 |
| B8 | 3.24 | 0.009 | 0.002 | 0.001 | 0.001 | 0.0003 | — | — | — | — | — | 0.22 |

TABLE 23

| | PRODUCTION RESULTS PRODUCTION RESULTS OF SILICON STEEL SHEET | | | | | | | | | | | |
|---|---|---|---|---|---|---|---|---|---|---|---|---|
| | CHEMICAL COMPOSITION OF SILICON STEEL SHEET (UNIT: mass %, BALANCE CONSISTING OF Fe AND IMPURITIES) | | | | | | | | | | NUMBER FRACTION OF COARSE SECONDARY RECRYSTALLIZED | |
| TEST No. | Si | Mn | C | ACID-SOLUBLE Al | N | S | Bi | Sn | Cr | Cu | GRAINS IN SECONDARY RECRYSTALLIZED GRAINS % | AVERAGE THICKNESS mm |
| B9 | 3.26 | 0.520 | 0.002 | 0.001 | 0.001 | 0.0004 | — | — | — | — | — | 0.22 |
| B10 | 3.19 | 0.440 | 0.002 | 0.001 | 0.001 | 0.0004 | — | — | — | — | — | 0.22 |
| B11 | — | — | — | — | — | — | — | — | — | — | — | — |
| B12 | 2.55 | 0.030 | 0.002 | 0.001 | 0.001 | 0.0004 | — | — | — | — | 15 | 0.22 |
| B13 | 2.41 | 0.040 | 0.002 | 0.001 | 0.001 | 0.0004 | — | — | — | — | 18 | 0.22 |
| B14 | 2.81 | 0.040 | 0.002 | 0.001 | 0.001 | 0.0004 | — | — | — | — | 19 | 0.22 |
| B15 | 2.75 | 0.450 | 0.002 | 0.001 | 0.001 | 0.0004 | — | — | — | — | 15 | 0.22 |
| B16 | 3.71 | 0.490 | 0.002 | 0.001 | 0.001 | 0.0004 | — | — | — | — | 15 | 0.22 |
| B17 | 2.65 | 0.330 | 0.002 | 0.001 | 0.001 | 0.0002 | — | — | — | — | 18 | 0.22 |
| A31 | 2.81 | 0.170 | 0.002 | 0.001 | 0.003 | 0.0002 | — | — | — | — | 19 | 0.22 |
| B18 | 3.12 | 0.160 | 0.002 | 0.001 | 0.001 | 0.0002 | — | 0.006 | — | — | 25 | 0.22 |
| B19 | 3.11 | 0.120 | 0.002 | 0.001 | 0.001 | 0.0002 | — | 0.48 | — | — | 28 | 0.22 |
| B20 | 3.15 | 0.180 | 0.002 | 0.001 | 0.001 | 0.0002 | — | — | 0.01 | — | 28 | 0.22 |
| B21 | 3.10 | 0.150 | 0.002 | 0.001 | 0.001 | 0.0002 | — | — | — | 0.95 | 29 | 0.22 |
| B22 | 3.14 | 0.180 | 0.002 | 0.001 | 0.001 | 0.0002 | 0.0010 | — | — | — | 25 | 0.22 |
| A32 | 3.12 | 0.051 | 0.002 | 0.001 | 0.001 | 0.0004 | — | — | — | — | 15 | 0.19 |
| A33 | 3.14 | 0.052 | 0.002 | 0.001 | 0.001 | 0.0004 | — | — | — | — | 17 | 0.19 |
| B23 | 3.16 | 0.052 | 0.002 | 0.001 | 0.001 | 0.0004 | — | — | — | — | 19 | 0.19 |
| B24 | 3.09 | 0.095 | 0.002 | 0.001 | 0.001 | 0.0004 | — | — | — | — | 18 | 0.19 |

TABLE 24

| | PRODUCTION RESULTS PRODUCTION RESULTS OF SILICON STEEL SHEET | | | | | | | | | | | |
|---|---|---|---|---|---|---|---|---|---|---|---|---|
| | CHEMICAL COMPOSITION OF SILICON STEEL SHEET (UNIT: mass %, BALANCE CONSISTING OF Fe AND IMPURITIES) | | | | | | | | | | NUMBER FRACTION OF COARSE SECONDARY RECRYSTALLIZED | |
| TEST No. | Si | Mn | C | ACID-SOLUBLE Al | N | S | Bi | Sn | Cr | Cu | GRAINS IN SECONDARY RECRYSTALLIZED GRAINS % | AVERAGE THICKNESS mm |
| B25 | 3.15 | 0.081 | 0.002 | 0.001 | 0.001 | 0.0004 | — | — | — | — | 18 | 0.19 |
| A34 | 3.17 | 0.081 | 0.002 | 0.001 | 0.001 | 0.0002 | — | — | — | — | 35 | 0.19 |
| A35 | 3.16 | 0.052 | 0.002 | 0.001 | 0.002 | 0.0002 | — | — | — | — | 36 | 0.19 |
| A36 | 3.12 | 0.052 | 0.002 | 0.001 | 0.002 | 0.0002 | — | — | — | — | 32 | 0.19 |
| A37 | 3.14 | 0.081 | 0.002 | 0.001 | 0.002 | 0.0002 | — | — | — | — | 37 | 0.19 |
| A38 | 3.12 | 0.081 | 0.002 | 0.001 | 0.001 | 0.0002 | — | — | — | — | 32 | 0.19 |
| A39 | 3.15 | 0.081 | 0.002 | 0.001 | 0.001 | 0.0002 | — | — | — | — | 33 | 0.19 |
| A40 | 3.18 | 0.081 | 0.002 | 0.001 | 0.001 | 0.0002 | — | — | — | — | 32 | 0.22 |
| A41 | 3.24 | 0.081 | 0.002 | 0.001 | 0.001 | 0.0003 | — | — | — | — | 35 | 0.22 |
| A42 | 3.26 | 0.081 | 0.002 | 0.001 | 0.001 | 0.0003 | — | — | — | — | 51 | 0.22 |
| A43 | 3.16 | 0.051 | 0.002 | 0.001 | 0.001 | 0.0003 | 0.0005 | 0.11 | — | — | 33 | 0.22 |
| A44 | 3.15 | 0.051 | 0.002 | 0.001 | 0.001 | 0.0003 | 0.0005 | 0.11 | — | — | 35 | 0.22 |
| A45 | 3.14 | 0.051 | 0.002 | 0.001 | 0.002 | 0.0003 | 0.0005 | 0.11 | — | — | 42 | 0.22 |
| A46 | 3.12 | 0.085 | 0.002 | 0.001 | 0.001 | 0.0003 | 0.0010 | — | — | 0.08 | 36 | 0.22 |
| A47 | 3.17 | 0.085 | 0.002 | 0.001 | 0.001 | 0.0003 | 0.0010 | — | — | 0.08 | 39 | 0.22 |
| A48 | 3.13 | 0.085 | 0.002 | 0.001 | 0.001 | 0.0003 | 0.0010 | — | — | 0.08 | 42 | 0.22 |
| A49 | 3.12 | 0.091 | 0.002 | 0.001 | 0.002 | 0.0004 | — | 0.14 | 0.02 | — | 35 | 0.22 |
| A50 | 3.11 | 0.091 | 0.002 | 0.001 | 0.001 | 0.0004 | — | 0.14 | 0.02 | — | 45 | 0.22 |
| A51 | 3.20 | 0.092 | 0.002 | 0.001 | 0.001 | 0.0002 | — | 0.02 | 0.12 | 0.03 | 51 | 0.22 |

TABLE 25

| | PRODUCTION RESULTS PRODUCTION RESULTS OF SILICON STEEL SHEET | | | | | | | | | | | |
|---|---|---|---|---|---|---|---|---|---|---|---|---|
| | CHEMICAL COMPOSITION OF SILICON STEEL SHEET (UNIT: mass %, BALANCE CONSISTING OF Fe AND IMPURITIES) | | | | | | | | | | NUMBER FRACTION OF COARSE SECONDARY RECRYSTALLIZED | |
| TEST No. | Si | Mn | C | ACID-SOLUBLE Al | N | S | Bi | Sn | Cr | Cu | GRAINS IN SECONDARY RECRYSTALLIZED GRAINS % | AVERAGE THICKNESS mm |
| A52 | 3.14 | 0.092 | 0.002 | 0.001 | 0.001 | 0.0002 | — | 0.02 | 0.12 | 0.03 | 41 | 0.22 |
| A53 | 3.25 | 0.078 | 0.002 | 0.001 | 0.001 | 0.0003 | — | 0.33 | — | 0.11 | 35 | 0.19 |
| A54 | 3.26 | 0.065 | 0.002 | 0.001 | 0.001 | 0.0003 | 0.0005 | — | 0.37 | — | 36 | 0.19 |
| A55 | 3.27 | 0.065 | 0.002 | 0.001 | 0.001 | 0.0003 | 0.0005 | — | 0.37 | — | 41 | 0.19 |
| A56 | 3.27 | 0.092 | 0.002 | 0.001 | 0.001 | 0.0003 | 0.0010 | 0.28 | 0.035 | — | 50 | 0.19 |
| B26 | 3.14 | 0.140 | 0.002 | 0.001 | 0.001 | 0.0002 | — | — | 0.48 | — | 43 | 0.22 |
| B27 | 3.20 | 0.160 | 0.002 | 0.001 | 0.001 | 0.0002 | — | — | — | 0.01 | 52 | 0.22 |
| B28 | 3.15 | 0.150 | 0.002 | 0.001 | 0.001 | 0.0002 | — | — | — | 0.95 | 65 | 0.22 |
| B29 | 3.12 | 0.180 | 0.002 | 0.001 | 0.001 | 0.0002 | 0.0010 | — | — | — | 43 | 0.22 |
| B30 | 3.09 | 0.051 | 0.002 | 0.001 | 0.001 | 0.0002 | — | — | — | — | 29 | 0.22 |
| B31 | 3.11 | 0.140 | 0.002 | 0.001 | 0.001 | 0.0002 | — | — | 0.48 | — | 36 | 0.22 |
| B32 | 3.11 | 0.160 | 0.002 | 0.001 | 0.001 | 0.0002 | — | — | — | 0.01 | 42 | 0.22 |
| B33 | 3.14 | 0.051 | 0.002 | 0.001 | 0.001 | 0.0002 | — | — | — | — | 51 | 0.22 |
| A57 | 3.08 | 0.051 | 0.002 | 0.001 | 0.002 | 0.0002 | — | — | — | — | 18 | 0.22 |
| A58 | 3.09 | 0.051 | 0.002 | 0.001 | 0.001 | 0.0002 | — | — | — | — | 19 | 0.22 |
| A59 | 3.14 | 0.052 | 0.002 | 0.001 | 0.001 | 0.0002 | — | — | — | — | 18 | 0.22 |
| A60 | 3.12 | 0.052 | 0.002 | 0.001 | 0.001 | 0.0002 | — | — | — | — | 19 | 0.22 |
| A61 | 3.13 | 0.095 | 0.002 | 0.001 | 0.002 | 0.0002 | — | — | — | — | 18 | 0.22 |
| A62 | 3.17 | 0.095 | 0.002 | 0.001 | 0.001 | 0.0002 | — | — | — | — | 25 | 0.22 |

TABLE 26

| | PRODUCTION RESULTS PRODUCTION RESULTS OF SILICON STEEL SHEET | | | | | | | | | | | |
|---|---|---|---|---|---|---|---|---|---|---|---|---|
| | CHEMICAL COMPOSITION OF SILICON STEEL SHEET (UNIT: mass %, BALANCE CONSISTING OF Fe AND IMPURITIES) | | | | | | | | | | NUMBER FRACTION OF COARSE SECONDARY RECRYSTALLIZED | |
| TEST No. | Si | Mn | C | ACID-SOLUBLE Al | N | S | Bi | Sn | Cr | Cu | GRAINS IN SECONDARY RECRYSTALLIZED GRAINS % | AVERAGE THICKNESS mm |
| A63 | 3.12 | 0.081 | 0.002 | 0.001 | 0.001 | 0.0002 | — | — | — | — | 24 | 0.22 |
| A64 | 3.12 | 0.081 | 0.002 | 0.001 | 0.001 | 0.0002 | — | — | — | — | 25 | 0.22 |
| A65 | 3.14 | 0.051 | 0.002 | 0.001 | 0.001 | 0.0002 | 0.0005 | 0.11 | — | — | 25 | 0.22 |
| A66 | 3.11 | 0.051 | 0.002 | 0.001 | 0.001 | 0.0002 | 0.0005 | 0.11 | — | — | 28 | 0.22 |
| A67 | 3.14 | 0.051 | 0.002 | 0.001 | 0.001 | 0.0002 | — | — | — | — | 18 | 0.19 |
| A68 | 3.15 | 0.051 | 0.002 | 0.001 | 0.003 | 0.0003 | — | — | — | — | 17 | 0.19 |
| A69 | 3.18 | 0.052 | 0.002 | 0.001 | 0.002 | 0.0004 | — | — | — | — | 19 | 0.19 |
| A70 | 3.13 | 0.052 | 0.002 | 0.001 | 0.002 | 0.0004 | — | — | — | — | 19 | 0.19 |
| A71 | 3.12 | 0.095 | 0.002 | 0.001 | 0.001 | 0.0004 | — | — | — | — | 19 | 0.19 |
| A72 | 3.12 | 0.095 | 0.002 | 0.001 | 0.001 | 0.0004 | — | — | — | — | 18 | 0.19 |
| A73 | 3.14 | 0.081 | 0.002 | 0.001 | 0.001 | 0.0004 | — | — | — | — | 51 | 0.19 |
| A74 | 3.12 | 0.081 | 0.002 | 0.001 | 0.001 | 0.0004 | — | — | — | — | 38 | 0.19 |
| A75 | 3.11 | 0.051 | 0.002 | 0.001 | 0.001 | 0.0004 | 0.0005 | 0.11 | — | — | 42 | 0.19 |
| A76 | 3.16 | 0.051 | 0.002 | 0.001 | 0.001 | 0.0004 | 0.0005 | 0.11 | — | — | 39 | 0.19 |
| A77 | 3.14 | 0.095 | 0.002 | 0.001 | 0.001 | 0.0004 | — | — | — | — | 35 | 0.19 |
| A78 | 3.12 | 0.081 | 0.002 | 0.001 | 0.002 | 0.0003 | — | — | — | — | 35 | 0.19 |
| A79 | 3.15 | 0.081 | 0.002 | 0.001 | 0.001 | 0.0003 | — | — | — | — | 37 | 0.22 |
| A80 | 3.12 | 0.081 | 0.002 | 0.001 | 0.001 | 0.0003 | — | — | — | — | 34 | 0.19 |
| A81 | 3.12 | 0.081 | 0.002 | 0.001 | 0.001 | 0.0003 | — | — | — | — | 68 | 0.22 |

TABLE 27

| | PRODUCTION RESULTS PRODUCTION RESULTS OF SILICON STEEL SHEET | | | | | | | | | | | |
|---|---|---|---|---|---|---|---|---|---|---|---|---|
| | CHEMICAL COMPOSITION OF SILICON STEEL SHEET (UNIT mass %, BALANCE CONSISTING OF Fe AND IMPURITIES) | | | | | | | | | | NUMBER FRACTION OF COARSE SECONDARY RECRYSTALLIZED | |
| TEST No. | Si | Mn | C | ACID-SOLUBLE Al | N | S | Bi | Sn | Cr | Cu | GRAINS IN SECONDARY RECRYSTALLIZED GRAINS % | AVERAGE THICKNESS mm |
| A82 | 3.11 | 0.051 | 0.002 | 0.001 | 0.001 | 0.0003 | 0.0005 | 0.11 | — | — | 34 | 0.19 |
| A83 | 3.14 | 0.051 | 0.002 | 0.001 | 0.001 | 0.0003 | 0.0005 | 0.11 | — | — | 55 | 0.22 |
| A84 | 3.11 | 0.051 | 0.002 | 0.001 | 0.001 | 0.0004 | 0.0005 | 0.11 | — | — | 56 | 0.19 |
| A85 | 3.11 | 0.085 | 0.002 | 0.001 | 0.001 | 0.0004 | 0.0010 | — | — | 0.08 | 71 | 0.22 |
| A86 | 3.11 | 0.085 | 0.002 | 0.001 | 0.001 | 0.0002 | 0.0010 | — | — | 0.08 | 49 | 0.19 |
| A87 | 3.09 | 0.091 | 0.002 | 0.001 | 0.002 | 0.0002 | — | 0.14 | 0.02 | — | 35 | 0.22 |
| A88 | 3.11 | 0.091 | 0.002 | 0.001 | 0.001 | 0.0003 | — | 0.14 | 0.02 | — | 37 | 0.19 |
| A89 | 3.14 | 0.092 | 0.002 | 0.001 | 0.001 | 0.0003 | — | 0.02 | 0.12 | 0.03 | 34 | 0.22 |
| A90 | 3.15 | 0.092 | 0.002 | 0.001 | 0.001 | 0.0003 | — | 0.02 | 0.12 | 0.03 | 68 | 0.19 |
| A91 | 3.25 | 0.078 | 0.002 | 0.001 | 0.001 | 0.0004 | — | 0.33 | — | 0.11 | 34 | 0.22 |
| A92 | 3.25 | 0.078 | 0.002 | 0.001 | 0.001 | 0.0004 | — | 0.33 | — | 0.11 | 55 | 0.19 |
| A93 | 3.22 | 0.065 | 0.002 | 0.001 | 0.001 | 0.0002 | 0.0005 | — | 0.37 | — | 56 | 0.22 |
| A94 | 3.24 | 0.092 | 0.002 | 0.001 | 0.001 | 0.0002 | 0.0010 | 0.28 | 0.035 | — | 71 | 0.19 |
| A95 | 3.25 | 0.092 | 0.002 | 0.001 | 0.001 | 0.0002 | 0.0010 | 0.28 | 0.035 | — | 49 | 0.22 |
| A96 | 2.51 | 0.030 | 0.002 | 0.001 | 0.001 | 0.0002 | — | — | — | — | 29 | 0.19 |
| A97 | 2.71 | 0.040 | 0.002 | 0.001 | 0.001 | 0.0002 | — | — | — | — | 26 | 0.19 |
| A98 | 2.50 | 0.040 | 0.002 | 0.001 | 0.001 | 0.0002 | — | — | — | — | 21 | 0.19 |
| A99 | 3.82 | 0.030 | 0.002 | 0.001 | 0.001 | 0.0002 | — | — | — | — | 35 | 0.19 |
| A100 | 2.81 | 0.040 | 0.002 | 0.001 | 0.001 | 0.0003 | — | — | — | — | 22 | 0.19 |

TABLE 28

| | PRODUCTION RESULTS PRODUCTION RESULTS OF SILICON STEEL SHEET | | | | | | | | | | | |
|---|---|---|---|---|---|---|---|---|---|---|---|---|
| | CHEMICAL COMPOSITION OF SILICON STEEL SHEET (UNIT: mass %, BALANCE CONSISTING OF Fe AND IMPURITIES) | | | | | | | | | | NUMBER FRACTION OF COARSE SECONDARY RECRYSTALLIZED | |
| TEST No. | Si | Mn | C | ACID-SOLUBLE Al | N | S | Bi | Sn | Cr | Cu | GRAINS IN SECONDARY RECRYSTALLIZED GRAINS % | AVERAGE THICKNESS mm |
| A101 | 2.87 | 0.320 | 0.002 | 0.001 | 0.002 | 0.0003 | — | — | — | — | 25 | 0.19 |
| A102 | 2.77 | 0.450 | 0.002 | 0.001 | 0.001 | 0.0004 | — | — | — | — | 28 | 0.19 |
| A103 | 3.67 | 0.010 | 0.002 | 0.001 | 0.001 | 0.0004 | — | — | — | — | 37 | 0.19 |
| A104 | 3.59 | 0.490 | 0.002 | 0.001 | 0.001 | 0.0002 | — | — | — | — | 24 | 0.19 |
| A105 | 2.58 | 0.330 | 0.002 | 0.001 | 0.001 | 0.0002 | — | — | — | — | 27 | 0.19 |
| A106 | 2.77 | 0.170 | 0.002 | 0.001 | 0.001 | 0.0003 | — | — | — | — | 42 | 0.19 |
| A107 | 3.12 | 0.160 | 0.002 | 0.001 | 0.001 | 0.0003 | — | 0.006 | — | — | 34 | 0.19 |
| A108 | 3.05 | 0.120 | 0.002 | 0.001 | 0.001 | 0.0003 | — | 0.48 | — | — | 26 | 0.19 |
| A109 | 3.24 | 0.180 | 0.002 | 0.001 | 0.001 | 0.0004 | — | — | 0.01 | — | 28 | 0.19 |
| A110 | 3.11 | 0.140 | 0.002 | 0.001 | 0.001 | 0.0004 | — | — | 0.48 | — | 22 | 0.19 |
| A111 | 3.12 | 0.160 | 0.002 | 0.001 | 0.002 | 0.0002 | — | — | — | 0.01 | 31 | 0.19 |
| A112 | 3.15 | 0.150 | 0.002 | 0.001 | 0.001 | 0.0002 | — | — | — | 0.95 | 28 | 0.19 |
| A113 | 3.11 | 0.180 | 0.002 | 0.001 | 0.001 | 0.0004 | 0.0010 | — | — | — | 33 | 0.19 |
| A114 | 3.14 | 0.051 | 0.002 | 0.001 | 0.001 | 0.0004 | — | — | — | — | 55 | 0.19 |
| A115 | 3.16 | 0.052 | 0.002 | 0.001 | 0.001 | 0.0002 | — | — | — | — | 41 | 0.19 |
| A116 | 3.11 | 0.095 | 0.002 | 0.001 | 0.001 | 0.0002 | — | — | — | — | 29 | 0.19 |
| A117 | 3.21 | 0.081 | 0.002 | 0.001 | 0.001 | 0.0002 | — | — | — | — | 26 | 0.19 |
| A118 | 3.16 | 0.051 | 0.002 | 0.001 | 0.001 | 0.0002 | 0.0005 | 0.11 | — | — | 45 | 0.19 |
| A119 | 3.19 | 0.075 | 0.002 | 0.001 | 0.001 | 0.0002 | — | — | 0.06 | 0.15 | 28 | 0.19 |

TABLE 29

| | PRODUCTION RESULTS PRODUCTION RESULTS OF SILICON STEEL SHEET | | | | | | | | | | | |
|---|---|---|---|---|---|---|---|---|---|---|---|---|
| | CHEMICAL COMPOSITION OF SILICON STEEL SHEET (UNIT: mass %, BALANCE CONSISTING OF Fe AND IMPURITIES) | | | | | | | | | | NUMBER FRACTION OF COARSE SECONDARY RECRYSTALLIZED | |
| TEST No. | Si | Mn | C | ACID-SOLUBLE Al | N | S | Bi | Sn | Cr | Cu | GRAINS IN SECONDARY RECRYSTALLIZED GRAINS % | AVERAGE THICKNESS mm |
| A120 | 3.15 | 0.085 | 0.002 | 0.001 | 0.001 | 0.0002 | 0.0010 | — | — | 0.08 | 46 | 0.19 |
| A121 | 3.13 | 0.091 | 0.002 | 0.001 | 0.002 | 0.0002 | — | 0.14 | 0.02 | — | 42 | 0.19 |
| A122 | 3.14 | 0.092 | 0.002 | 0.001 | 0.001 | 0.0003 | — | 0.02 | 0.12 | 0.03 | 38 | 0.19 |
| A123 | 3.22 | 0.078 | 0.002 | 0.001 | 0.001 | 0.0003 | — | 0.33 | — | 0.11 | 27 | 0.19 |
| A124 | 3.29 | 0.065 | 0.002 | 0.001 | 0.001 | 0.0003 | 0.0005 | — | 0.37 | — | 34 | 0.19 |
| A125 | 3.22 | 0.092 | 0.002 | 0.001 | 0.001 | 0.0003 | 0.0010 | 0.28 | 0.035 | — | 26 | 0.19 |
| B34 | 3.18 | 0.060 | 0.002 | 0.001 | 0.001 | 0.0003 | — | — | — | — | — | 0.19 |
| B35 | 3.11 | 0.040 | 0.015 | 0.001 | 0.001 | 0.0003 | — | — | — | — | — | 0.19 |
| B36 | 2.30 | 0.060 | 0.002 | 0.001 | 0.001 | 0.0002 | — | — | — | — | — | 0.19 |
| B37 | 3.09 | 0.080 | 0.002 | 0.001 | 0.001 | 0.0001 | — | — | — | — | — | 0.19 |
| B38 | 3.01 | 0.050 | 0.002 | 0.019 | 0.001 | 0.0003 | — | — | — | — | — | 0.19 |
| B39 | 3.08 | 0.480 | 0.002 | 0.001 | 0.018 | 0.0003 | — | — | — | — | — | 0.19 |
| B40 | 3.14 | 0.009 | 0.002 | 0.001 | 0.001 | 0.0001 | — | — | — | — | — | 0.19 |
| B41 | 3.20 | 0.520 | 0.002 | 0.001 | 0.001 | 0.0004 | — | — | — | — | — | 0.19 |
| B42 | 3.20 | 0.440 | 0.002 | 0.001 | 0.001 | 0.0003 | — | — | — | — | — | 0.19 |
| A126 | 2.55 | 0.010 | 0.002 | 0.001 | 0.001 | 0.0002 | — | — | — | — | 21 | 0.23 |
| A127 | 2.78 | 0.310 | 0.002 | 0.001 | 0.001 | 0.0002 | — | — | — | — | 20 | 0.22 |
| A128 | 3.69 | 0.490 | 0.002 | 0.001 | 0.001 | 0.0002 | — | — | — | — | 21 | 0.22 |
| A129 | 2.51 | 0.495 | 0.002 | 0.001 | 0.001 | 0.0002 | — | — | — | — | 17 | 0.22 |

TABLE 30

| | PRODUCTION RESULTS PRODUCTION RESULTS OF SILICON STEEL SHEET | | | | | | | | | | | |
|---|---|---|---|---|---|---|---|---|---|---|---|---|
| | CHEMICAL COMPOSITION OF SILICON STEEL SHEET (UNIT: mass %, BALANCE CONSISTING OF Fe AND IMPURITIES) | | | | | | | | | | NUMBER FRACTION OF COARSE SECONDARY RECRYSTALLIZED | |
| TEST No. | Si | Mn | C | ACID-SOLUBLE Al | N | S | Bi | Sn | Cr | Cu | GRAINS IN SECONDARY RECRYSTALLIZED GRAINS % | AVERAGE THICKNESS mm |
| A130 | 2.54 | 0.080 | 0.002 | 0.001 | 0.001 | 0.0002 | — | — | — | — | 19 | 0.19 |
| A131 | 2.71 | 0.450 | 0.002 | 0.001 | 0.001 | 0.0002 | — | — | — | — | 22 | 0.22 |
| A132 | 2.68 | 0.450 | 0.002 | 0.001 | 0.001 | 0.0002 | — | — | — | — | 23 | 0.22 |
| A133 | 3.11 | 0.051 | 0.002 | 0.001 | 0.001 | 0.0002 | 0.0005 | 0.11 | — | — | 54 | 0.19 |
| B43 | 2.74 | 0.450 | 0.002 | 0.001 | 0.001 | 0.0002 | — | — | — | — | 22 | 0.22 |
| B44 | 2.55 | 0.001 | 0.002 | 0.001 | 0.001 | 0.0002 | — | — | — | — | 20 | 0.23 |
| B45 | 3.05 | 0.050 | 0.210 | 0.001 | 0.001 | 0.0002 | — | — | — | — | — | 0.22 |
| B46 | 2.97 | 0.045 | 0.002 | 0.072 | 0.001 | 0.0003 | — | — | — | — | — | 0.22 |
| B47 | 3.04 | 0.055 | 0.002 | 0.001 | 0.022 | 0.0004 | — | — | — | — | — | 0.22 |
| B48 | — | — | — | — | — | — | — | — | — | — | — | — |
| B49 | 3.00 | 0.053 | 0.002 | 0.001 | 0.001 | 0.0003 | — | 0.53 | — | — | — | 0.22 |
| B50 | 2.95 | 0.045 | 0.002 | 0.001 | 0.001 | 0.0003 | — | — | 0.51 | — | — | 0.22 |
| B51 | — | — | — | — | — | — | — | — | — | — | — | — |
| B52 | 2.88 | 0.038 | 0.002 | 0.001 | 0.001 | 0.0002 | — | — | — | — | 22 | 0.22 |
| B53 | 3.07 | 0.045 | 0.002 | 0.001 | 0.001 | 0.0004 | — | — | — | — | 28 | 0.22 |

25

TABLE 31

| | PRODUCTION RESULTS PRODUCTION RESULTS OF GLASS FILM | | | | | | | |
|---|---|---|---|---|---|---|---|---|
| | Mn-CONTANING OXIDE | | | | | EVALUATION RESULTS | | |
| TEST No. | EXISTENCE | TYPE (B: BRAUNITE) (M: $Mn_3O_4$) | EXISTENCE AT INTERFACE | NUMBER DENSITY AT INTERFACE PIECES/$\mu m^2$ | DIFFRACTED INTENSITY OF $I_{For}$ AND $I_{TiN}$ BY XRD | FILM ADHESION | MAGNETIC FLUX DENSITY B8 T | NOTE |
| A1 | EXISTENCE | B & M | EXISTENCE | 0.03 | — | Fair | 1.91 | INVENTIVE EXAMPLE |
| A2 | EXISTENCE | B & M | EXISTENCE | 0.01 | — | Fair | 1.92 | INVENTIVE EXAMPLE |
| A3 | EXISTENCE | B & M | EXISTENCE | 0.02 | — | Fair | 1.90 | INVENTIVE EXAMPLE |
| A4 | EXISTENCE | B & M | EXISTENCE | 0.01 | — | Fair | 1.93 | INVENTIVE EXAMPLE |
| A5 | EXISTENCE | B & M | EXISTENCE | 0.04 | — | Fair | 1.92 | INVENTIVE EXAMPLE |
| A6 | EXISTENCE | B & M | EXISTENCE | 0.03 | — | Fair | 1.90 | INVENTIVE EXAMPLE |
| A7 | EXISTENCE | B & M | EXISTENCE | 0.03 | — | Fair | 1.91 | INVENTIVE EXAMPLE |
| A8 | EXISTENCE | B & M | EXISTENCE | 0.01 | — | Fair | 1.93 | INVENTIVE EXAMPLE |
| A9 | EXISTENCE | B & M | EXISTENCE | 0.03 | — | Fair | 1.92 | INVENTIVE EXAMPLE |
| A10 | EXISTENCE | B & M | EXISTENCE | 0.02 | — | Fair | 1.93 | INVENTIVE EXAMPLE |
| A11 | EXISTENCE | B & M | EXISTENCE | 0.03 | — | Fair | 1.94 | INVENTIVE EXAMPLE |
| A12 | EXISTENCE | B & M | EXISTENCE | 0.4 | — | Good | 1.92 | INVENTIVE EXAMPLE |
| A13 | EXISTENCE | B & M | EXISTENCE | 0.2 | — | Good | 1.92 | INVENTIVE EXAMPLE |
| A14 | EXISTENCE | B & M | EXISTENCE | 0.3 | — | Good | 1.91 | INVENTIVE EXAMPLE |
| A15 | EXISTENCE | B & M | EXISTENCE | 0.3 | — | Good | 1.93 | INVENTIVE EXAMPLE |
| A16 | EXISTENCE | B & M | EXISTENCE | 0.4 | — | Good | 1.92 | INVENTIVE EXAMPLE |
| A17 | EXISTENCE | B & M | EXISTENCE | 0.1 | — | Good | 1.93 | INVENTIVE EXAMPLE |
| A18 | EXISTENCE | B & M | EXISTENCE | 0.2 | — | Good | 1.94 | INVENTIVE EXAMPLE |
| A19 | EXISTENCE | B & M | EXISTENCE | 0.4 | — | Good | 1.95 | INVENTIVE EXAMPLE |

TABLE 32

| | PRODUCTION RESULTS PRODUCTION RESULTS OF GLASS FILM | | | | | | | |
|---|---|---|---|---|---|---|---|---|
| | Mn-CONTANING OXIDE | | | | | EVALUATION RESULTS | | |
| TEST No. | EXISTENCE | TYPE (B: BRAUNITE) (M: $Mn_3O_4$) | EXISTENCE AT INTERFACE | NUMBER DENSITY AT INTERFACE PIECES/$\mu m^2$ | DIFFRACTED INTENSITY OF $I_{For}$ AND $I_{TiN}$ BY XRD | FILM ADHESION | MAGNETIC FLUX DENSITY B8 T | NOTE |
| A20 | EXISTENCE | B & M | EXISTENCE | 0.3 | — | Good | 1.94 | INVENTIVE EXAMPLE |
| A21 | EXISTENCE | B & M | EXISTENCE | 0.2 | — | Good | 1.93 | INVENTIVE EXAMPLE |
| A22 | EXISTENCE | B & M | EXISTENCE | 0.3 | — | Good | 1.92 | INVENTIVE EXAMPLE |
| A23 | EXISTENCE | B & M | EXISTENCE | 1.0 | — | V.G. | 1.93 | INVENTIVE EXAMPLE |
| A24 | EXISTENCE | B & M | EXISTENCE | 0.7 | — | V.G. | 1.92 | INVENTIVE EXAMPLE |
| A25 | EXISTENCE | B & M | EXISTENCE | 1.1 | — | V.G. | 1.94 | INVENTIVE EXAMPLE |
| A26 | EXISTENCE | B & M | EXISTENCE | 0.9 | — | V.G. | 1.95 | INVENTIVE EXAMPLE |
| A27 | EXISTENCE | B & M | EXISTENCE | 1.5 | — | V.G. | 1.94 | INVENTIVE EXAMPLE |
| A28 | EXISTENCE | B & M | EXISTENCE | 1.2 | — | V.G. | 1.93 | INVENTIVE EXAMPLE |
| A29 | EXISTENCE | B & M | EXISTENCE | 1.1 | — | V.G. | 1.94 | INVENTIVE EXAMPLE |
| A30 | EXISTENCE | B & M | EXISTENCE | 1.9 | — | V.G. | 1.92 | INVENTIVE EXAMPLE |
| B1 | — | — | — | — | — | — | 1.65 | COMPARATIVE EXAMPLE |
| B2 | — | — | — | — | — | — | 1.71 | COMPARATIVE EXAMPLE |
| B3 | — | — | — | — | — | — | 1.66 | COMPARATIVE EXAMPLE |
| B4 | — | — | — | — | — | — | — | COMPARATIVE EXAMPLE |
| B5 | — | — | — | — | — | — | 1.77 | COMPARATIVE EXAMPLE |
| B6 | — | — | — | — | — | — | 1.76 | COMPARATIVE EXAMPLE |
| B7 | — | — | — | — | — | — | 1.75 | COMPARATIVE EXAMPLE |
| B8 | — | — | — | — | — | — | 1.74 | COMPARATIVE EXAMPLE |

TABLE 33

| | PRODUCTION RESULTS PRODUCTION RESULTS OF GLASS FILM | | | | | | | |
|---|---|---|---|---|---|---|---|---|
| | Mn-CONTANING OXIDE | | | | | EVALUATION RESULTS | | |
| TEST No. | EXISTENCE | TYPE (B: BRAUNITE) (M: $Mn_3O_4$) | EXISTENCE AT INTERFACE | NUMBER DENSITY AT INTERFACE PIECES/$\mu m^2$ | DIFFRACTED INTENSITY OF $I_{For}$ AND $I_{TiN}$ BY XRD | FILM ADHESION | MAGNETIC FLUX DENSITY B8 T | NOTE |
| B9 | — | — | — | — | — | — | 1.72 | COMPARATIVE EXAMPLE |
| B10 | — | — | — | — | — | — | 1.75 | COMPARATIVE EXAMPLE |
| B11 | — | — | — | — | — | — | — | COMPARATIVE EXAMPLE |
| B12 | NONE | — | — | — | — | Poor | 1.89 | COMPARATIVE EXAMPLE |
| B13 | NONE | — | — | — | — | Poor | 1.89 | COMPARATIVE EXAMPLE |
| B14 | NONE | — | — | — | — | Poor | 1.92 | COMPARATIVE EXAMPLE |
| B15 | NONE | — | — | — | — | Poor | 1.92 | COMPARATIVE EXAMPLE |
| B16 | NONE | — | — | — | — | Poor | 1.91 | COMPARATIVE EXAMPLE |
| B17 | NONE | — | — | — | — | Poor | 1.89 | COMPARATIVE EXAMPLE |
| A31 | EXISTENCE | B & M | EXISTENCE | 0.04 | — | Fair | 1.91 | INVENTIVE EXAMPLE |
| B18 | NONE | — | — | — | — | Poor | 1.91 | COMPARATIVE EXAMPLE |
| B19 | NONE | — | — | — | — | Poor | 1.92 | COMPARATIVE EXAMPLE |
| B20 | NONE | — | — | — | — | Poor | 1.93 | COMPARATIVE EXAMPLE |
| B21 | NONE | — | — | — | — | Poor | 1.93 | COMPARATIVE EXAMPLE |
| B22 | NONE | — | — | — | — | Poor | 1.92 | COMPARATIVE EXAMPLE |
| A32 | EXISTENCE | B & M | EXISTENCE | 0.3 | — | Good | 1.90 | INVENTIVE EXAMPLE |
| A33 | EXISTENCE | B & M | EXISTENCE | 0.4 | — | Good | 1.91 | INVENTIVE EXAMPLE |
| B23 | NONE | — | — | — | — | Poor | 1.92 | COMPARATIVE EXAMPLE |
| B24 | NONE | — | — | — | — | Poor | 1.91 | COMPARATIVE EXAMPLE |

TABLE 34

| | PRODUCTION RESULTS PRODUCTION RESULTS OF GLASS FILM | | | | | EVALUATION RESULTS | | |
|---|---|---|---|---|---|---|---|---|
| | Mn-CONTANING OXIDE | | | | | | | |
| TEST No. | EXISTENCE | TYPE (B: BRAUNITE) (M: $Mn_3O_4$) | EXISTENCE AT INTERFACE | NUMBER DENSITY AT INTERFACE PIECES/$\mu m^2$ | DIFFRACTED INTENSITY OF $I_{For}$ AND $I_{TiN}$ BY XRD | FILM ADHESION | MAGNETIC FLUX DENSITY B8 T | NOTE |
| B25 | NONE | — | — | — | — | Poor | 1.92 | COMPARATIVE EXAMPLE |
| A34 | EXISTENCE | B & M | EXISTENCE | 1.5 | — | V.G. | 1.96 | INVENTIVE EXAMPLE |
| A35 | EXISTENCE | B & M | EXISTENCE | 1.9 | — | V.G. | 1.95 | INVENTIVE EXAMPLE |
| A36 | EXISTENCE | B & M | EXISTENCE | 1.3 | — | V.G. | 1.95 | INVENTIVE EXAMPLE |
| A37 | EXISTENCE | B & M | EXISTENCE | 0.9 | — | V.G. | 1.95 | INVENTIVE EXAMPLE |
| A38 | EXISTENCE | B & M | EXISTENCE | 1.5 | — | V.G. | 1.96 | INVENTIVE EXAMPLE |
| A39 | EXISTENCE | B & M | EXISTENCE | 0.8 | — | V.G. | 1.94 | INVENTIVE EXAMPLE |
| A40 | EXISTENCE | B & M | EXISTENCE | 0.6 | — | V.G. | 1.95 | INVENTIVE EXAMPLE |
| A41 | EXISTENCE | B & M | EXISTENCE | 1.0 | — | V.G. | 1.93 | INVENTIVE EXAMPLE |
| A42 | EXISTENCE | B & M | EXISTENCE | 1.4 | — | V.G. | 1.94 | INVENTIVE EXAMPLE |
| A43 | EXISTENCE | B & M | EXISTENCE | 1.6 | — | V.G. | 1.97 | INVENTIVE EXAMPLE |
| A44 | EXISTENCE | B & M | EXISTENCE | 1.2 | — | V.G. | 1.93 | INVENTIVE EXAMPLE |
| A45 | EXISTENCE | B & M | EXISTENCE | 0.8 | — | V.G. | 1.93 | INVENTIVE EXAMPLE |
| A46 | EXISTENCE | B & M | EXISTENCE | 1.1 | — | V.G. | 1.92 | INVENTIVE EXAMPLE |
| A47 | EXISTENCE | B & M | EXISTENCE | 0.9 | — | V.G. | 1.94 | INVENTIVE EXAMPLE |
| A48 | EXISTENCE | B & M | EXISTENCE | 0.7 | — | V.G. | 1.95 | INVENTIVE EXAMPLE |
| A49 | EXISTENCE | B & M | EXISTENCE | 0.8 | — | V.G. | 1.96 | INVENTIVE EXAMPLE |
| A50 | EXISTENCE | B & M | EXISTENCE | 0.9 | — | V.G. | 1.93 | INVENTIVE EXAMPLE |
| A51 | EXISTENCE | B & M | EXISTENCE | 1.1 | — | V.G. | 1.93 | INVENTIVE EXAMPLE |

TABLE 35

| | PRODUCTION RESULTS PRODUCTION RESULTS OF GLASS FILM | | | | | EVALUATION RESULTS | | |
|---|---|---|---|---|---|---|---|---|
| | Mn-CONTANING OXIDE | | | | | | | |
| TEST No. | EXISTENCE | TYPE (B: BRAUNITE) (M: $Mn_3O_4$) | EXISTENCE AT INTERFACE | NUMBER DENSITY AT INTERFACE PIECES/$\mu m^2$ | DIFFRACTED INTENSITY OF $I_{For}$ AND $I_{TiN}$ BY XRD | FILM ADHESION | MAGNETIC FLUX DENSITY B8 T | NOTE |
| A52 | EXISTENCE | B & M | EXISTENCE | 1.7 | — | V.G. | 1.94 | INVENTIVE EXAMPLE |
| A53 | EXISTENCE | B & M | EXISTENCE | 1.4 | — | V.G. | 1.95 | INVENTIVE EXAMPLE |
| A54 | EXISTENCE | B & M | EXISTENCE | 0.9 | — | V.G. | 1.92 | INVENTIVE EXAMPLE |
| A55 | EXISTENCE | B & M | EXISTENCE | 1.3 | — | V.G. | 1.94 | INVENTIVE EXAMPLE |
| A56 | EXISTENCE | B & M | EXISTENCE | 0.6 | — | V.G. | 1.93 | INVENTIVE EXAMPLE |
| B26 | NONE | — | — | — | — | Bad | 1.95 | COMPARATIVE EXAMPLE |
| B27 | — | — | — | — | — | — | 1.79 | COMPARATIVE EXAMPLE |
| B28 | NONE | — | — | — | — | Bad | 1.92 | COMPARATIVE EXAMPLE |
| B29 | NONE | — | — | — | — | Bad | 1.91 | COMPARATIVE EXAMPLE |
| B30 | NONE | — | — | — | — | Bad | 1.89 | COMPARATIVE EXAMPLE |
| B31 | NONE | — | — | — | — | Bad | 1.89 | COMPARATIVE EXAMPLE |
| B32 | NONE | — | — | — | — | Bad | 1.89 | COMPARATIVE EXAMPLE |
| B33 | NONE | — | — | — | — | Bad | 1.89 | COMPARATIVE EXAMPLE |
| A57 | EXISTENCE | B & M | EXISTENCE | 0.1 | — | Good | 1.92 | INVENTIVE EXAMPLE |
| A58 | EXISTENCE | B & M | EXISTENCE | 0.4 | — | Good | 1.91 | INVENTIVE EXAMPLE |
| A59 | EXISTENCE | B & M | EXISTENCE | 0.2 | — | Good | 1.92 | INVENTIVE EXAMPLE |
| A60 | EXISTENCE | B & M | EXISTENCE | 0.2 | — | Good | 1.91 | INVENTIVE EXAMPLE |
| A61 | EXISTENCE | B & M | EXISTENCE | 0.2 | — | Good | 1.92 | INVENTIVE EXAMPLE |
| A62 | EXISTENCE | B & M | EXISTENCE | 0.3 | — | Good | 1.93 | INVENTIVE EXAMPLE |

TABLE 36

| | PRODUCTION RESULTS PRODUCTION RESULTS OF GLASS FILM | | | | | | | |
|---|---|---|---|---|---|---|---|---|
| | Mn-CONTANING OXIDE | | | | | EVALUATION RESULTS | | |
| TEST No. | EXISTENCE | TYPE (B: BRAUNITE) (M: $Mn_3O_4$) | EXISTENCE AT INTERFACE | NUMBER DENSITY AT INTERFACE PIECES/μm$^2$ | DIFFRACTED INTENSITY OF $I_{For}$ AND $I_{TiN}$ BY XRD | FILM ADHESION | MAGNETIC FLUX DENSITY B8 T | NOTE |
| A63 | EXISTENCE | B & M | EXISTENCE | 0.2 | — | Good | 1.93 | INVENTIVE EXAMPLE |
| A64 | EXISTENCE | B & M | EXISTENCE | 0.1 | — | Good | 1.92 | INVENTIVE EXAMPLE |
| A65 | EXISTENCE | B & M | EXISTENCE | 1.8 | — | V.G. | 1.91 | INVENTIVE EXAMPLE |
| A66 | EXISTENCE | B & M | EXISTENCE | 1.4 | — | V.G. | 1.93 | INVENTIVE EXAMPLE |
| A67 | EXISTENCE | B & M | EXISTENCE | 0.9 | — | V.G. | 1.92 | INVENTIVE EXAMPLE |
| A68 | EXISTENCE | B & M | EXISTENCE | 0.7 | — | V.G. | 1.93 | INVENTIVE EXAMPLE |
| A69 | EXISTENCE | B & M | EXISTENCE | 1.1 | — | V.G. | 1.91 | INVENTIVE EXAMPLE |
| A70 | EXISTENCE | B & M | EXISTENCE | 1.5 | — | V.G. | 1.92 | INVENTIVE EXAMPLE |
| A71 | EXISTENCE | B & M | EXISTENCE | 1.1 | — | V.G. | 1.91 | INVENTIVE EXAMPLE |
| A72 | EXISTENCE | B & M | EXISTENCE | 1.0 | — | V.G. | 1.93 | INVENTIVE EXAMPLE |
| A73 | EXISTENCE | B & M | EXISTENCE | 1.7 | — | V.G. | 1.93 | INVENTIVE EXAMPLE |
| A74 | EXISTENCE | B & M | EXISTENCE | 0.7 | — | V.G. | 1.95 | INVENTIVE EXAMPLE |
| A75 | EXISTENCE | B & M | EXISTENCE | 1.0 | — | V.G. | 1.96 | INVENTIVE EXAMPLE |
| A76 | EXISTENCE | B & M | EXISTENCE | 1.3 | — | V.G. | 1.92 | INVENTIVE EXAMPLE |
| A77 | EXISTENCE | B & M | EXISTENCE | 7.5 | — | Excellent | 1.91 | INVENTIVE EXAMPLE |
| A78 | EXISTENCE | B & M | EXISTENCE | 1.2 | — | V.G. | 1.94 | INVENTIVE EXAMPLE |
| A79 | EXISTENCE | B & M | EXISTENCE | 5.6 | — | Excellent | 1.94 | INVENTIVE EXAMPLE |
| A80 | EXISTENCE | B & M | EXISTENCE | 8.9 | — | Excellent | 1.95 | INVENTIVE EXAMPLE |
| A81 | EXISTENCE | B & M | EXISTENCE | 2.5 | — | Excellent | 1.96 | INVENTIVE EXAMPLE |

TABLE 37

| | PRODUCTION RESULTS PRODUCTION RESULTS OF GLASS FILM | | | | | | | |
|---|---|---|---|---|---|---|---|---|
| | Mn-CONTANING OXIDE | | | | | EVALUATION RESULTS | | |
| TEST No. | EXISTENCE | TYPE (B: BRAUNITE) (M: $Mn_3O_4$) | EXISTENCE AT INTERFACE | NUMBER DENSITY AT INTERFACE PIECES/μm$^2$ | DIFFRACTED INTENSITY OF $I_{For}$ AND $I_{TiN}$ BY XRD | FILM ADHESION | MAGNETIC FLUX DENSITY B8 T | NOTE |
| A82 | EXISTENCE | B & M | EXISTENCE | 5.4 | — | Excellent | 1.97 | INVENTIVE EXAMPLE |
| A83 | EXISTENCE | B & M | EXISTENCE | 9.3 | — | Excellent | 1.93 | INVENTIVE EXAMPLE |
| A84 | EXISTENCE | B & M | EXISTENCE | 3.3 | — | Excellent | 1.95 | INVENTIVE EXAMPLE |
| A85 | EXISTENCE | B & M | EXISTENCE | 4.8 | — | Excellent | 1.94 | INVENTIVE EXAMPLE |
| A86 | EXISTENCE | B & M | EXISTENCE | 5.1 | — | Excellent | 1.93 | INVENTIVE EXAMPLE |
| A87 | EXISTENCE | B & M | EXISTENCE | 6.9 | — | Excellent | 1.95 | INVENTIVE EXAMPLE |
| A88 | EXISTENCE | B & M | EXISTENCE | 4.2 | — | Excellent | 1.93 | INVENTIVE EXAMPLE |
| A89 | EXISTENCE | B & M | EXISTENCE | 3.8 | — | Excellent | 1.95 | INVENTIVE EXAMPLE |
| A90 | EXISTENCE | B & M | EXISTENCE | 5.4 | — | Excellent | 1.96 | INVENTIVE EXAMPLE |
| A91 | EXISTENCE | B & M | EXISTENCE | 8.7 | — | Excellent | 1.93 | INVENTIVE EXAMPLE |
| A92 | EXISTENCE | B & M | EXISTENCE | 1.9 | — | V.G. | 1.96 | INVENTIVE EXAMPLE |
| A93 | EXISTENCE | B & M | EXISTENCE | 1.2 | — | V.G. | 1.95 | INVENTIVE EXAMPLE |
| A94 | EXISTENCE | B & M | EXISTENCE | 1.4 | — | V.G. | 1.92 | INVENTIVE EXAMPLE |
| A95 | EXISTENCE | B & M | EXISTENCE | 0.8 | — | V.G. | 1.93 | INVENTIVE EXAMPLE |
| A96 | EXISTENCE | B & M | EXISTENCE | 0.4 | — | Good | 1.93 | INVENTIVE EXAMPLE |
| A97 | EXISTENCE | B & M | EXISTENCE | 0.3 | — | Good | 1.92 | INVENTIVE EXAMPLE |
| A98 | EXISTENCE | B & M | EXISTENCE | 0.4 | — | Good | 1.90 | INVENTIVE EXAMPLE |
| A99 | EXISTENCE | B & M | EXISTENCE | 0.3 | — | Good | 1.94 | INVENTIVE EXAMPLE |
| A100 | EXISTENCE | B & M | EXISTENCE | 0.2 | — | Good | 1.91 | INVENTIVE EXAMPLE |

TABLE 38

| | PRODUCTION RESULTS PRODUCTION RESULTS OF GLASS FILM | | | | | EVALUATION RESULTS | | |
|---|---|---|---|---|---|---|---|---|
| | Mn-CONTANING OXIDE | | | | | | | |
| TEST No. | EXISTENCE | TYPE (B: BRAUNITE) (M: $Mn_3O_4$) | EXISTENCE AT INTERFACE | NUMBER DENSITY AT INTERFACE PIECES/μm$^2$ | DIFFRACTED INTENSITY OF $I_{For}$ AND $I_{TiN}$ BY XRD | FILM ADHESION | MAGNETIC FLUX DENSITY B8 T | NOTE |
| A101 | EXISTENCE | B & M | EXISTENCE | 0.4 | — | Good | 1.92 | INVENTIVE EXAMPLE |
| A102 | EXISTENCE | B & M | EXISTENCE | 0.3 | — | Good | 1.93 | INVENTIVE EXAMPLE |
| A103 | EXISTENCE | B & M | EXISTENCE | 0.3 | — | Good | 1.94 | INVENTIVE EXAMPLE |
| A104 | EXISTENCE | B & M | EXISTENCE | 0.2 | — | Good | 1.92 | INVENTIVE EXAMPLE |
| A105 | EXISTENCE | B & M | EXISTENCE | 0.3 | — | Good | 1.93 | INVENTIVE EXAMPLE |
| A106 | EXISTENCE | B & M | EXISTENCE | 0.2 | — | Good | 1.95 | INVENTIVE EXAMPLE |
| A107 | EXISTENCE | B & M | EXISTENCE | 0.3 | — | Good | 1.94 | INVENTIVE EXAMPLE |
| A108 | EXISTENCE | B & M | EXISTENCE | 0.1 | — | Good | 1.92 | INVENTIVE EXAMPLE |
| A109 | EXISTENCE | B & M | EXISTENCE | 0.4 | — | Good | 1.93 | INVENTIVE EXAMPLE |
| A110 | EXISTENCE | B & M | EXISTENCE | 0.3 | — | Good | 1.91 | INVENTIVE EXAMPLE |
| A111 | EXISTENCE | B & M | EXISTENCE | 0.2 | — | Good | 1.94 | INVENTIVE EXAMPLE |
| A112 | EXISTENCE | B & M | EXISTENCE | 0.1 | — | Good | 1.93 | INVENTIVE EXAMPLE |
| A113 | EXISTENCE | B & M | EXISTENCE | 0.3 | — | Good | 1.94 | INVENTIVE EXAMPLE |
| A114 | EXISTENCE | B & M | EXISTENCE | 0.3 | — | Good | 1.97 | INVENTIVE EXAMPLE |
| A115 | EXISTENCE | B & M | EXISTENCE | 0.2 | — | Good | 1.94 | INVENTIVE EXAMPLE |
| A116 | EXISTENCE | B & M | EXISTENCE | 0.4 | — | Good | 1.93 | INVENTIVE EXAMPLE |
| A117 | EXISTENCE | B & M | EXISTENCE | 0.3 | — | Good | 1.92 | INVENTIVE EXAMPLE |
| A118 | EXISTENCE | B & M | EXISTENCE | 1.8 | — | V.G. | 1.95 | INVENTIVE EXAMPLE |
| A119 | EXISTENCE | B & M | EXISTENCE | 1.5 | — | V.G. | 1.93 | INVENTIVE EXAMPLE |

TABLE 39

| | PRODUCTION RESULTS PRODUCTION RESULTS OF GLASS FILM | | | | | EVALUATION RESULTS | | |
|---|---|---|---|---|---|---|---|---|
| | Mn-CONTANING OXIDE | | | | | | | |
| TEST No. | EXISTENCE | TYPE (B: BRAUNITE) (M: $Mn_3O_4$) | EXISTENCE AT INTERFACE | NUMBER DENSITY AT INTERFACE PIECES/μm$^2$ | DIFFRACTED INTENSITY OF $I_{For}$ AND $I_{TiN}$ BY XRD | FILM ADHESION | MAGNETIC FLUX DENSITY B8 T | NOTE |
| A120 | EXISTENCE | B & M | EXISTENCE | 1.7 | — | V.G. | 1.96 | INVENTIVE EXAMPLE |
| A121 | EXISTENCE | B & M | EXISTENCE | 0.6 | — | V.G. | 1.95 | INVENTIVE EXAMPLE |
| A122 | EXISTENCE | B & M | EXISTENCE | 1.4 | — | V.G. | 1.94 | INVENTIVE EXAMPLE |
| A123 | EXISTENCE | B & M | EXISTENCE | 0.9 | — | V.G. | 1.93 | INVENTIVE EXAMPLE |
| A124 | EXISTENCE | B & M | EXISTENCE | 1.6 | — | V.G. | 1.94 | INVENTIVE EXAMPLE |
| A125 | EXISTENCE | B & M | EXISTENCE | 1.3 | — | V.G. | 1.92 | INVENTIVE EXAMPLE |
| B34 | — | — | — | — | — | — | 1.66 | COMPARATIVE EXAMPLE |
| B35 | — | — | — | — | — | — | 1.73 | COMPARATIVE EXAMPLE |
| B36 | — | — | — | — | — | — | 1.55 | COMPARATIVE EXAMPLE |
| B37 | — | — | — | — | — | — | 1.77 | COMPARATIVE EXAMPLE |
| B38 | — | — | — | — | — | — | 1.76 | COMPARATIVE EXAMPLE |
| B39 | — | — | — | — | — | — | 1.75 | COMPARATIVE EXAMPLE |
| B40 | — | — | — | — | — | — | 1.74 | COMPARATIVE EXAMPLE |
| B41 | — | — | — | — | — | — | 1.72 | COMPARATIVE EXAMPLE |
| B42 | — | — | — | — | — | — | 1.75 | COMPARATIVE EXAMPLE |
| A126 | EXISTENCE | B & M | EXISTENCE | 0.02 | — | Fair | 1.90 | INVENTIVE EXAMPLE |
| A127 | EXISTENCE | OTHER | EXISTENCE | 0.03 | — | Fair | 1.90 | INVENTIVE EXAMPLE |
| A128 | EXISTENCE | B | EXISTENCE | 0.04 | — | Good | 1.91 | INVENTIVE EXAMPLE |
| A129 | EXISTENCE | M | EXISTENCE | 0.03 | — | Good | 1.89 | INVENTIVE EXAMPLE |

TABLE 40

| | PRODUCTION RESULTS PRODUCTION RESULTS OF GLASS FILM | | | | | EVALUATION RESULTS | | |
|---|---|---|---|---|---|---|---|---|
| | Mn-CONTAINING | | | | | | | |
| TEST No. | EXISTENCE | TYPE (B: BRAUNITE) (M: $Mn_3O_4$) | EXISTENCE AT INTERFACE | NUMBER DENSITY AT INTERFACE PIECES/$\mu m^2$ | DIFFRACTED INTENSITY OF $I_{For}$ AND $I_{TiN}$ BY XRD | FILM ADHESION | MAGNETIC FLUX DENSITY B8 T | NOTE |
| A130 | EXISTENCE | B & M | NONE | — | — | Fair | 1.90 | INVENTIVE EXAMPLE |
| A131 | EXISTENCE | B & M | EXISTENCE | 0.03 | Good | Good | 1.90 | INVENTIVE EXAMPLE |
| A132 | EXISTENCE | B & M | EXISTENCE | 1.1 | Good | Good | 1.90 | INVENTIVE EXAMPLE |
| A133 | EXISTENCE | B & M | EXISTENCE | 3.5 | Good | Excellent | 1.96 | INVENTIVE EXAMPLE |
| B43 | NONE | — | — | — | Bad | Bad | 1.90 | COMPARATIVE EXAMPLE |
| B44 | NONE | — | — | — | — | Bad | 1.90 | COMPARATIVE EXAMPLE |
| B45 | — | — | — | — | — | — | 1.69 | COMPARATIVE EXAMPLE |
| B46 | — | — | — | — | — | — | 1.73 | COMPARATIVE EXAMPLE |
| B47 | — | — | — | — | — | — | 1.71 | COMPARATIVE EXAMPLE |
| B48 | — | — | — | — | — | — | — | COMPARATIVE EXAMPLE |
| B49 | — | — | — | — | — | — | 1.70 | COMPARATIVE EXAMPLE |
| B50 | — | — | — | — | — | — | 1.72 | COMPARATIVE EXAMPLE |
| B51 | — | — | — | — | — | — | — | COMPARATIVE EXAMPLE |
| B52 | NONE | — | — | — | — | Poor | 1.91 | COMPARATIVE EXAMPLE |
| B53 | NONE | — | — | — | — | Bad | 1.89 | COMPARATIVE EXAMPLE |

INDUSTRIAL APPLICABILITY

According to the above aspects of the present invention, it is possible to provide the grain-oriented electrical steel sheet excellent in the coating adhesion without deteriorating the magnetic characteristics, and method for producing thereof. Accordingly, the present invention has significant industrial applicability.

REFERENCE SIGNS LIST

1 Grain-oriented electrical steel sheet
11 Silicon steel sheet (base steel sheet)
13 Glass film (primary coating)
131 Mn-containing oxide (Braunite, $Mn_3O_4$, or the like)
15 Insulation coating (secondary coating)

What is claimed is:

1. A grain-oriented electrical steel sheet comprising:
a silicon steel sheet including, as a chemical composition, by mass %,
2.50 to 4.0% of Si,
0.010 to 0.50% of Mn,
0 to 0.20% of C,
0 to 0.070% of acid-soluble Al,
0 to 0.020% of N,
0 to 0.080% of S,
0 to 0.020% of Bi,
0 to 0.50% of Sn,
0 to 0.50% of Cr,
0 to 1.0% of Cu, and
a balance comprising Fe and impurities;
a glass film arranged on a surface of the silicon steel sheet; and
an insulation coating arranged on a surface of the glass film,
wherein the glass film includes a Mn-containing oxide including at least Braunite.

2. The grain-oriented electrical steel sheet according to claim 1,
wherein the Mn-containing oxide further includes $Mn_3O_4$.

3. The grain-oriented electrical steel sheet according to claim 2,
wherein the Mn-containing oxide is arranged at an interface with the silicon steel sheet in the glass film.

4. The grain-oriented electrical steel sheet according to claim 3,
wherein 0.1 to 30 pieces/$\mu m^2$ of the Mn-containing oxide are arranged at the interface in the glass film.

5. The grain-oriented electrical steel sheet according to claim 1,
wherein the Mn-containing oxide is arranged at an interface with the silicon steel sheet in the glass film.

6. The grain-oriented electrical steel sheet according to claim 5,
wherein 0.1 to 30 pieces/$\mu m^2$ of the Mn-containing oxide are arranged at the interface in the glass film.

7. The grain-oriented electrical steel sheet according to claim 1,
wherein $I_{For}$ is a diffracted intensity of a peak originated in a forsterite, and $I_{TiN}$ is a diffracted intensity of a peak originated in a titanium nitride in a range of $41° < 2\theta < 43°$ of an X-ray diffraction spectrum of the glass film measured by an X-ray diffraction method, and
wherein the $I_{For}$ and the $I_{TiN}$ satisfy: $I_{TiN} < I_{For}$.

8. The grain-oriented electrical steel sheet according to claim 1,
wherein a number fraction of secondary recrystallized grains whose maximum diameter is 30 to 100 mm is 20 to 80% as compared with entire secondary recrystallized grains in the silicon steel sheet.

9. The grain-oriented electrical steel sheet according to claim 1, wherein an average thickness of the silicon steel sheet is 0.17 mm or more and less than 0.22 mm.

10. The grain-oriented electrical steel sheet according to claim 1, wherein the silicon steel sheet includes, as the chemical composition, by mass %, at least one comprising 0.0001 to 0.0050% of C, 0.0001 to 0.0100% of acid-soluble Al, 0.0001 to 0.0100% of N, 0.0001 to 0.0100% of S, 0.0001 to 0.0010% of Bi, 0.005 to 0.50% of Sn, 0.01 to 0.50% of Cr, and 0.01 to 1.0% of Cu.

11. A method for producing the grain-oriented electrical steel sheet according to claim 1, the method comprising:

a hot rolling process of heating a slab to a temperature range of 1200 to 1600° C. and then hot-rolling the slab to obtain a hot rolled steel sheet, the slab including, as the chemical composition, by mass %, 2.50 to 4.0% of Si, 0.010 to 0.50% of Mn, 0 to 0.20% of C, 0 to 0.070% of acid-soluble Al, 0 to 0.020% of N, 0 to 0.080% of S, 0 to 0.020% of Bi, 0 to 0.50% of Sn, 0 to 0.50% of Cr, 0 to 1.0% of Cu, a balance comprising Fe and impurities;

a hot band annealing process of annealing the hot rolled steel sheet to obtain a hot band annealed sheet;

a cold rolling process of cold-rolling the hot band annealed sheet by cold-rolling once or by cold-rolling plural times with an intermediate annealing to obtain a cold rolled steel sheet;

a decarburization annealing process of decarburization-annealing the cold rolled steel sheet to obtain a decarburization annealed sheet;

a final annealing process of applying an annealing separator to the decarburization annealed sheet and then final-annealing the decarburization annealed sheet so as to form a glass film on a surface of the decarburization annealed sheet to obtain a final annealed sheet; and an insulation coating forming process of applying an insulation coating forming solution to the final annealed sheet and then heat-treating the final annealed sheet so as to form an insulation coating on a surface of the final annealed sheet, wherein, in the decarburization annealing process, when a dec-$S_{500-600}$ is an average heating rate in units of ° C./second and a dec-$P_{500-600}$ is an oxidation degree $PH_2O/PH_2$ of an atmosphere in a temperature range of 500 to 600° C. during raising a temperature of the cold rolled steel sheet and when a dec-$S_{600-700}$ is an average heating rate in units of ° C./second and a dec-$P_{600-700}$ is an oxidation degree $PH_2O/PH_2$ of an atmosphere in a temperature range of 600 to 700° C. during raising the temperature of the cold rolled steel sheet, the dec-$S_{500-600}$ is 300 to 2000° C./second, the dec-$S_{600-700}$ is 300 to 3000° C./second, the dec-$S_{500-600}$ and the dec-$S_{600-700}$ satisfy dec-$S_{500-600}$<dec-$S_{600-700}$, the dec-$P_{500-600}$ is 0.00010 to 0.50, and the dec-$P_{600-700}$ is 0.00001 to 0.50, wherein, in the final annealing process, the decarburization annealed sheet after applying the annealing separator is held in a temperature range of 1000 to 1300° C. for 10 to 60 hours, and wherein, in the insulation coating forming process, when an ins-$S_{500-600}$ is an average heating rate in units of ° C./second in a temperature range of 600 to 700° C. and an ins-$S_{700-800}$ is an average heating rate in units of ° C./second in a temperature range of 700 to 800° C. during raising the temperature of the final annealed sheet, the ins-$S_{500-600}$ is 10 to 200° C./second, the ins-$S_{700-800}$ is 5 to 100° C./second, and the ins-$S_{500-600}$ and the ins-$S_{700-800}$ satisfy ins-$S_{500-600}$>ins-$S_{700-800}$, thereby producing the grain-oriented electrical steel sheet of claim 1.

12. The method for producing the grain-oriented electrical steel sheet according to claim 11, wherein, in the decarburization annealing process, the dec-$P_{500-600}$ and the dec-$P_{600-700}$ satisfy dec-$P_{500-600}$>dec-$P_{600-700}$.

13. The method for producing the grain-oriented electrical steel sheet according to claim 11, wherein, in the decarburization annealing process, a first annealing and a second annealing are conducted after raising the temperature of the cold rolled steel sheet, and wherein when a dec-$T_I$ is a holding temperature in units of ° C., a dec-$t_I$ is a holding time in units of second, and a dec-$P_I$ is an oxidation degree $PH_2O/PH_2$ of an atmosphere during the first annealing and when a dec-$T_{II}$ is a holding temperature in units of ° C., a dec-$t_{II}$ is a holding time in units of second, and a dec-$P_{II}$ is an oxidation degree $PH_2O/PH_2$ of an atmosphere during the second annealing, the dec-$T_I$ is 700 to 900° C., the dec-$t_I$ is 10 to 1000 seconds, the dec-$P_I$ is 0.10 to 1.0, the dec-$T_{II}$ is (dec-$T_I$+50)° C. or more and 1000° C. or less, the dec-$t_{II}$ is 5 to 500 seconds, the dec-$P_{II}$ is 0.00001 to 0.10, and the dec-$P_I$ and the dec-$P_{II}$ satisfy dec-$P_I$>dec-$P_{II}$.

14. The method for producing the grain-oriented electrical steel sheet according to claim 13, wherein, in the decarburization annealing process, the dec-$P_{500-600}$, the dec-$P_{600-700}$, the dec-$P_I$, and the dec-$P_{II}$ satisfy dec-$P_{500-600}$>dec-$P_{600-700}$<dec-$P_I$>dec-$P_{II}$.

15. The method for producing the grain-oriented electrical steel sheet according to claim 11, wherein, in the insulation coating forming process, when an ins-$P_{600-700}$ is an oxidation degree $PH_2O/PH_2$ of an atmosphere in the temperature range of 600 to 700° C. and an ins-$P_{700-800}$ is an oxidation degree $PH_2O/PH_2$ of an atmosphere in the temperature range of 700 to 800° C. during raising the temperature of the final annealed sheet, the ins-$P_{600-700}$ is 1.0 or more, the ins-$P_{700-800}$ is 0.1 to 5.0, and the ins-$P_{600-700}$ and the ins-$P_{700-800}$ satisfy ins-$P_{600-700}$>ins-$P_{700-800}$.

16. The method for producing the grain-oriented electrical steel sheet according to claim 11, wherein, in the final annealing process, the annealing separator includes a Ti-compound of 0.5 to 10 mass % in metallic Ti equivalent.

17. The method for producing the grain-oriented electrical steel sheet according to claim 11, wherein the slab includes, as the chemical composition, by mass %, at least one comprising 0.01 to 0.20% of C, 0.01 to 0.070% of acid-soluble Al, 0.0001 to 0.020% of N, 0.005 to 0.080% of S, 0.001 to 0.020% of Bi, 0.005 to 0.50% of Sn, 0.01 to 0.50% of Cr, and 0.01 to 1.0% of Cu.

* * * * *